US010130925B2

(12) United States Patent
Misono

(10) Patent No.: US 10,130,925 B2
(45) Date of Patent: Nov. 20, 2018

(54) STIRRING DEVICES

(71) Applicant: Kunio Misono, Reno, NV (US)

(72) Inventor: Kunio Misono, Reno, NV (US)

( * ) Notice: Subject to any disclaimer, the term of this patent is extended or adjusted under 35 U.S.C. 154(b) by 304 days.

(21) Appl. No.: 15/050,474

(22) Filed: Feb. 23, 2016

(65) Prior Publication Data

US 2016/0250609 A1 Sep. 1, 2016

Related U.S. Application Data

(62) Division of application No. 14/048,916, filed on Oct. 8, 2013, now Pat. No. 9,302,234.

(60) Provisional application No. 61/878,351, filed on Sep. 16, 2013, provisional application No. 61/833,837, filed on Jun. 11, 2013, provisional application No. 61/786,541, filed on Mar. 15, 2013, provisional application No. 61/711,718, filed on Oct. 9, 2012.

(51) Int. Cl.

| | |
|---|---|
| ***B01F 11/00*** | (2006.01) |
| ***B01F 13/00*** | (2006.01) |
| ***B01L 3/02*** | (2006.01) |
| ***B01F 13/10*** | (2006.01) |

(52) U.S. Cl.

CPC ..... *B01F 13/0025* (2013.01); *B01F 11/0005* (2013.01); *B01F 11/008* (2013.01); *B01F 11/0014* (2013.01); *B01F 13/1022* (2013.01); *B01L 3/0217* (2013.01); *B01L 3/0275* (2013.01); *B01F 2215/0037* (2013.01); *B01L 2200/021* (2013.01); *B01L 2300/0829* (2013.01); *B01L 2400/0433* (2013.01)

(58) Field of Classification Search

None

See application file for complete search history.

(56) References Cited

U.S. PATENT DOCUMENTS 3,780,992 A * 12/1973 Nishi ..... B01F 11/04 222/198
4,046,515 A * 9/1977 de Leeuw ..... B01F 11/008 366/117
4,846,003 A * 7/1989 Marquiss ..... B01L 3/0275 422/931
8,357,544 B2 * 1/2013 Ingenhoven ..... B01L 3/021 141/2

(Continued)

*Primary Examiner* — Jill A Warden
*Assistant Examiner* — Brittany I Fisher
(74) *Attorney, Agent, or Firm* — James J. Wong

(57) ABSTRACT

An embodiment of the present disclosure provides a hand held pipette for aspirating and dispensing liquids including, a stirring device assembly, including a vibration inducing unit, a power source for the vibration inducing unit, and a control for the vibration inducing unit. Another embodiment of the present disclosure provides a microplate stirring device including, an orbital plate module having a proximal and distal side; at least one vibration inducing unit attached to the proximal side of said orbital plate module; and a base plate for receiving the microplate. Another embodiment of the present disclosure provides a liquid handling system used for aspirating and dispensing liquids including, a stirring module assembly. Another embodiment of the present disclosure provides a manual stirring device including, a vibration inducing unit; a power source for the vibration inducing unit; and a control for the vibration inducing unit.

16 Claims, 96 Drawing Sheets

(56) References Cited

U.S. PATENT DOCUMENTS

| | | | | |
|---|---|---|---|---|
| 2008/0078257 | A1* | 4/2008 | Daniel | B01F 11/0077 73/864.01 |
| 2010/0024529 | A1* | 2/2010 | Dillingham | G01N 13/02 73/64.52 |
| 2011/0000276 | A1* | 1/2011 | Wassermeier | B01L 3/0275 73/1.74 |

* cited by examiner

STIRRING DEVICES

CROSS-REFERENCES TO RELATED APPLICATIONS

This utility application is a divisional application of U.S. patent application Ser. No. 14/048,916 filed Oct. 8, 2013, which claims priority to U.S. Provisional Patent Application No. 61/878,351 entitled "Stirring Devices" filed on Sep. 16, 2013; U.S. Provisional Patent Application No. 61/833,837 entitled "Stirring Devices" filed on Jun. 11, 2013; U.S. Provisional Patent Application No. 61/786,541 entitled "Stirring Devices" filed on Mar. 15, 2013; and U.S. Provisional Patent Application No. 61/711,718 entitled "Stirring Devices" filed on Oct. 9, 2012, all of which are hereby incorporated by reference for all purposes.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

The present invention is directed to the technical field of laboratory mixing and stirring devices, particularly devices that are used for dissolving or mixing materials and reagents. It is readily appreciated by those of ordinary skill in the art that thorough mixing is critical in performing processes such as chemical reactions, biological reactions and assays.

The discovery of new beneficial therapeutic agents requires the testing of chemical and biological candidates to determine whether a single candidate or class of candidates have sufficient desired characteristics to warrant further investigation and development. High throughput screening is a valuable tool for the rapid testing of large numbers of chemical and biological agents using robotics, data processing, control software, liquid handling devices and detectors. One essential, although somewhat unassuming, piece of equipment in this process is the microtiter plate, also commonly referred to as a microplate or microwell plate. A microplate typically has 6, 24, 96, 384 or even 1536 sample wells arranged in a 2 by 3 ratio rectangular matrix, such as the 8×12, 96 well microplate. Microplates having 3456 and 9600 wells have also been investigated for feasibility. The dimensions of a typical microplate are generally 5 inch by 3⅜ inch (128 mm by 86 mm) with a height of ⅜ inch to ⅝ inch (9.5 mm to 16 mm). Regardless of the number of wells, all of the wells are located in an area that is 4¼ inch by 2⅞ in (108 mm×73 mm). Therefore increasing the number of wells per plate results in increasing the density of the wells for each plate because the size of the plate is not increased. As expected, this also results in wells having smaller volumes, and thus making it difficult to mix the contents of the wells.

Microplates are flat plates having multiple wells arranged in standardized formats, in which each well serves as a test tube. Microplates are used in high-throughput (HTP) assays for such purposes as compound screening for drug discovery, diagnostic testing and genomic analyses. Microplates commonly used for HTP assays include 96-well, 384-well and 1536-well plates. The nominal capacities of the wells in these plates are 380 μl, 120 μl and 12 μl, respectively; the recommended working assay volumes are 200 μl, 80 μl, and 8 μl, respectively (see Table 1). At such small volumes, adequate mixing is difficult because of the tendency of the liquids to adhere to the wall and not to freely move. Thorough mixing is necessary to obtain reliable assay data. Mixing is critical in assays that use particulate components in test mixtures, such as bio-conjugate beads (for example polymer beads conjugated with the assay target or reporter molecules) and, sub-cellular particles, as those components precipitate without mixing. Mixing is also critical in assays using cells which grow attached to the well surfaces and do not move about in the assay medium.

TABLE 1

Microplates commonly used in high-throughput assays.

| Microplate | Well arrangement | Well Diameter (mm) | Well Depth (mm) | Well Capacity (μl) | Recommended Assay Volume (μl) |
|---|---|---|---|---|---|
| 96 wells | 8 rows of 12 wells | 7 | 10 | 380 | 200 |
| 384 wells | 16 rows of 24 wells | 3.8 | 10 | 120 | 80 |
| 1536 wells | 32 rows of 48 wells | 1.7 | 5 | 12 | 8 |

High throughput screening provides many benefits, one of which is the relatively small amounts of materials required. This provides the user the ability to acquire data about a large number of candidates at relatively low cost. Hence, there is a continual need to develop assay and screening processes that improves the efficiency of currently configured well plates, as well as developing processes for employing microplates having even larger numbers of wells.

However the use of currently available microplates and microplates that are in development having even greater number of wells is hampered by physical constraints resulting from the smaller wells and the corresponding smaller volumes that they can accommodate. Materials and reagents used for screening assays are often difficult to dissolve. Failure to dissolve the materials for an assay can result in inaccurate or inconsistent data. It has been shown that mixing the contents of the well can alleviate this problem (Hancock, Michael K., Medina, Myleen N., Smith, Brendan M., and Orth, Anthony P., "Microplate Orbital Mixing Improves High-Throughput Cell-Based Reporter Assay Readouts", Journal of Biomolecular Screening 12(1); 2007, 140-144, www.sbsonline.com).

This problem is not easily addressed because of the size of the wells and the corresponding smaller volume of materials. The smaller well size and amounts of materials make it difficult to impart sufficient agitation for thorough mixing of the contents in the well. This challenge is only exacerbated by the trend to employ higher density microplates that is microplates having a greater number of smaller wells, such as the aforementioned 384 well and 1536 well microplates.

There have been attempts to address this problem by mechanically shaking and agitating the entire microplate. However as noted previously, the size of the wells do not lend to the process of agitating the contents of the wells, and is likely to be even less effective with higher density microplates, because of the correspondingly smaller wells.

The need for adequate mixing in microplates has long been recognized and several types of mixing devices have been developed. These include orbital shakers designed for microplate mixing, magnetic stirrer systems, sonicators and acoustic mixers. Each type has its own advantages and disadvantages (Comley, John, "Microplate Mixing—Bioassay Panacea or Proven Distraction?)"

Orbital shakers for microplates have small orbiting radii (1 to 2 mm) and operate at high speeds. Efficient mixing requires shaking speeds as high as several thousand revolutions per minute. Such high-speed shaking tends to cause foaming or splashing of sample liquids, which must be avoided. In a system designed for improved mixing, stationary pins are immersed in the sample wells while the microplate is shaken on an orbital shaker at speeds as fast as several thousand revolutions per minute.

Assays using cultured cells, or cell-based assays, are increasingly used in drug discovery. Mammalian cells widely used in such assays are sensitive to mechanical stress, and shaking of microplates may cause the cells to be disrupted or dislodged from the well surfaces on which they grow (Song O. R., Kim T H, Perrodon X, Lee C, Jeon H K, Seghiri Z, Kwon H J, Cechetto J, Christophe T (2010). Confocal-based method for quantification of diffusion kinetics in microwell plates and its application for identifying a rapid mixing method for high content/throughput screening. J Biomol Screen. 15(2):138-147). Orbital shakers are unsuitable for mammalian cell-based assays.

Mixing by a magnetic stirrer requires a stirrer element placed in each well and, in general, the stirrer element must be removed from the well for sample measurement. These processes are cumbersome and require specifically designed equipment. The system is not readily adaptable to small volumes. The stirrer element may also mechanically disrupt assay components by direct contacts, such as cells growing on the well surfaces.

In a modified system, U-shaped pins equipped with a propeller-like magnetic stirrer element are immersed in the wells. The stirrer elements are then made to spin in a propeller-like motion by the use of a magnetic stirrer. This system is suitable for large volumes but is not readily adaptable to small volumes. Spinning of the stirrer element may also cause splashing of sample liquids.

Sonicators are often used for tissue homogenization and DNA shearing. It is also effective in helping dissolve materials. However, sonication cannot be used for mixing in some assays such as those using cells, sub-cellular particles or bio-conjugate beads. Similarly, acoustic mixing applied at the energy level necessary for efficient mixing is disruptive to cells or other materials. Acoustic mixing may also cause splashing of sample liquids.

Methods or devices that enable efficient yet non-disruptive and controlled mixing are an unmet need for high throughput screening. The present disclosure provides embodiments that address this unsolved need, as well as other related problems.

BRIEF SUMMARY OF THE INVENTION

An embodiment of the present disclosure provides a hand held pipette for aspirating and dispensing liquids including, a hand held portion having a plunger, piston and spring assembly for aspirating and dispensing liquids; an ejector assembly for ejecting pipette tips; and a stirring device assembly, including a vibration inducing unit, a power source for the vibration inducing unit, and a control for the vibration inducing unit.

Another embodiment of the present disclosure provides a microplate stirring device including, an orbital plate module having a proximal and distal side; at least one vibration inducing unit attached to the proximal side of said orbital plate module; and a base plate for receiving the microplate.

Another embodiment of the present disclosure provides a liquid handling system used for aspirating and dispensing liquids including, a controller; liquid handling assembly; a probe head assembly including a pipette tip ejector mechanism, at least one liquid handling channel, and a stirring module assembly.

Another embodiment of the present disclosure provides a manual stirring device including, a vibration inducing unit; a power source for the vibration inducing unit; and a control for the vibration inducing unit.

In the figures showing a cross section view, the D2 direction corresponds to the length or depth of the embodiment depicted. Movement along the D2 direction from the top of the page to the bottom of the page corresponds to movement described in the disclosure as going from proximal to distal.

DETAILED DESCRIPTION OF THE INVENTION

An embodiment of the present disclosure provides a portable stirring device comprising: a casing having a proximal end and a distal end, forming a first internal space, the casing having a first part of an attachment mechanism at the distal end of the casing; a detachable probe housing having: a proximal end and distal end forming a second internal space, the detachable probe housing having a second part of an attachment mechanism at the proximal end of the detachable probe housing; and a tapered appendage at the distal end of the detachable probe housing; a probe tip ejector; a vibration inducing unit enclosed within the second internal space; a power source enclosed within the first internal space for the vibration inducing unit; and a control unit enclosed within the first internal space for the vibration inducing unit.

An aspect of the present embodiment is where the vibration inducing unit is capable of producing vibrations in a range of about 10 vibrations/sec to about 250 vibrations/sec.

As used herein the term "stirring device" refers to an apparatus of the present disclosure used for mixing liquids and/or dissolving solid materials in a liquid. A stirring device can be a freestanding handheld or otherwise portable device, it can be a component built into or attached externally to a pipette, or it can be a component built into or attached externally to a single dispensing head or multiple dispensing heads of an automated or semi automated dispenser system.

As used herein the terms "detachably affixed" or "detachably attached" means that a probe, such as a pin stirring probe, or a pipette stirring probe, is attached to a stirring device sufficiently firmly so that the probe can stir or agitate a desired media causing it to be stirred or mixed without becoming detached. However the probe tip can be detached as desired for replacement with a new probe tip, thereby saving the user time to clean the used tip. The terms "detachably affixed" or "detachably attached" can also refer to the ability of components, parts, modules and the like to be attached or affixed to one another and then to be detached as desired by the user. For example, the detachable probe housing can be attached to the case of the portable stirring device, or it can be optionally detached.

As used herein the terms "orbital revolution", "revolution" or "orbital movement" refer to the movement of an object, for example a probe, or a pin probe module that is part of a pin probe module, rotating about an external point.

Figure 1:
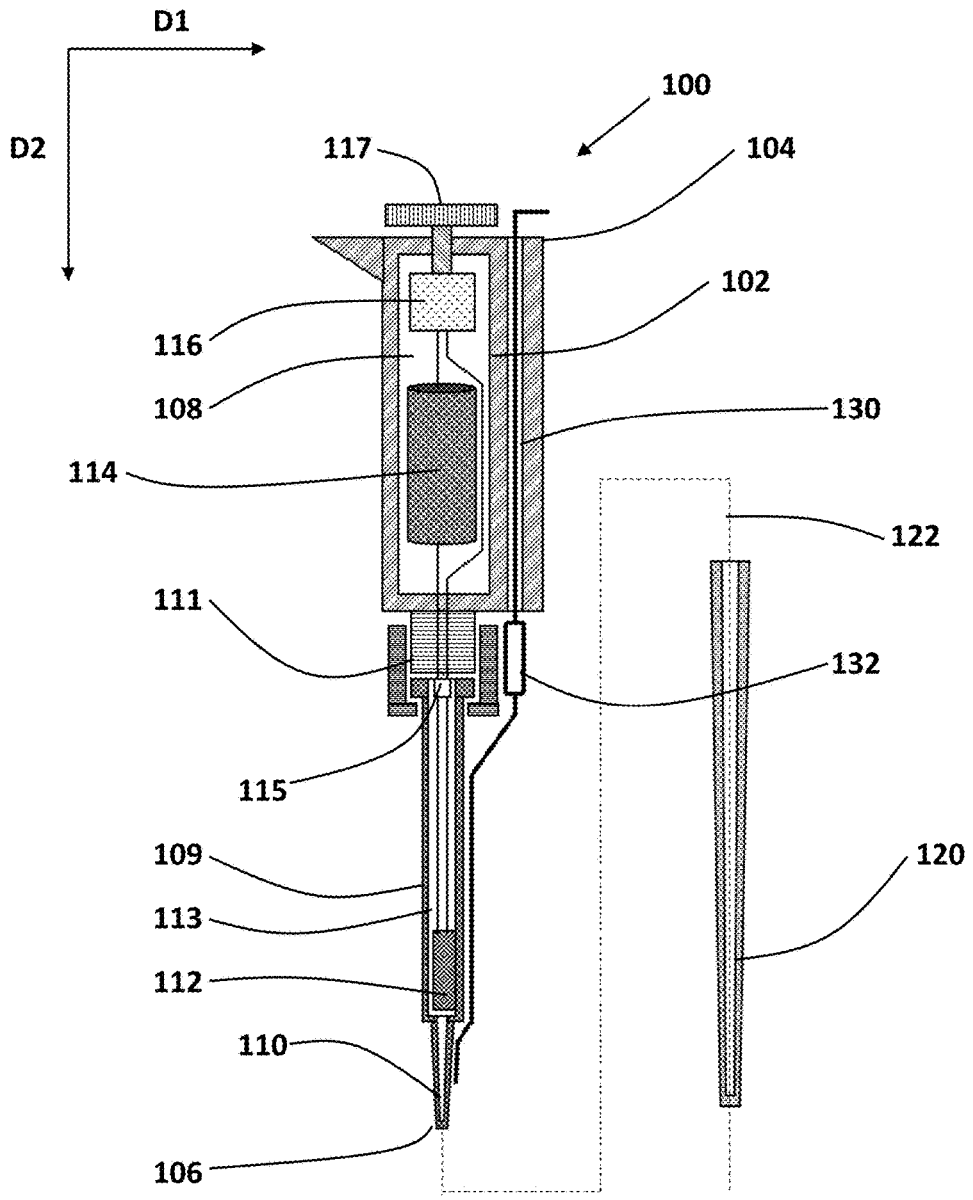
FIG. 1 provides a side view of a portable stirring device embodiment of the present disclosure.

FIG. 1 shows a side plane perspective of a portable stirring device 100 having a lengthwise or longitudinal dimension extending in the D2 direction and a widthwise dimension extending in the D1 direction, the portable stirring device 100 having a proximal end 104 and a distal end 106. The case 102 forms an internal space 108. Within the internal space 108 is a power source 114 for the vibration inducing unit 112 and a control unit 116 for the vibration inducing unit 112. The control unit 116 having a control knob 117 accessible from the outside of the case 102 for turning the power on and off and for varying the voltage of the power to the vibration inducing unit 112. Detachably attached to the case 102 by an attachment mechanism 111, such as a screw and thread assembly, or a bayonet mount, is a detachable probe attachment 109 enclosing the vibration inducing unit 112 and having electrical contact connectors 115 which conducts power from the power source 114 to the vibration inducing unit 112 when the detachable probe attachment 109 is attached to the case 102. The detachable probe attachment 109 includes a tapered appendage 110 located at the distal end 106 of the portable stirring device 100. Reusable or disposed probe tips, such as pipette tips or pin probes are detachably attached to the tapered appendage 110. For this embodiment, an oversized probe tip 120 is depicted to its point of attachment 122 to the tapered appendage 110. The oversized probe tip 120 can be used for regular to larger size vessels, such as those described below. The detachable probe housing 109 forms an internal space 113 which encloses the vibration inducing unit 112. The vibration inducing unit 112, power source 114 and the control unit 116 are all electrically connected such that power is provided to the vibration inducing unit 112, and the user is able to control the amplitude and frequency of the vibration inducing unit 112 through the control unit 116. Also shown is an ejector mechanism 130 for manually ejecting a pipette probe or pin probe from the distal end 106 of the portable stirring device 100 by depressing the mechanism at the proximal end 104 of the portable stirring device

100. The ejector mechanism includes attachment connector 132 that enables the ejector mechanism to detach into two parts that correspond to the detachable probe attachment 109 and the case 102. The case 102 and the detachable probe attachment 109 can be made from any material that is inert to chemical and/or biological reagents used in laboratories, such as polymers, including Teflon™, polypropylene and high density polypropylene suitable for use in laboratory equipment.

Figure 2:
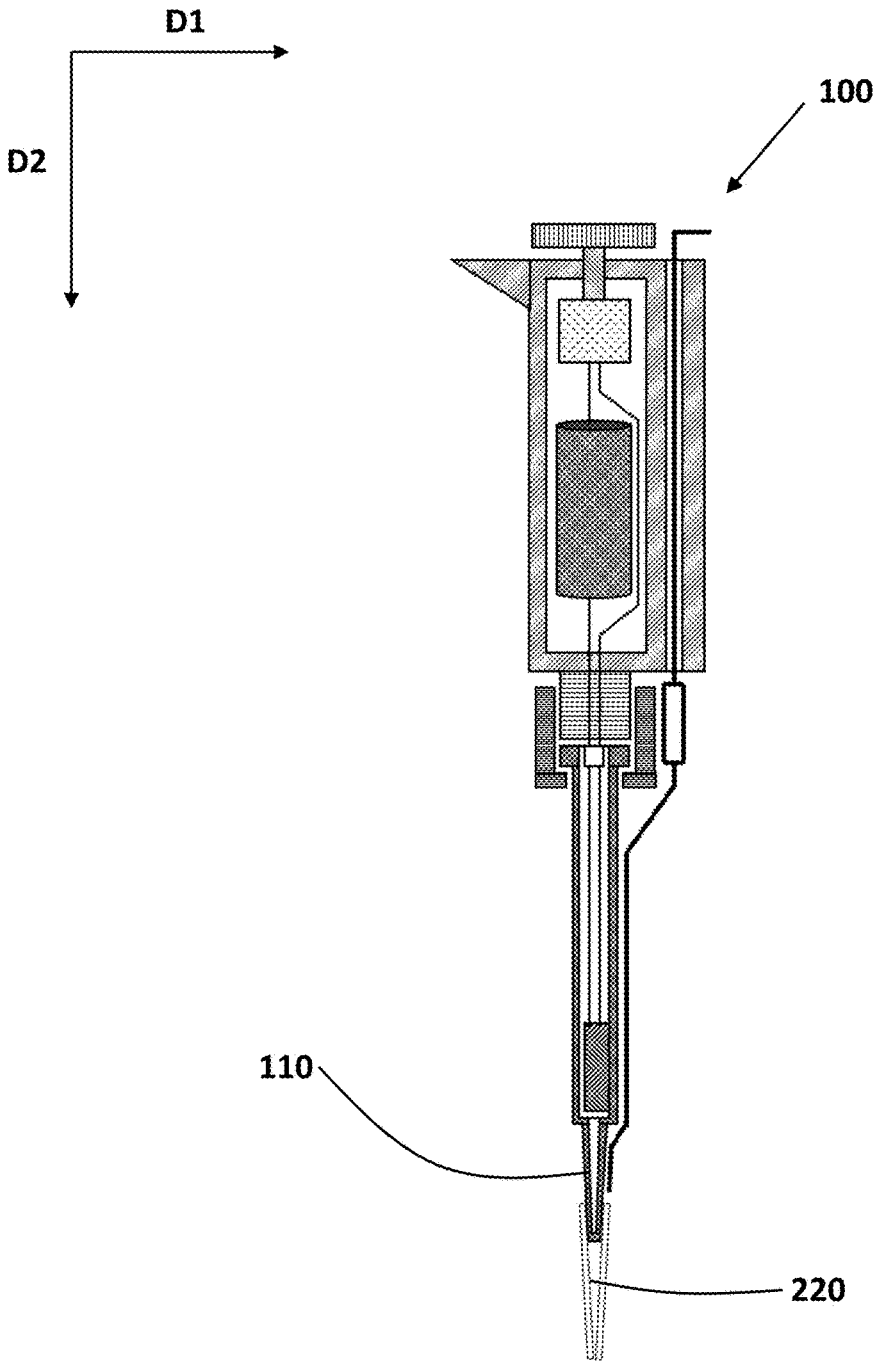
FIG. 2 provides a side view of a portable stirring device embodiment of the present disclosure having a pipette tip as a stirring probe.

FIG. 2 shows the embodiment described in FIG. 1 with a pipette tip 220 detachably attached to the tapered appendage 110. Pipette tips of various sizes may be used. The standard pipette tip sizes include those for 0.5 to 10 microliter, 2 to 20 microliter, 20 to 200 microliter and 200 to 1000 microliter pipetting volumes.

Figure 3:
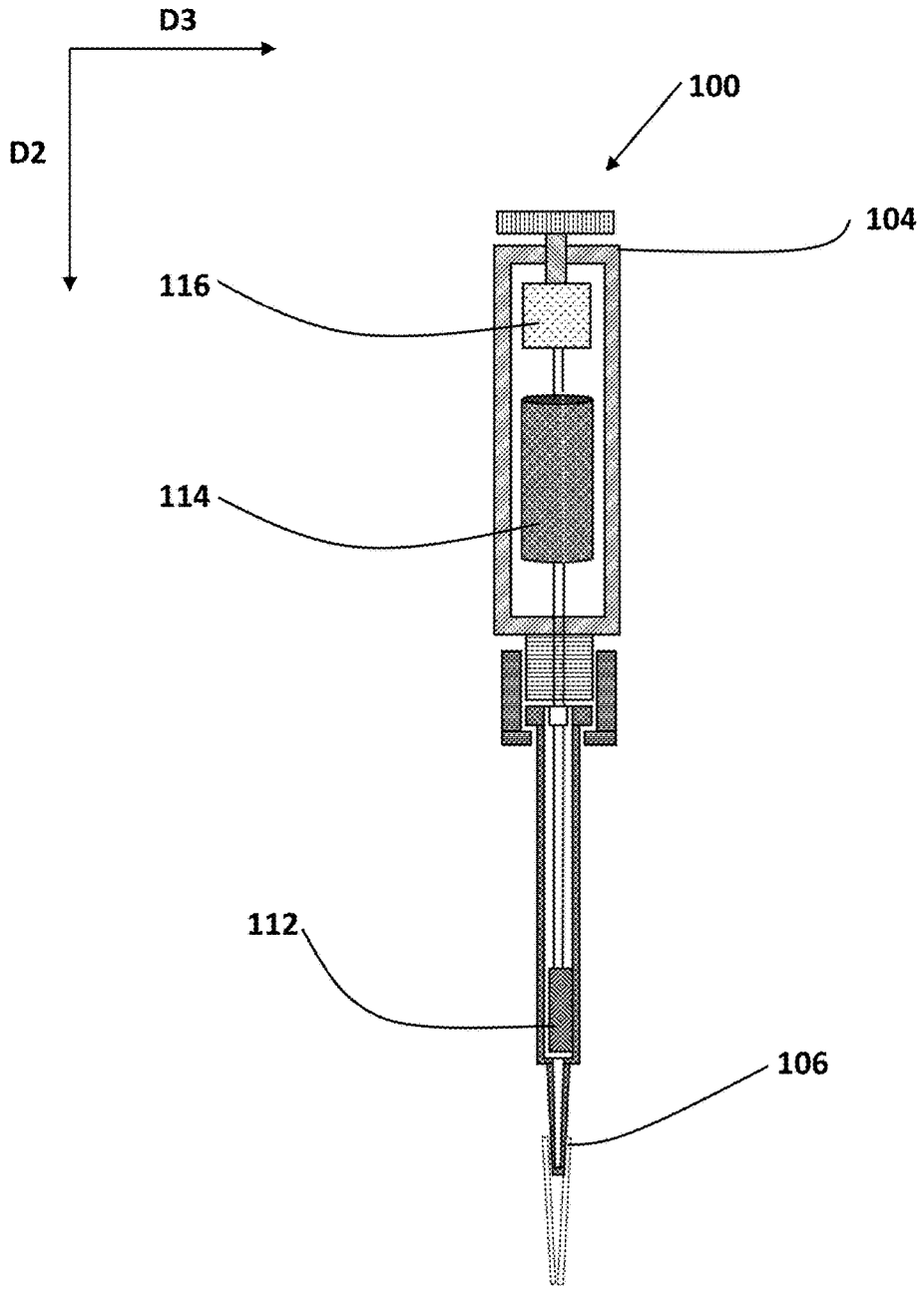
FIG. 3 provides a front view of a portable stirring device embodiment of the present disclosure having a pipette tip as a stirring probe.

FIG. 3 shows the embodiment described in FIG. 1 and FIG. 2 from a front plane perspective. FIG. 3 shows a front side perspective of a portable stirring device 100 having a lengthwise or longitudinal dimension extending in the D2 direction and a depth dimension extending in the D3 direction. The D1 direction depicted in FIG. 1 and FIG. 2 extend orthogonally from the plane formed by the D2 and D3 directions. The portable stirring device 100 having a proximal end 104, a distal end 106, a power source 114, a control unit 116, and a vibration inducing unit 112.

Figure 4:
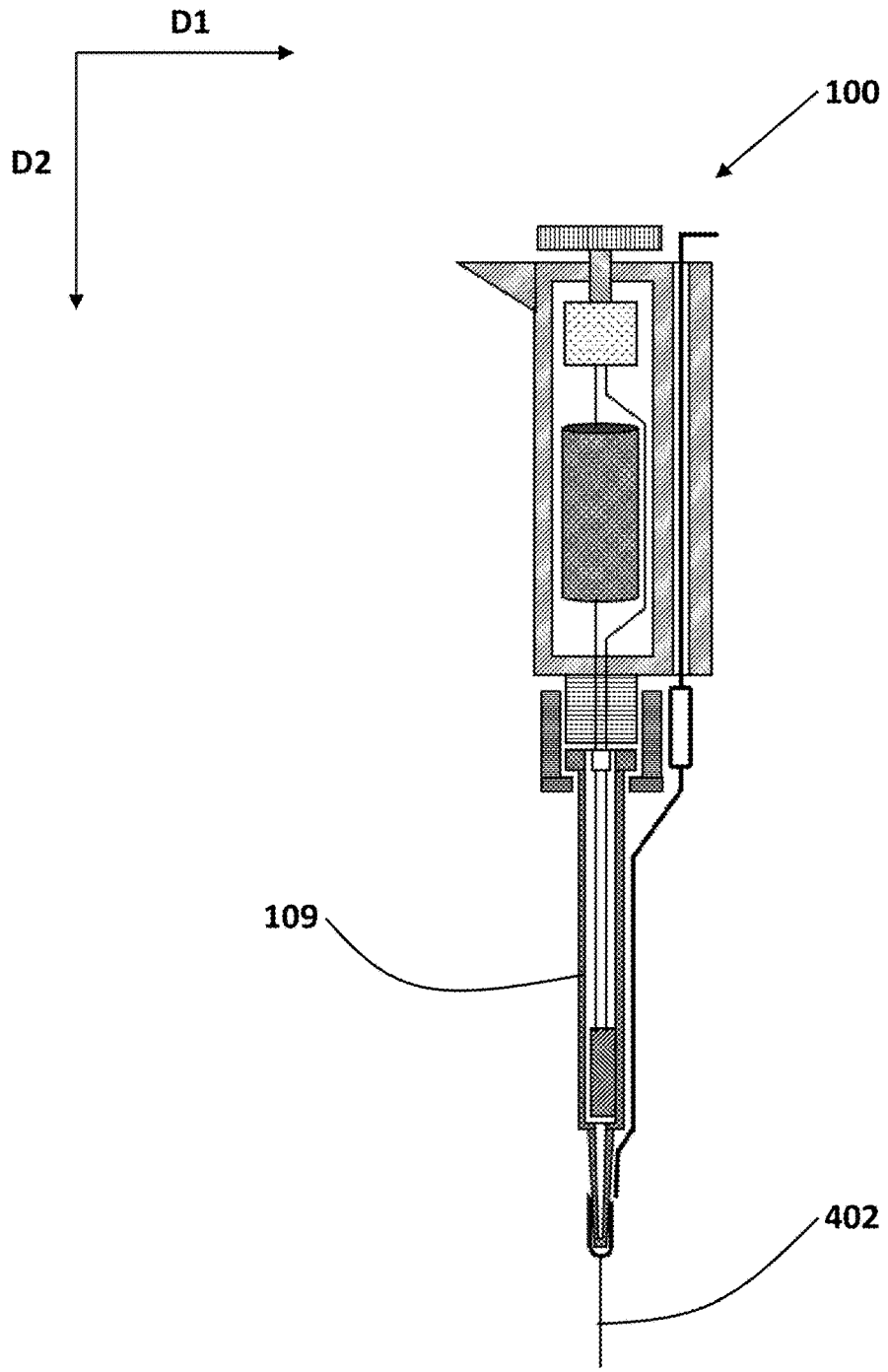
FIG. 4 provides a side view of a portable stirring device embodiment of the present disclosure having a pin probe as a stirring probe.

FIG. 4 shows the embodiment described in FIG. 1 having a pin probe 402 detachably attached to the detachably attach probe module 109.

Figure 5:
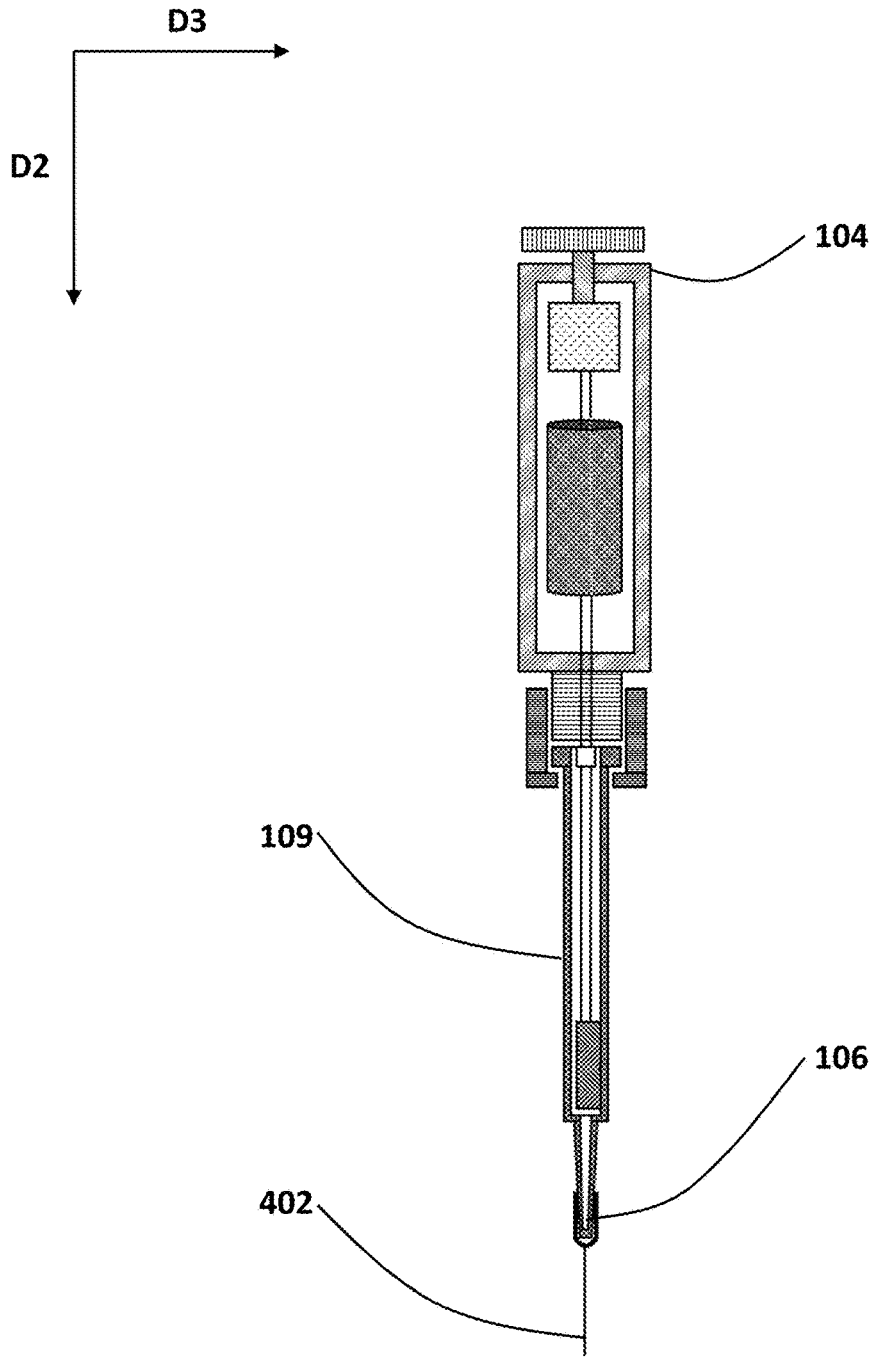
FIG. 5 provides a front view of a portable stirring device embodiment of the present disclosure having a pin probe as a stirring probe.

FIG. 5 shows the embodiment described in FIG. 4 from a front plane perspective. FIG. 5 shows a front side perspective of a portable stirring device 100 having a lengthwise or longitudinal dimension extending in the D2 direction and a depth dimension extending in the D3 direction. The D1 direction depicted in FIG. 1 and FIG. 4 extend orthogonally from the plane formed by the D2 and D3 directions. The portable stirring device 100 having a proximal end 104 and a distal end 106.

Figure 72:
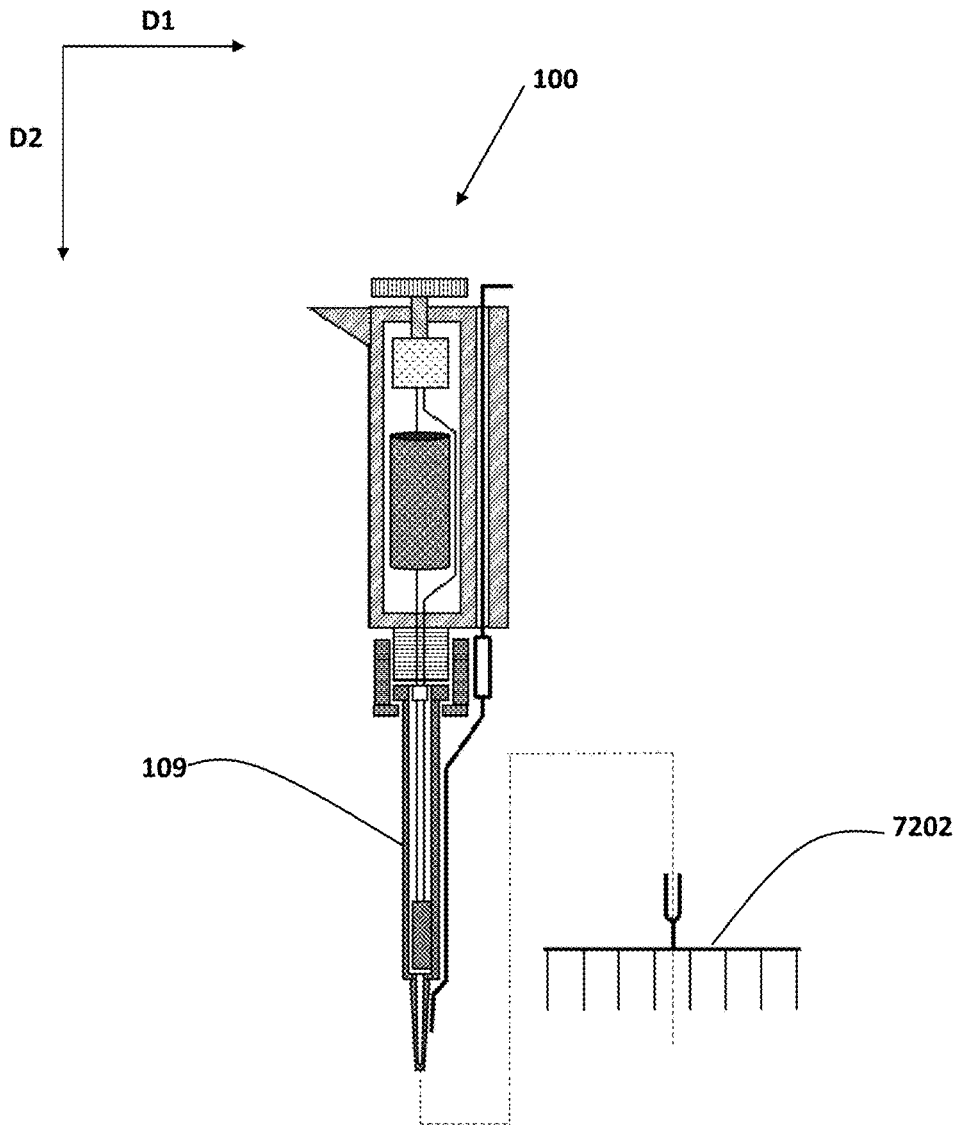
FIG. 72 shows the embodiment described in FIG. 1 having an eight pin probe.

FIG. 72 shows the embodiment described in FIG. 1 having an eight pin probe 7202 detachably attached to the detachably attach probe module 109. The present embodiment provides the user the ability to manually stir and/or mix the contents of a row of eight microplate wells simultaneously.

Figure 73:
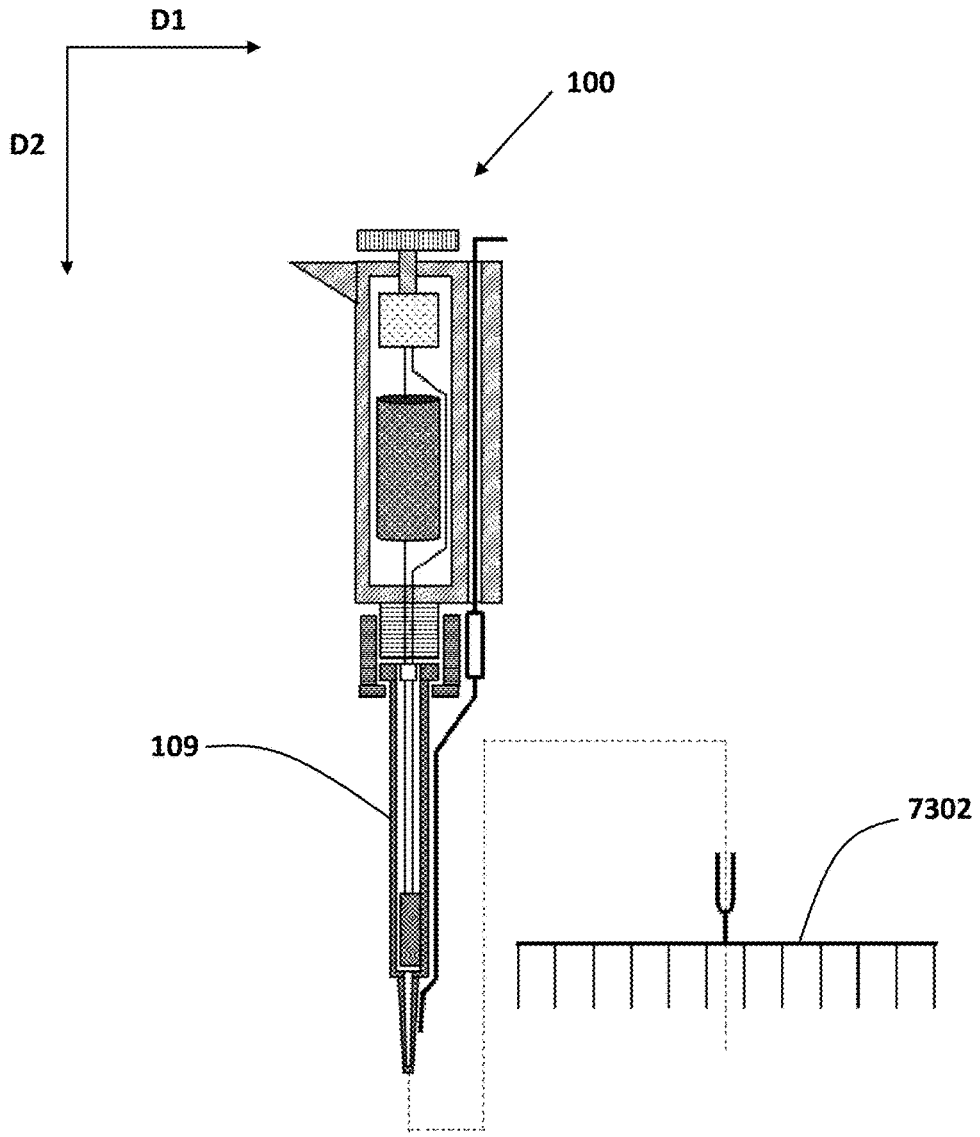
FIG. 73 shows the embodiment described in FIG. 1 having a twelve pin probe.

FIG. 73 shows the embodiment described in FIG. 1 having a twelve pin probe 7302 detachably attached to the detachably attach probe module 109. The present embodiment provides the user the ability to manually stir and/or mix the contents of a row of twelve microplate wells simultaneously.

Figure 74:
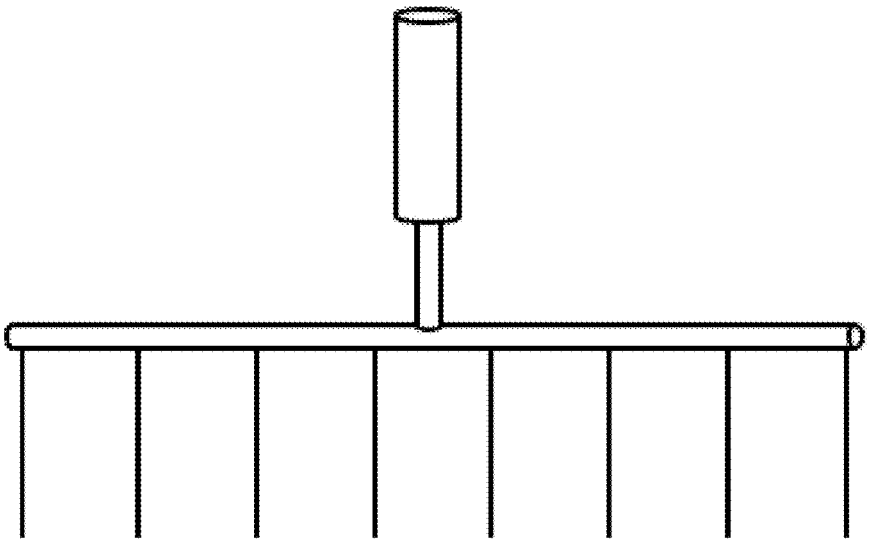
FIG. 74 provides the top down from the right perspective view of an eight pin probe described in FIG. 72.

FIG. 74 shows the eight pin probe 7202 described in FIG. 72.

Figure 75:
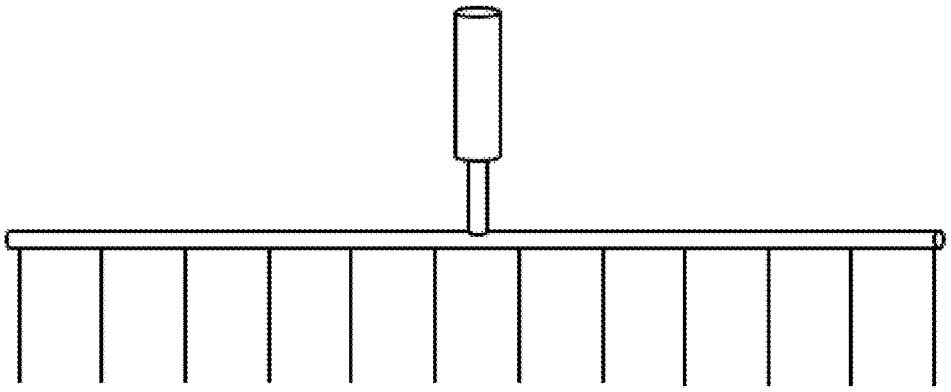
FIG. 75 provides the top down from the right perspective view of a twelve pin probe described in FIG. 73.

FIG. 75 shows the twelve pin probe 7302 described in FIG. 73.

A problem often encounter in a laboratory is the need to dissolve or disperse and evenly disperse reagents and materials for a reaction. This problem is particularly acute when the materials are biological in origin, since in most instances heat cannot be applied, and the materials may be subject to degradation.

Attempts to address this problem have been through the implementation of various types of mixing devices, such as bench top vortex mixers. However bench top vortex mixtures are dependent on having available a sufficient volume of solution for dissolving. Also a vortex mixture agitates the entire solution in the vessel, typically a centrifuge or microcentrifuge tube, without the ability to selectively or directly manipulate materials in order to facilitate their dissolving.

Other types of similar mechanical devices are the Pestle Micro Grinder or Mixer Motor. They are used mainly for homogenizing biological samples in micro-centrifuge tubes by grinding with a pestle or a bar that is connected to and is spanned by an electric motor. This device may also be used for suspending biological materials. However, with this device, the process of dispersion is difficult to observe or control as the device causes splashing, and foaming that could result in excessive grinding and loss of materials.

The portable stirring device taught in the present disclosure provides the mixing capabilities of a bench top vortex mixer in a compact and portable embodiment, while synergistically combining this with the capability of allowing the user to physically manipulate the sample while simultaneously agitating it into solution. The user is then able to more quickly and efficiently bring into solution the material.

The portable stirring device taught in the present disclosure can dissolve and/or disperse solid particles into liquid by providing agitation and stirring effects. Agitation is produced by the orbital revolution of the probe tip, such as a pipette tip or a pin probe. The probe tip causes liquid to swirl creating a vortex motion. This vortex motion also facilitates dissolution and dispersion of solid particles.

Figure 12:
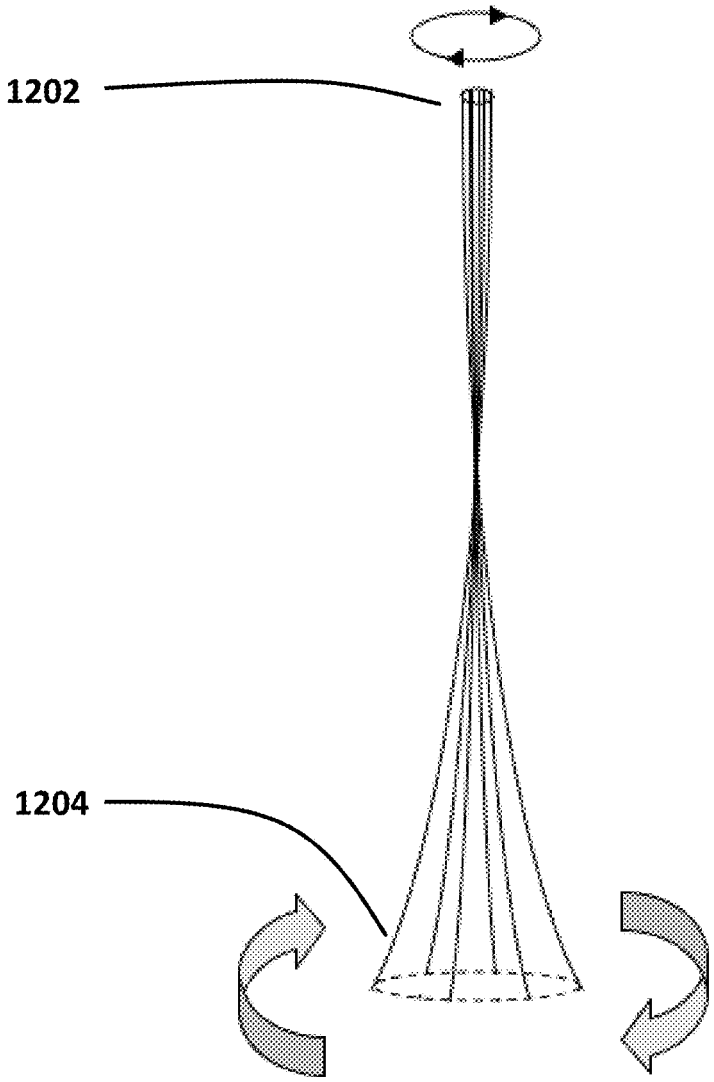
FIG. 12 provides a plan view depiction of the motion of the stirring probe.

FIG. 12 provides a side perspective illustration depicting the motion of an individual pin probe resulting from the motion caused by a vibration stirring unit, such as those described in FIGS. 1, 4, 5 and 6. As the motor of the vibration inducing unit spins, asymmetric centrifugal force is generated, which causes the mass of the motor to orbit around the motor shaft axis. The body of the motor revolves, in a Ferris Wheel-like motion, on a small orbit centered on the motor axis. The body of the motor does not spin on its own but translates along the circular orbit. The root of a pin that is structurally attached to the body of the motor or attached to the motor through an intervening structure is forced to undergo a similar orbital revolution. The orbital revolution of the root of the pin causes the pin to make a swirling motion. With the pin immersed in liquid in the well, this swirling motion affords mixing. The swirling motion of the pin is created directly by the vibration inducing unit without the need for any additional mechanical devices or elements. FIG. 12 shows activation of the vibration inducing unit resulting in an orbital revolution at the proximal end 1202 of the pin probe, shown rotating in a clockwise direction. This creates a swirling motion in the same direction at the distal end 1204 of the pin probe. The swirling motion at the proximal end 1202 of the pin probe results in an exaggerated orbital revolution at the distal end 1204 of the pin probe that stirs and/or mix the material.

Figure 13:
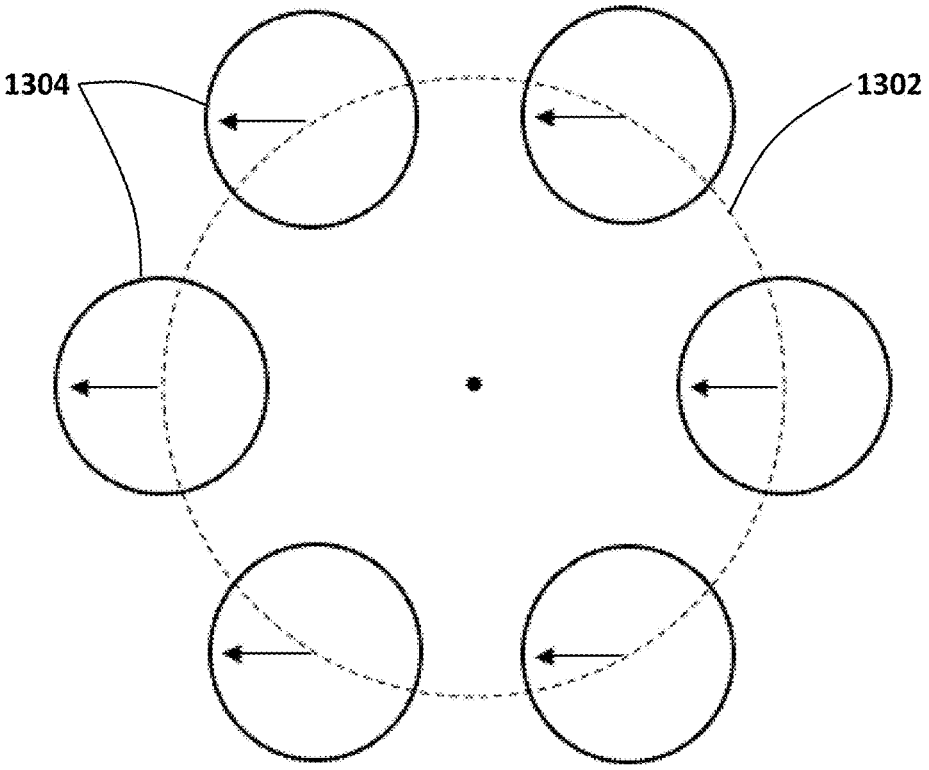
FIG. 13 provides a plan view depiction showing the motion of an individual pin probe of the pin probe module.

FIG. 13 provides a pan view illustration depicting the motion of an individual pin probe resulting from the motion caused by a vibration inducing unit, such as those described in FIGS. 1, 4, 5 and 6. Activation of the vibration inducing unit results in the proximal end 1202 of the pin probe moving in an orbit 1302 depicted as the dash line circle. The location of the proximal end of the pin probe 1202 during different phases of each revolution is shown 1304.

Figure 14:
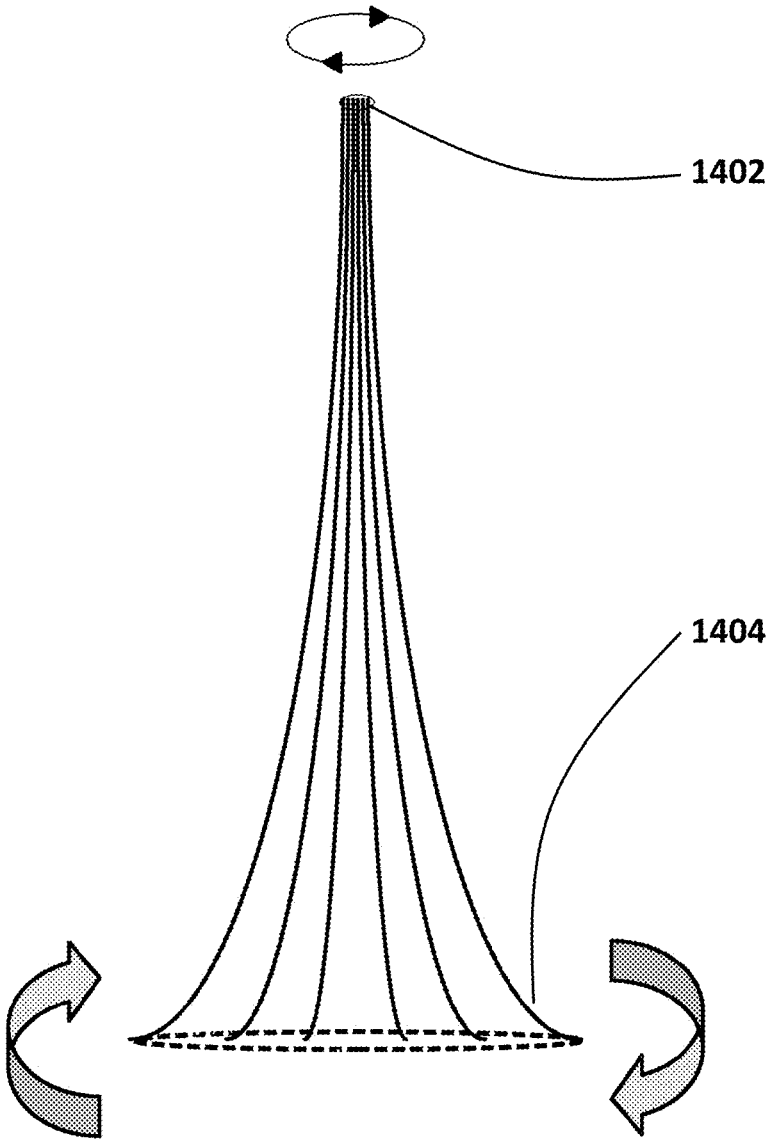
FIG. 14 provides an illustration of the shape of a pin probe operating at a slow orbital revolution.

FIG. 14 provides an illustration of the shape of a pin probe having a proximal end 1402 and a distal end 1404 as it undergoes orbital revolution. The distal end 1404 of the pin probe bends outward by the centrifugal force and the shape of the pin probe from proximal end 1402 to the distal end 1404 forms a cone-shaped volume of space resulting in a swirling motion that brings about stirring/mixing. The distal end 1404 revolves in a larger radius and travels at a faster tangential speed than any other point on the pin probe, resulting in the strongest swirling motion at the distal end and a vortex in liquid centered around the distal end of the pin probe. This form of probe motion and stirring effect are also obtained with a pipette tip of various sizes or an oversized probe tip used as the probe. For example, this form of motion is also obtained with the oversized pipette tip 120 (previously described in FIG. 1) or the pipette tip 220 (previously described in FIG. 2).

Figure 15:
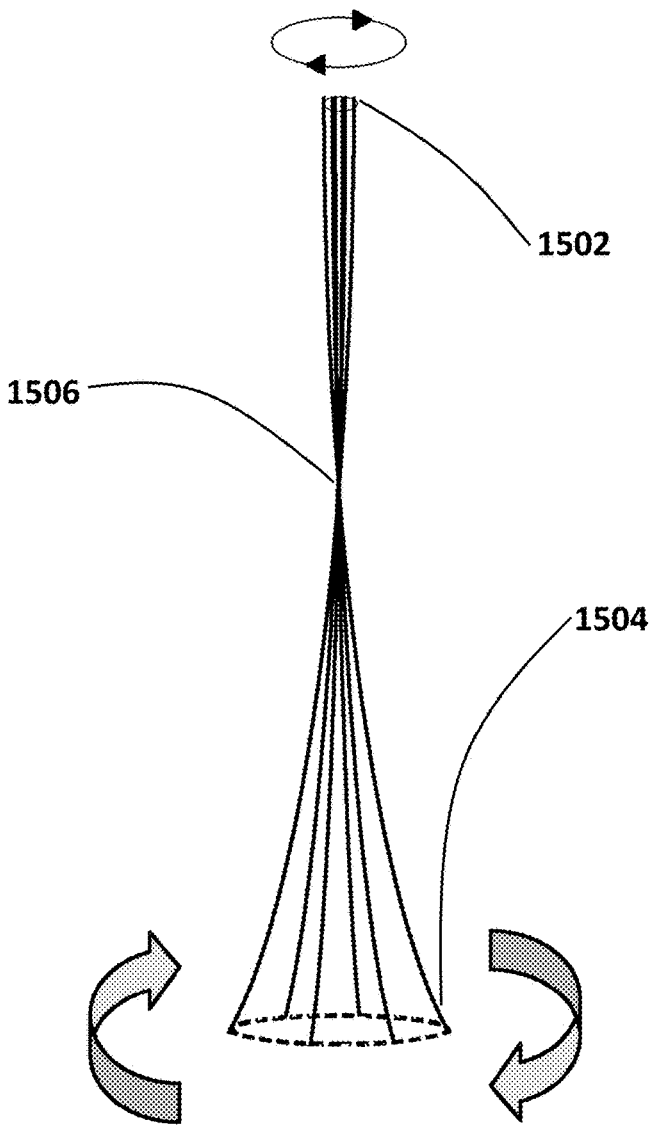
FIG. 15 provides an illustration of the shape of a pin probe operating at a fast orbital revolution.

FIG. 15 provides an illustration of the shape of a pin probe having a proximal end 1502 and a distal end 1504 at a higher orbital revolution speed. In this case, the medium pulls the pin causing it to bend backward as well as outward. This makes the shape of the pin motion twisted and narrowed at the distal end 1504 relative to the shape of the pin probe illustrated in FIG. 14, and also results in a cone-shaped volume of space that is shorter, where the apex of the cone is formed at a position distal 1506 from the proximal end 1502 of the pin probe. The shape of the pin probe illustrated in FIG. 15 is the approximate shape of the pin probe when it is immersed in liquid or solution. Again the shape may vary according to the viscosity of the liquid or solution. This shape can also be obtained using a pin probe material that is more flexible. The narrowed swirling motion provides the benefit of being less likely to cause splashing or foaming, which can result in the deterioration or loss of the material or cross contamination of samples.

Operating the vibration inducing unit at a higher frequency results in a higher orbital revolution for a pin probe. Matching the operating frequency of the vibration inducing unit with pin probes having a certain degree of flexibility provides the user with mixing options for addressing materials having various viscosity characteristics. The different degrees of flexibility can be obtained using specific materials, or by altering the physical characteristics of the pin probe, for example by increasing or decreasing the diameter. The shape of the pin probe changes according to the operating frequency of the vibration inducing unit, the flexibility of the pin probe and the material that is being stirred. As used herein the term "shape of the pin probe" refers to the shape of the volume of space occupied by the pin probe when in orbital revolution.

The portable stirring device can be used to suspend biological materials collected in small test tubes such as micro-centrifuge tubes. This task is generally done by stirring the materials manually with a stirrer rod or similar laboratory appliance, or by agitating the tube and the material inside by placing on a vortex mixer. It is often difficult and time-consuming to disperse biological materials because they are generally agglutinant and clingy to the surfaces. The portable stirring device accelerates dispersion by directly agitating the materials with the swirling of liquid inside the tube by the orbital revolution of the probe tip. The motion of the probe tip also prevents the materials clinging onto its surface. The user can perform the procedure in a controlled manner by manipulating the tip while observing the sample visually. The intensity of agitation as well as the speed of the liquid vortex can be controlled by altering the voltage supplied to the vibration inducing unit allowing the user to visually inspect the progress of the stirring. Further because the user is manually directing the stirring, the user is able to minimize splashing, foaming, or excessive grinding of sample materials. Re-suspension of a pellet of such materials is often difficult and time consuming. The present embodiment can be used to directly agitate the pellet, disperse and re-suspend the material quickly. These procedures can be performed while observing the sample visually and controlling the intensity of mixing by altering the speed of the vibration inducing unit.

The portable stirring device can be used with a variety of disposable or reusable probes of varying sizes as required by the user. For example, micropipette tips can be detachably affixed to the portable stirring device in a manner similar to how micropipette tips are used with standard micropipettes. This provides the added efficiency of being able to utilize a micropipette tip used for dissolving a material to also measure a volume of the material without introducing another micropipette tip, which would result in loss of materials.

Another example of a disposable or reusable probe is a pin probe, which is illustrated in FIGS. 4 and 5. The pin probe is made from a material that is inert to the material it is used to stir. Suitable materials may be appropriate inert metals, and polymers, such as Teflon and polypropylene. The size of the probe whether a micropipette tip or a pin probe can vary according to the application. Different probe sizes can be employed depending on whether the vessel is a micro centrifuge tube, a standard centrifuge tube, a centrifuge bottle, or a test tube. It should be noted that a single portable stirring device can be used consecutively with probe tips of varying types and sizes, since each tip whether a one use disposable tip or a reusable tip can be detached.

For Micro-Centrifuge Tubes/PCR Tubes (plastic) having the following dimensions:

| Capacity | Diameter | Height | Note |
|---|---|---|---|
| 2 ml | 10 mm | 38 mm | wider less conical bottom |
| 1.5 ml | 10 mm | 38 mm | |
| 0.5 ml | 8 mm | 30 mm | |
| 0.4 ml | 6 mm | 47 mm | |
| 0.3 ml | 6 mm | 32 mm | |
| 0.25 ml | 6 mm | 29 mm | |

Probes having a diameter of about 0.1 mm to about 2.5 mm and a length of about 20 mm to about 80 mm can be used.

For centrifuge tubes having the following dimensions:

| Capacity | Diameter | Height | Note |
|---|---|---|---|
| 15 ml | 17 mm | 120 mm | disposable, plastic |
| 50 ml | 28 mm | 110 mm | disposable, plastic |
| 30 ml | 24 mm | 100 mm | Corex glass tube, not disposable, |
| 100 ml | 38 mm | 100 mm | plastic, not disposable |

Probes having a diameter of about 0.5 mm to about 5 mm and a length of about 50 mm to about 150 mm can be used.

For centrifuge bottles having the following dimensions:

| Capacity | Diameter | Height | Note |
|---|---|---|---|
| 250 ml | 60 mm | 130 mm | |
| 500 ml | 65 mm | 130 mm | |

Probes having a diameter of about 0.5 mm to about 10 mm and a length of about 50 mm to about 150 mm can be used.

For Test Tubes (plastic or glass) having the following dimensions:

| Capacity | Diameter | Height | Note |
|---|---|---|---|
| 5 ml | 12 mm | 75 mm | |
| 10 ml | 13 mm | 100 mm | |

-continued

| Capacity | Diameter | Height | Note |
|---|---|---|---|
| 15 ml | 16 mm | 100 mm | |
| 20 ml | 16 mm | 150 mm | |
| 36 ml | 18 mm | 150 mm | |

Probes having a diameter of about 0.5 mm to about 5 mm and a length of about 50 mm to about 150 mm can be used.

The portable stirring device includes a power source, which can be disposable batteries of suitable voltage and amperage, or rechargeable batteries. The control module provides an on/off switch for the device, as well as variable control for the power allowing the user to conveniently adjust the degree of agitation to be applied to sample.

Figure 25:
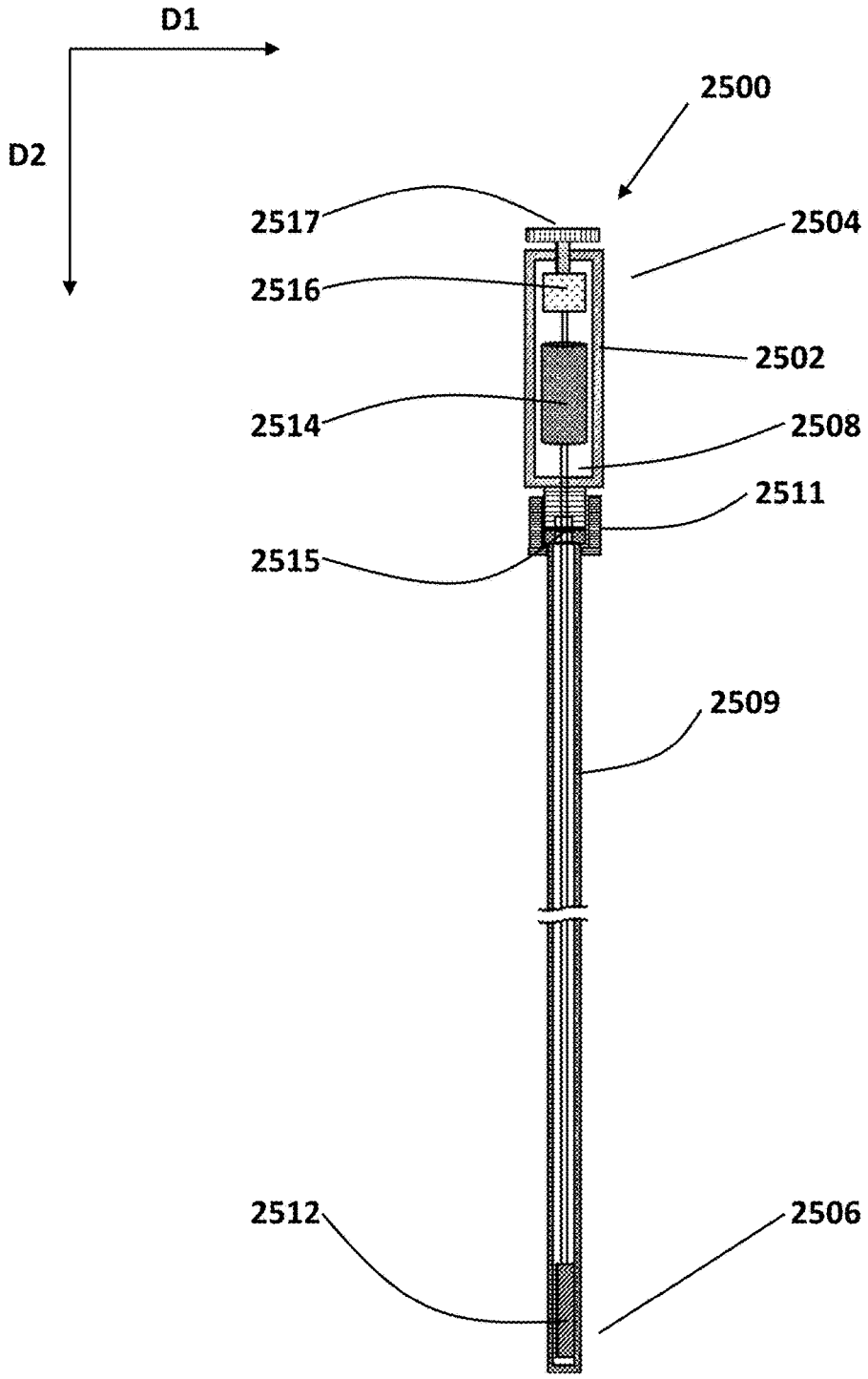
FIG. 25 provides a side perspective of a stirrer bar device.

Another embodiment of the present disclosure provides a portable stirring device 2500. FIG. 25 provides a side plane view of stirring device 2500 having a lengthwise or longitudinal dimension extending in the D2 direction and a widthwise dimension extending in the D1 direction, the portable stirring device 2500 having a proximal end 2504 and a distal end 2506. The case 2502 forms an internal space 2508. Within the internal space 2508 is a power source 2514 for the vibration inducing unit 2512 and a control unit 2516 for the vibration inducing unit 2512. The control unit 2516 having a control knob 2517 accessible from the outside of the case 2502 for turning the power on and off and for varying the voltage of the power to the vibration inducing unit 2512. Detachably attached to the case 2502 by an attachment mechanism 2511, such as a screw and thread assembly, or a bayonet mount, is a detachable probe attachment 2509 enclosing the vibration inducing unit 2512 and having electrical contact connectors 2515 which conducts power from the power source 2514 to the vibration inducing unit 2512 when the detachable probe attachment 2509 is attached to the case 2502. The case 2502 and the detachable probe attachment 2509 can be made from any material that is inert to chemical and/or biological reagents used in laboratories, such as polymers, including Teflon™, polypropylene and high density polypropylene suitable for use in laboratory equipment.

Figure 26:
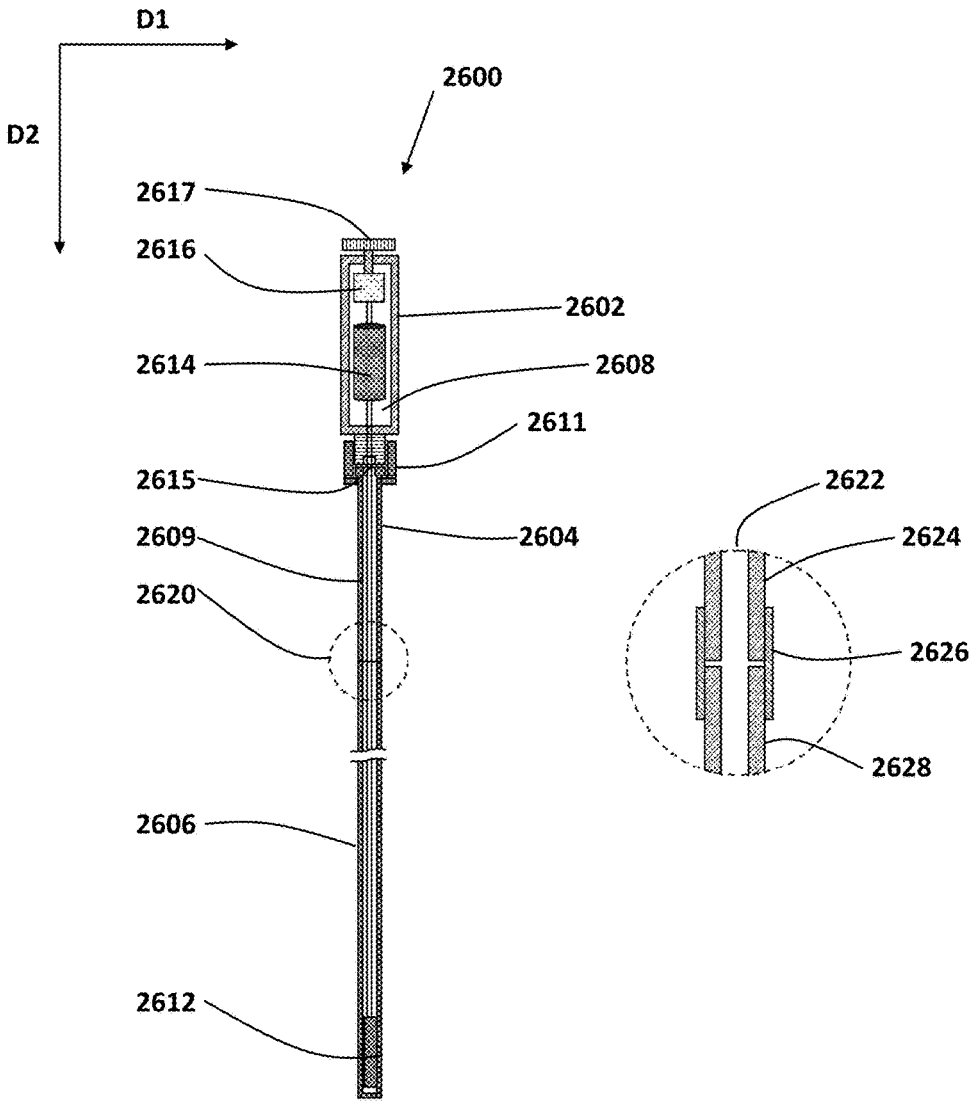
FIG. 26 provides a side perspective of a stirrer bar device having a flexible joint.
Figure 27:
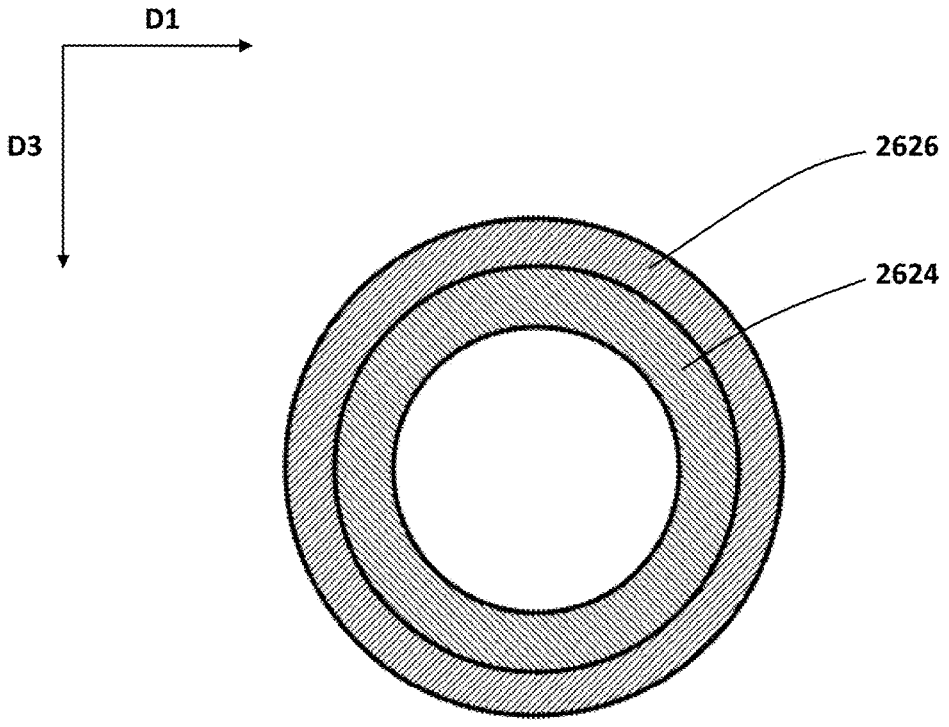
FIG. 27 provides a cross section view of a flexible joint.
Figure 28:
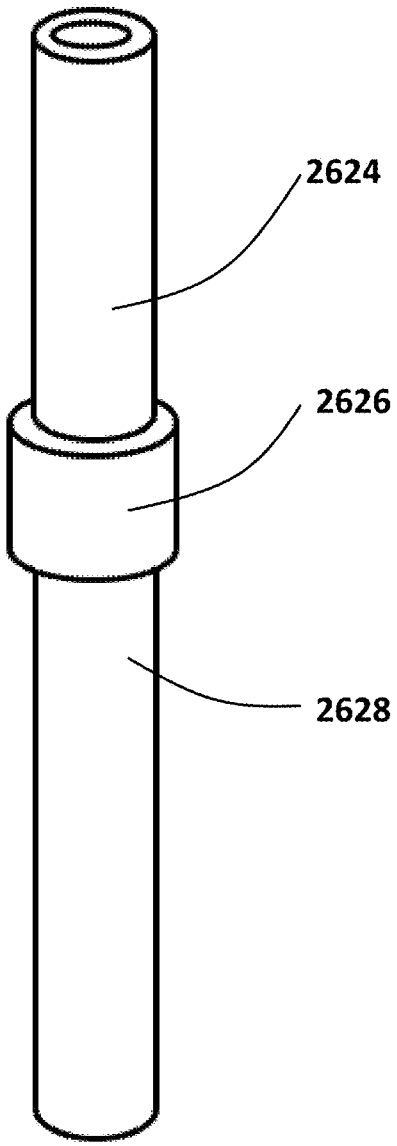
FIG. 28 provides a top down perspective view of a flexible joint.

Another embodiment of the present disclosure provides a portable stirring device having a flexible joint 2600. The portable stirring device comprising a case 2602 and a detachable probe attachment 2609. FIG. 26 provides a side plane view of the stirring device 2600 having a lengthwise or longitudinal dimension extending in the D2 direction and a widthwise dimension extending in the D1 direction. The case 2602 forms an internal space 2608. Within the internal space 2608 is a power source 2614 for the vibration inducing unit 2612 and a control unit 2616 for the vibration inducing unit 2612. The control unit 2616 having a control knob 2617 accessible from the outside of the case 2602 for turning the power on and off and for varying the voltage of the power to the vibration inducing unit 2612. The case 2602 is detachably attached at its distal end to the proximal end of the detachable probe attachment 2609 by an attachment mechanism 2611, such as a screw and thread assembly, or a bayonet mount. The attachment mechanism 2611 includes an electrical contact connector 2615 which conducts power from the power source 2614 to the vibration inducing unit 2612 when the detachable probe attachment 2609 is attached to the case 2602. The detachable probe attachment 2609 is comprised of a proximal section 2604 and a distal section 2606. The proximal section 2604 is detachably attached at its proximal end to the case 2602 by the attachment mechanism 2611. The distal section 2606 encloses the vibration inducing unit 2612 at its distal end. A flexible joint 2620 (graphically represented) joins the proximal section 2604 and the distal section 2606 of the detachable probe attachment 2609. Item 2622 provides an enlargement of the flexible joint 2620. The flexible joint comprises a sleeve 2626 that holds the position of the distal end of the proximal section 2624 adjacent to but not in contact with the proximal end of the distal section of the detachable probe attachment 2628. The flexible joint 2620 enables the distal portion 2606 of the detachable probe attachment to vibrate independently of the proximal 2604 portion of the detachable probe attachment. The flexible joint 2620 is formed so that the distal portion 2606 can be moved in unison with the proximal portion 2604, such as for stirring a liquid sample, or for manually agitating a solid particle in the liquid so that it can be dissolved. The flexible joint 2620 has sufficient flexibility such that when the vibration inducing unit 2612 enclosed in the distal portion 2606 of the detachable probe attachment 2609 induces vibrations, the vibrations are primarily transmitted through the distal portion 2606 of the detachable probe attachment 2609. FIG. 27 provides a top down plan view of the flexible joint 2620. The sleeve 2626 has a large diameter so that it encloses and secures the positions of the distal end of the proximal portion 2624 and the proximal end of the distal portion 2628 (not shown because it is overlapped by 2624). FIG. 28 provides a perspective view of the flexible joint 2626. The case 2602 and the detachable probe attachment 2609 can be made from any material that is inert to chemical and/or biological reagents used in laboratories, such as polymers, including Teflon™, polypropylene and high density polypropylene suitable for use in laboratory equipment.

Figure 29:
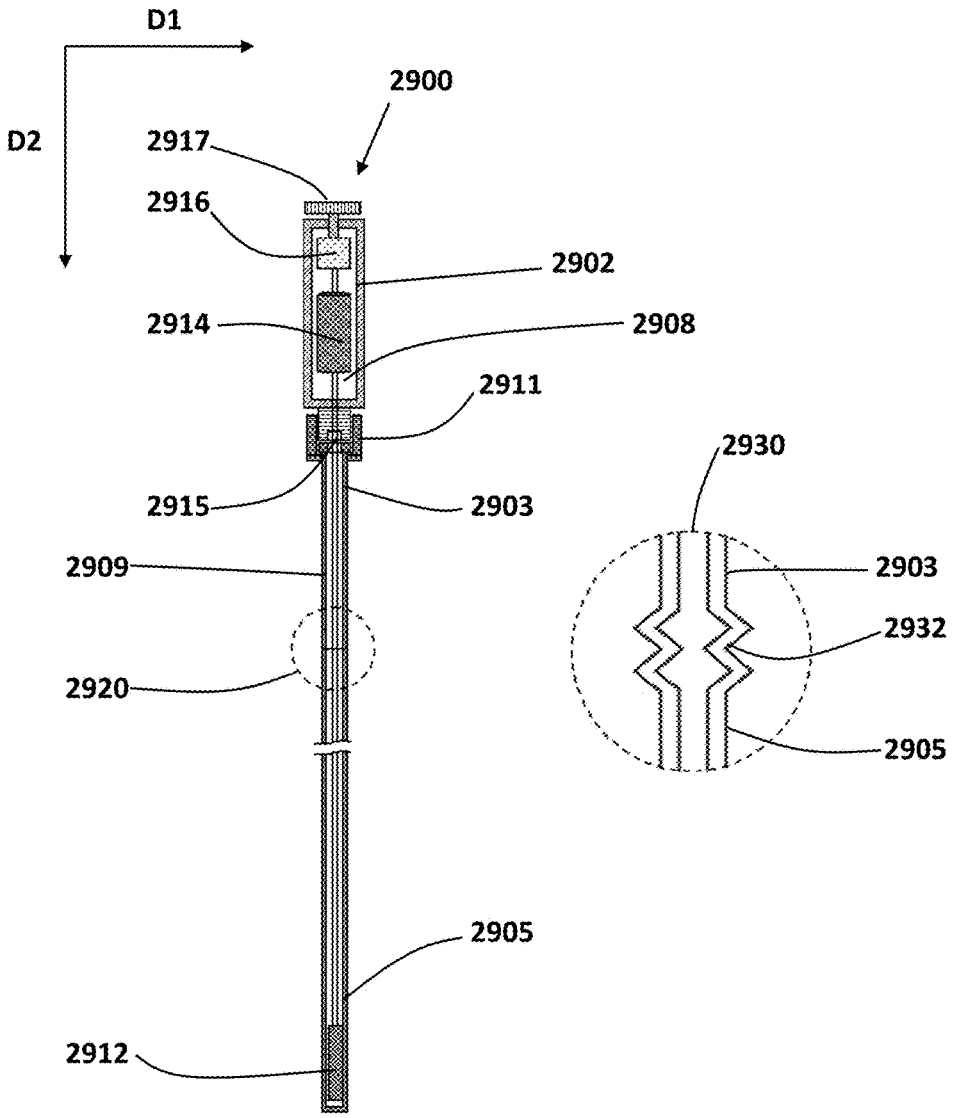
FIG. 29 provides a side view of a stirrer bar having a flexible bellows section.

Another embodiment of the present disclosure provides a portable stirring device having a flexible bellows section 2900. The portable stirring device comprising a case 2902 and a detachable probe attachment 2909. FIG. 29 provides a side plane view of the stirring device 2900 having a lengthwise or longitudinal dimension extending in the D2 direction and a widthwise dimension extending in the D1 direction. The case 2902 forms an internal space 2908. Within the internal space 2908 is a power source 2914 for the vibration inducing unit 2912 and a control unit 2916 for the vibration inducing unit 2912. The control unit 2916 having a control knob 2917 accessible from the outside of the case 2902 for turning the power on and off and for varying the voltage of the power to the vibration inducing unit 2912. The case 2902 is detachably attached at its distal end to the proximal end of the detachable probe attachment 2909 by an attachment mechanism 2911, such as a screw and thread assembly, or a bayonet mount. The attachment mechanism 2911 includes an electrical contact connector 2915 which conducts power from the power source 2914 to the vibration inducing unit 2912 when the detachable probe attachment 2909 is attached to the case 2902. A flexible bellows section 2920 (graphically represented) is between the proximal portion 2903 and the distal portion 2905 of the detachable probe attachment 2909. The flexible bellows section 2920 enables the distal portion 2905 to vibrate independently of the proximal portion 2903 of the detachable probe attachment 2909. Item 2930 provides an enlargement of the flexible bellows section 2920. The flexible bellows section 2932 enables the portion of the detachable probe attachment distal to it 2905 to vibrate independently of the portion of the detachable probe attachment proximal to it 2903. The flexible bellows section 2932 is formed so that the distal portion 2905 of the detachable probe attachment 2909 is sufficiently firm such that the distal portion 2905 can be moved in unison with the proximal portion 2903, such as for stirring a liquid sample, or for manually agitating a solid in a liquid sample so that it can be dissolved. The flexible bellows section 2932 has sufficient flexibility such that the distal portion 2905 of the detachable probe attachment 2909 enclosing the vibration inducing unit 2912 can more freely move, enhancing the actions of the vibration inducing unit 2912. The case 2902 and the detachable probe attachment 2909 can be made from any material that is inert to chemical and/or biological reagents used in laboratories, such as polymers, including Teflon™, polypropylene and high density polypropylene suitable for use in laboratory equipment.

Another embodiment of the present disclosure provides a stirring device comprising a power source, a control unit, and a vibration inducing unit as taught in the present disclosure built into the body of a dispenser head or multiple dispenser heads of an automated dispenser system. Automated dispenser or automate diluter systems are known to those skilled in the art. For example see the Microlab 600 Series Dispenser http://www.hamiltoncompany.com/products/microlab-600/c/982/, Microlab 600 Series Diluter http://www.hamiltoncompany.com/products/microlab-600/c/981/, and Microlab 300 Pipettor http://www.hamiltoncompany.com/products/microlab-300-pipettor/c/1288/manufactured by the Hamilton Company.

Another embodiment of the present disclosure provides a stirring device comprising a power source, a control unit, and a vibration inducing unit as taught in the present disclosure attached externally to the body of a dispenser head or multiple dispenser heads of an automated dispenser system.

Another embodiment of the present disclosure provides a stirring device having a vibration transmission interface comprising a power source, a control unit, a vibration inducing unit, and a vibration transmission interface as taught in the present disclosure built into the body of a dispenser head or multiple dispenser heads of an automated dispenser system.

Another embodiment of the present disclosure provides a stirring device having a vibration transmission interface comprising a power source, a control unit, a vibration inducing unit, and a vibration transmission interface as taught in the present disclosure attached externally to the body of a dispenser head or multiple dispenser heads of an automated dispenser system.

Figure 30:
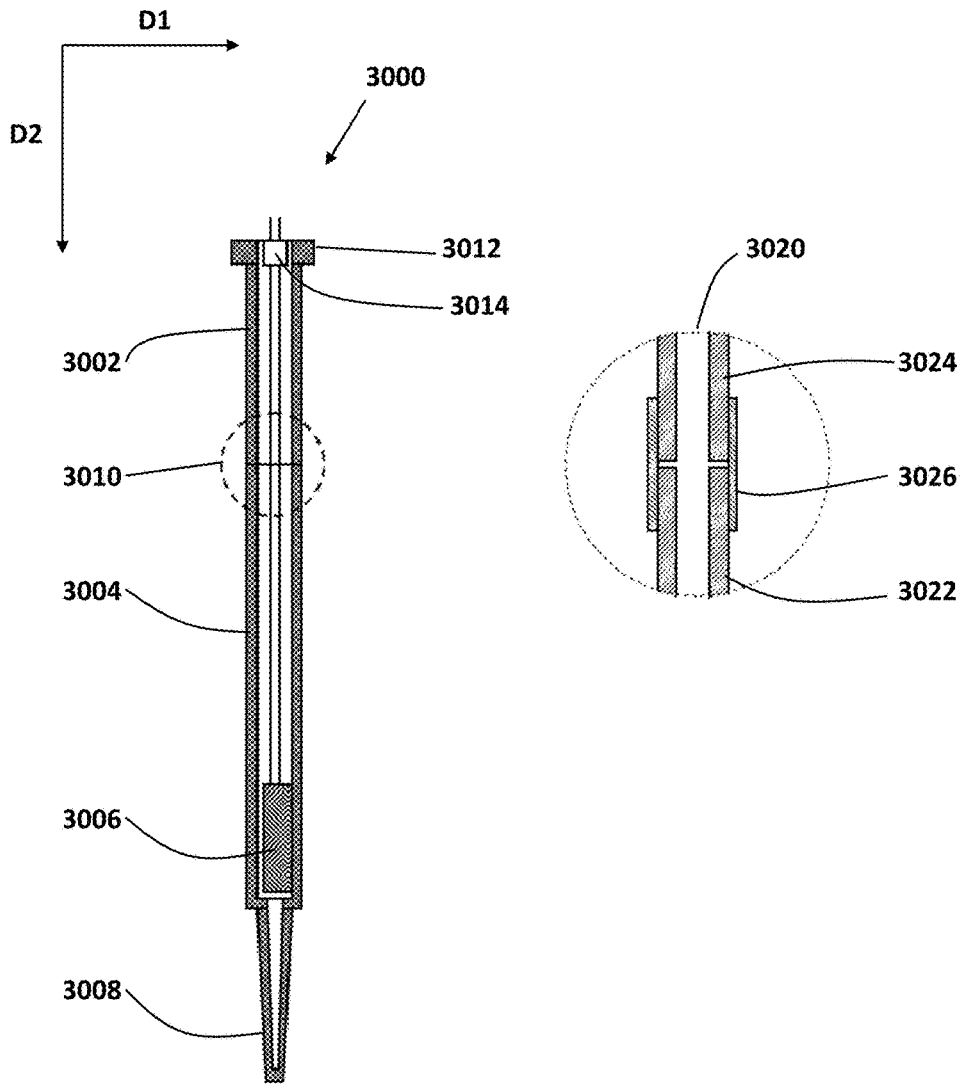
FIG. 30 provides a side view of an detachable probe attachment having a flexible joint.

Another embodiment of the present disclosure provides a detachable probe attachment 3000 having a flexible joint that can be used in place of the detachable probe attachment 109 taught in FIG. 1. As shown in FIG. 30, the detachable probe attachment 3000 consists of a proximal portion 3002 that attaches to the case 102 (as taught in FIG. 1) having a connector 3012 for attachment to the attachment mechanism 111 (as taught in FIG. 1), and an electrical contact connector 3014 for interfacing with the corresponding connectors in the case 102; and a distal portion 3004 that encloses the vibration inducing unit 3006 having a tapered end 3008. The proximal portion 3002 and distal portion 3004 are connected via a flexible joint 3010 (graphically represented) that enables the distal portion 3004 of the detachable probe attachment 3000 to vibrate independently of the proximal portion 3002 of the detachable probe attachment 3000. Item 3020 provides an enlargement of flexible joint 3010. The flexible joint consists of the distal end 3024 of the proximal portion 3002 of the detachable probe attachment 3000 positioned next to but not in contact with the proximal end 3022 of the distal portion 3004 of the detachable probe attachment 3000 by a sleeve 3026. The sleeve 3026 secures the proximal portion 3002 and the distal portion 3004 of the detachable probe attachment 3000 such that the distal portion 3004 of detachable probe attachment 3000 can be moved in unison with the proximal portion 3002 of the detachable probe attachment 3000, such as for stirring a liquid sample, or for manually agitating a solid in a liquid sample so that it can be dissolved. The proximal portion 3002 and the distal portion 3004 are not in physical contact, the distal portion 3004 enclosing the vibration inducing unit 3006 has more freedom to move, enhancing the actions of the vibration inducing unit 3006. The sleeve 3026 is made from a material having suitable flexible characteristics, such as materials previously discussed for making a vibration transmission interface.

Figure 31:
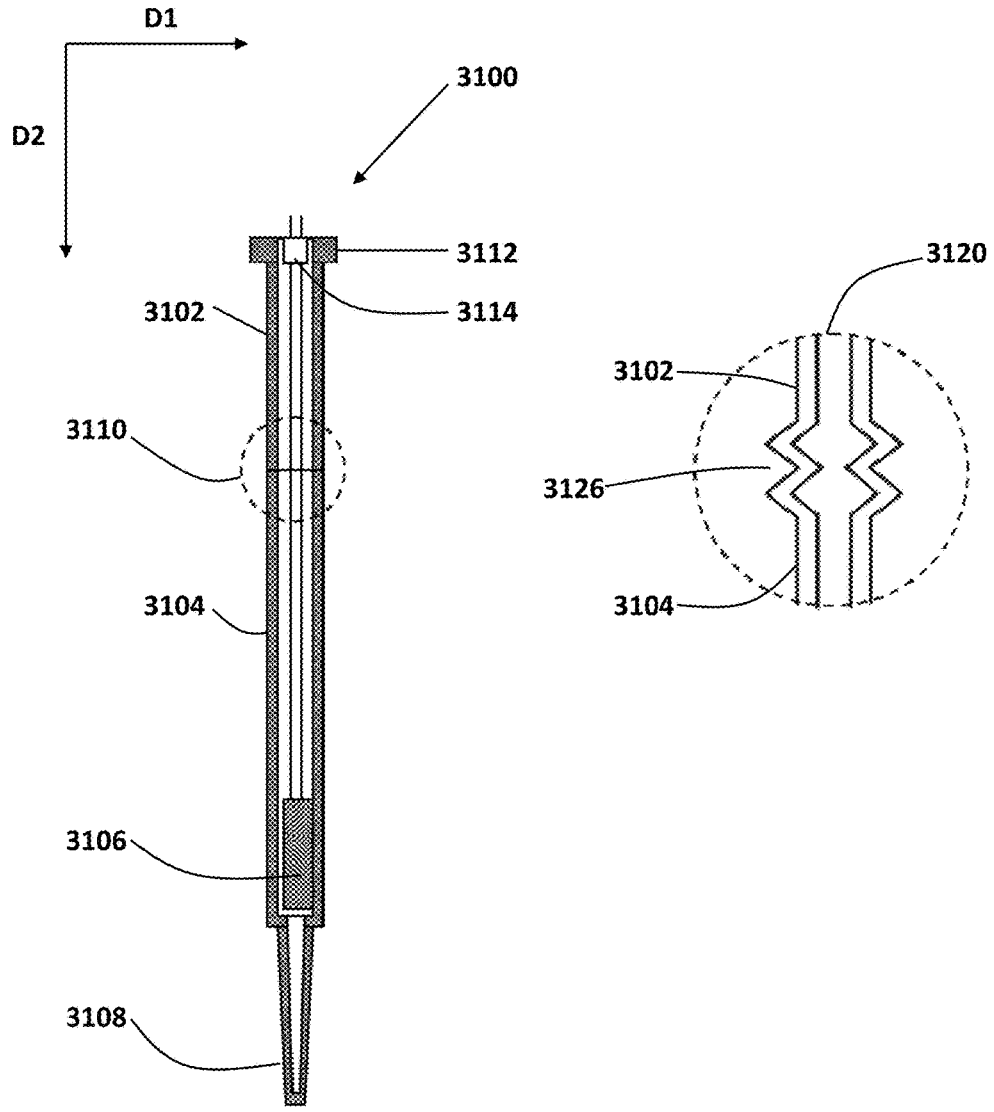
FIG. 31 provides a side view of a detachable probe attachment having a flexible bellows section.

Another embodiment of the present disclosure provides a detachable probe attachment 3100 having a flexible bellows section that can be used in place of the detachable probe attachment 109 taught in FIG. 1 and the associated disclosure. As shown in FIG. 31, the detachable probe attachment 3100 consists of a proximal portion 3102 that attaches to the case 102 (as taught in FIG. 1), a distal portion 3104 that encloses the vibration inducing unit 3106 having a tapered end 3108, a connector 3112 for attachment to the attachment mechanism 111 (as taught in FIG. 1), and electrical contact connector 3114 for interfacing with the corresponding connectors in the case 102. A flexible bellows section 3110 (graphically represented) is between the proximal portion 3102 and the distal portion 3104 of the detachable probe attachment 3100. The flexible bellows section 3110 enables the distal portion 3104 to vibrate independently of the proximal portion 3102 of the detachable probe attachment 3100. Item 3120 provides an enlargement of the flexible bellows section 3110. The flexible bellows section 3126 is formed so that the distal portion 3104 of the detachable probe attachment 3100 is sufficiently firm such that the distal portion 3104 can be moved in unison with the proximal portion 3102, such as for stirring a liquid sample, or for manually agitating a solid in a liquid sample so that it can be dissolved. The flexible bellows section 3110 has sufficient flexibility such that the distal portion 3104 of the detachable probe attachment 3100 enclosing the vibration inducing unit 3106 can more freely move, enhancing the actions of the vibration inducing unit 3106. The case 102 and the detachable probe attachment 3100 can be made from any material that is inert to chemical and/or biological reagents used in laboratories, such as polymers, including Teflon™, polypropylene and high density polypropylene suitable for use in laboratory equipment.

An embodiment of the present disclosure provides a manual stirring device including, a vibration inducing unit; a power source for the vibration inducing unit; and a control for the vibration inducing unit.

An aspect of the present disclosure provides a manual stirring device including a vibration transmission interface.

An aspect of the present disclosure provides a manual stirring device where the vibration inducing unit produces vibrations in a range of about 10 vibrations per second to about 250 vibrations per second.

An aspect of the present disclosure provides a manual stirring device where the manual stirring device includes a flexible joint.

Figure 16:
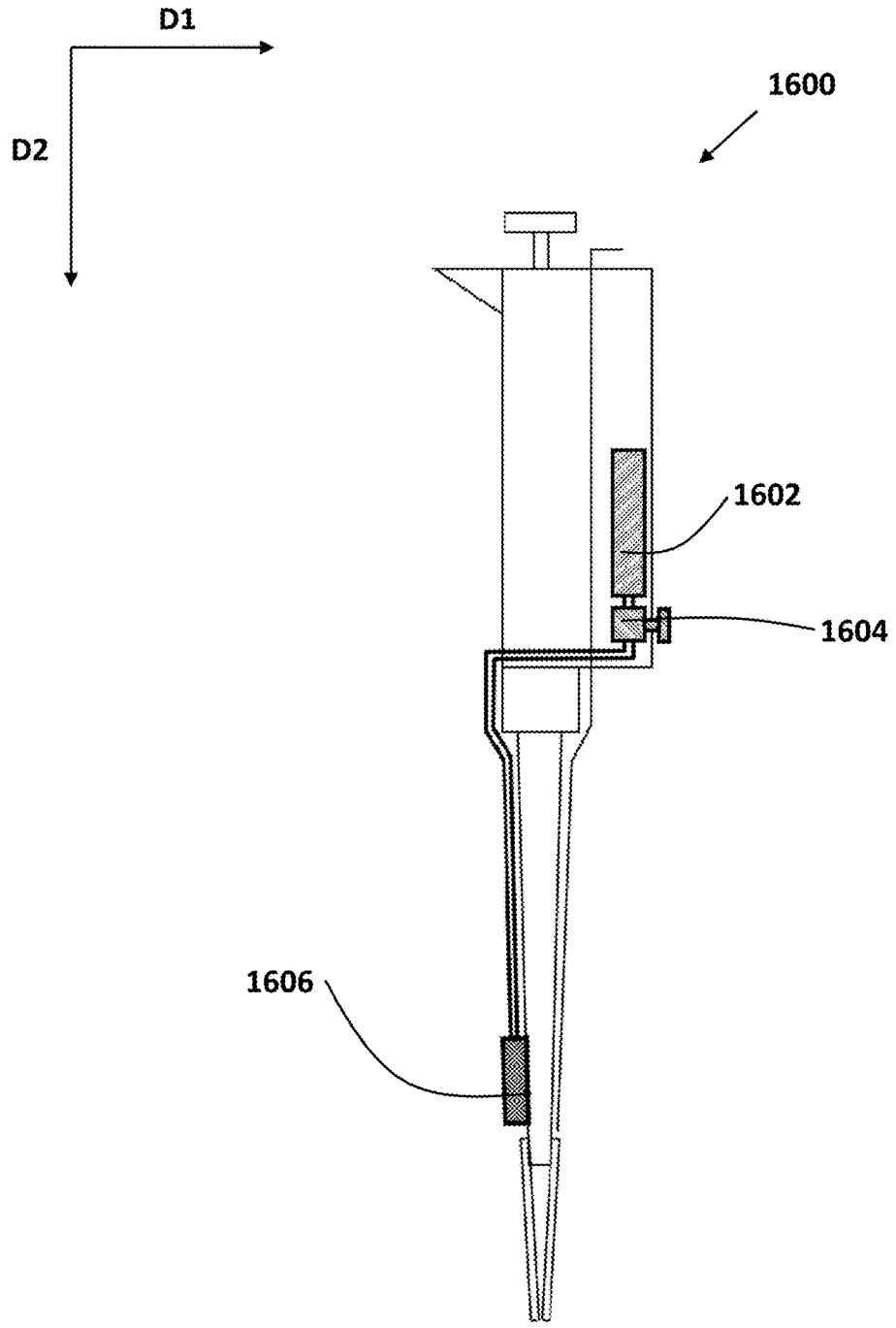
FIG. 16 provides a side perspective of a stirring device module built into a pipetting device.
Figure 17:
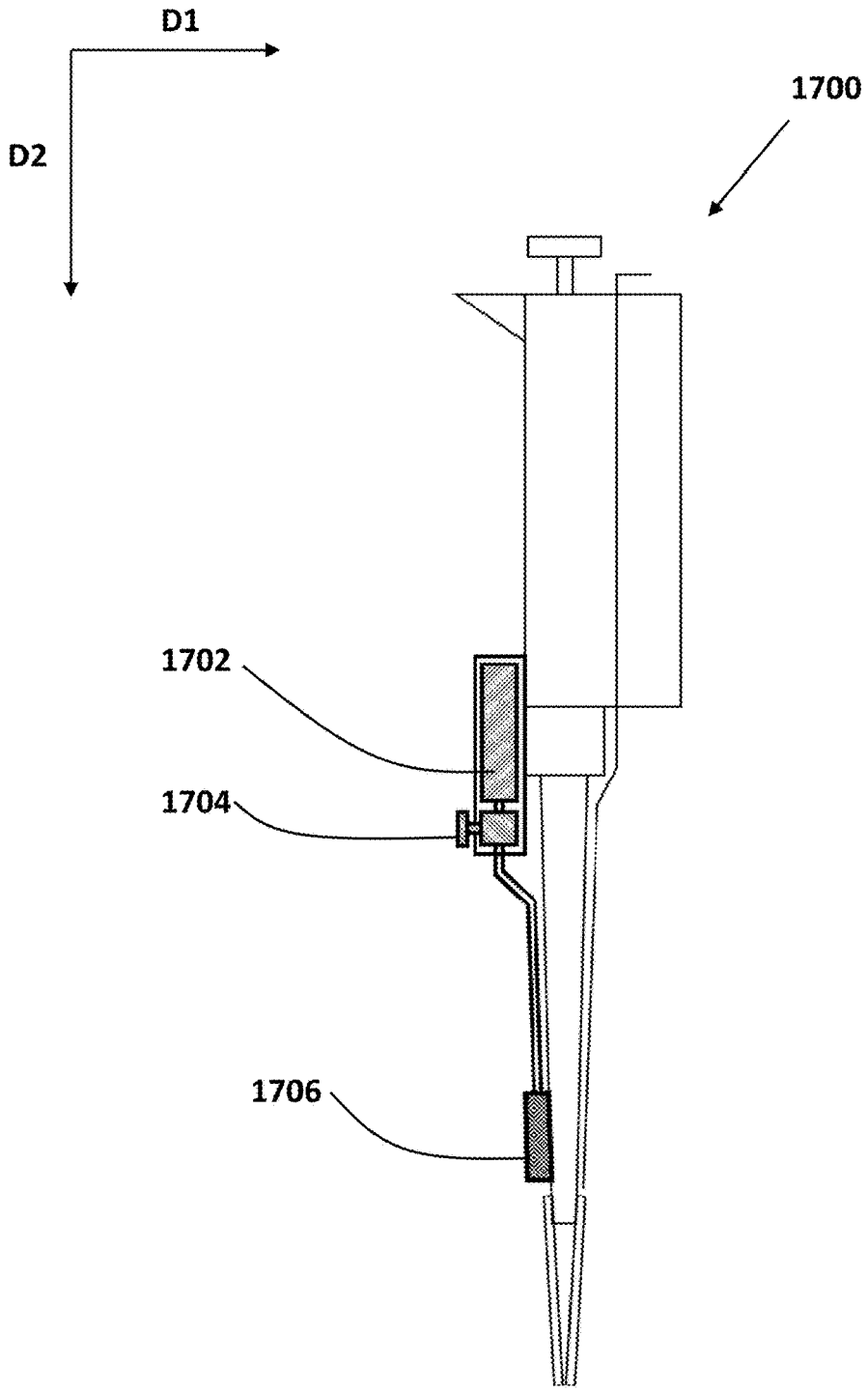
FIG. 17 provides a side perspective of a stirring device module that is attached externally to a pipetting device.

An embodiment of the present disclosure provides a pipette device used for measuring and/or transporting liquids, chemical or biological reagents, having a stirring device 1600 as illustrated in FIG. 16. A typical hand held pipette for aspirating and dispensing liquids will have at least the following components, a hand held portion which houses a plunger, piston and spring assembly used to aspirate and dispense liquids, and an ejector assembly used to eject disposable pipette tips. Additional features include the ability to set a desired volume of liquid to aspirate for one time or repeated dispensing routines. The construction and mechanisms for pipette devices are readily known to those in the art. For example see U.S. Pat. No. 5,364,596 "Manual Pipette With Plunger Velocity Governor, Home Position Latch and Trigger Release", U.S. Pat. No. 5,413,006 "Pipette For Sampling and Dispensing Adjustable Volumes of Liquids", and U.S. Pat. No. 5,983,733 "Manual Pipette". The stirring device component comprises a power source 1602, a control unit 1604 and a vibration inducing unit 1606. The stirring device can be incorporated into the body of the pipette as shown in FIG. 16. Alternately, the stirring device can be attached permanently, or detachably attached to the exterior of the pipette body 1700 as shown in FIG. 17. The external stirring device comprises a power source 1702, a control unit 1704, and a vibration inducing unit 1706.

Figure 18:
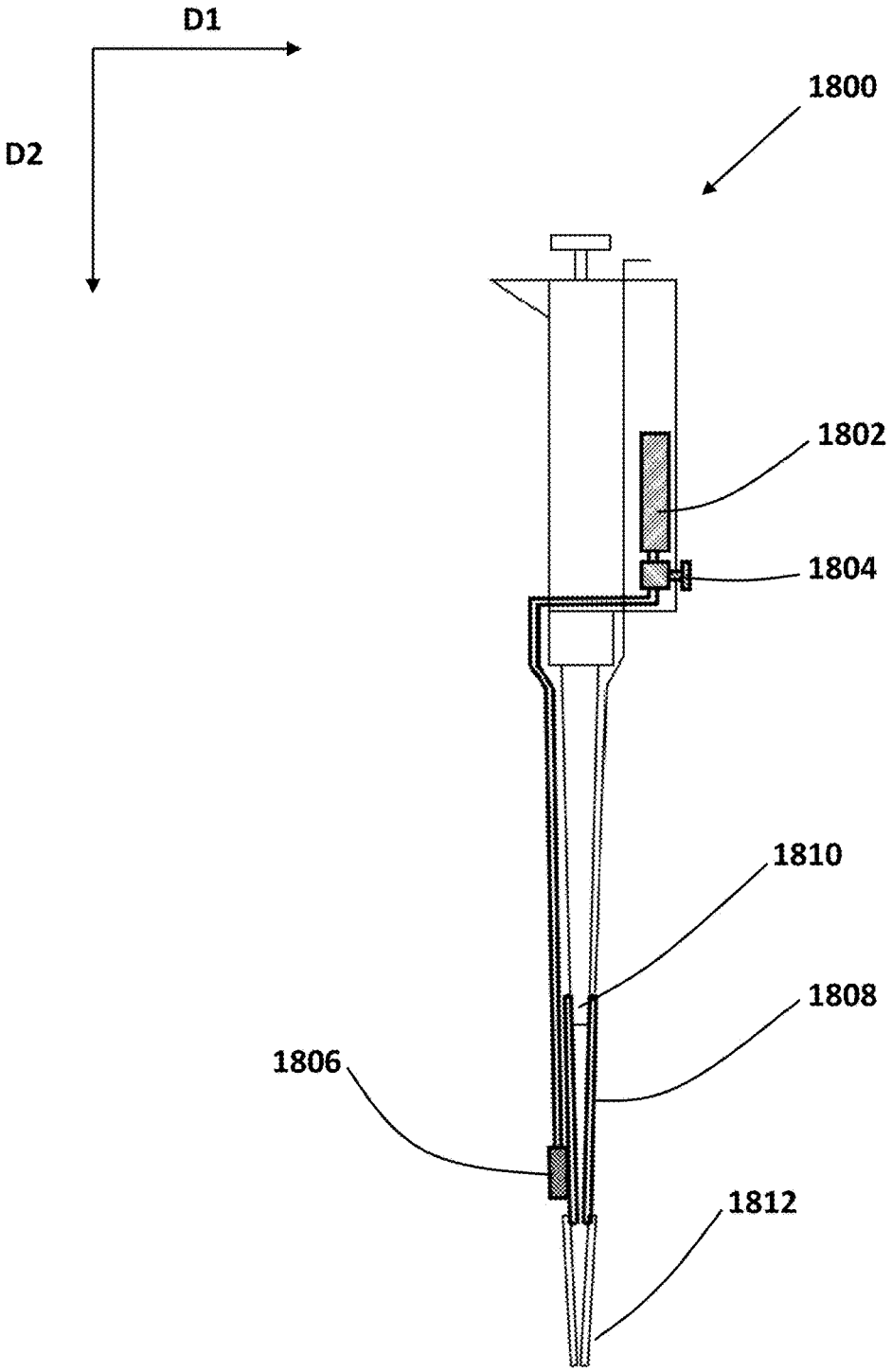
FIG. 18 provides a side perspective of a stirring device module built into a pipetting device having a vibration transmission interface.

Another embodiment of the present disclosure provides a pipette device used for measuring and/or transporting liquids, for example, chemical or biological reagents, incorporating a stirring device having a vibration transmission interface 1800 as illustrated in FIG. 18. The stirring device of the present embodiment comprises a power source 1802, a control unit 1804, a vibration inducing unit 1806 and a vibration transmission interface 1808. The proximal end of the vibration transmission interface 1808 is attached to the distal end of the pipette 1810. The point of attachment can be secured by friction between the vibration transmission interface and pipette, or alternatively an adhesion or bonding agent can be used to make the attachment.

A disposable or reusable pipette tip 1812 is attached directly to the distal end of the vibration transmission interface 1808. The vibration transmission interface 1808 is formed from a material, typically a polymer that is more flexible than the material used to construct the body of the pipette. The greater flexibility of the vibration transmission device provides a greater range of movement thereby enhancing the desired vibrations from the vibration inducing unit 1806. In addition, the vibration transmission interface dampens vibrations that would otherwise be transmitted to the body of the pipette. Vibrations such as these could have a deleteriously effect on the components of volumetric pipettes, or pipettes having electronic components housed within the body of the pipette.

Materials suitable for forming the vibration transmission interface are known to those skilled in the art. Characteristics used for selecting a material or combination of materials may include, tensile strength, tens mod of elasticity, tensile elongation, flex mod of elasticity, compressive strength, hardness and izod impact. Suitable materials include but are not limited to, ABS, Acrylic (Continuously processed), Kydex® 100, Noryl® (modified PPO), PETG, Polycarbonate, Polycarbonate (20% glass filled) Polystyrene, Polysulfone, PVC (rigid), Radel R®, Ultem®, Ultem® (30% glass filled) Acetal (copolymer), Acetal (homopolymer), HDPE, LDPE, Nylon (6 cast), Nylon (6/6 Extruded), PBT, PEEK, PET (semicrystalline), PP (homopolymer), PP (copolymer), PPS, PTFE, PVDF (homopolymer), UHMW-PE, Polyamide-imide Tecator™ 2154, Polyimide Vespel® SP-1, Vespel® SP-21, Vespel® S-22, Vespel® S-211, Vespel® SP-3, Vespel® SCP-5000, Vespel® SCP-5050, XX (Paper Phenolic), CE (Canvas Phenolic), LE (Linen Phenolic), FR-4 (Glass Epoxy) and G7 (Glass silicone).

Figure 19:
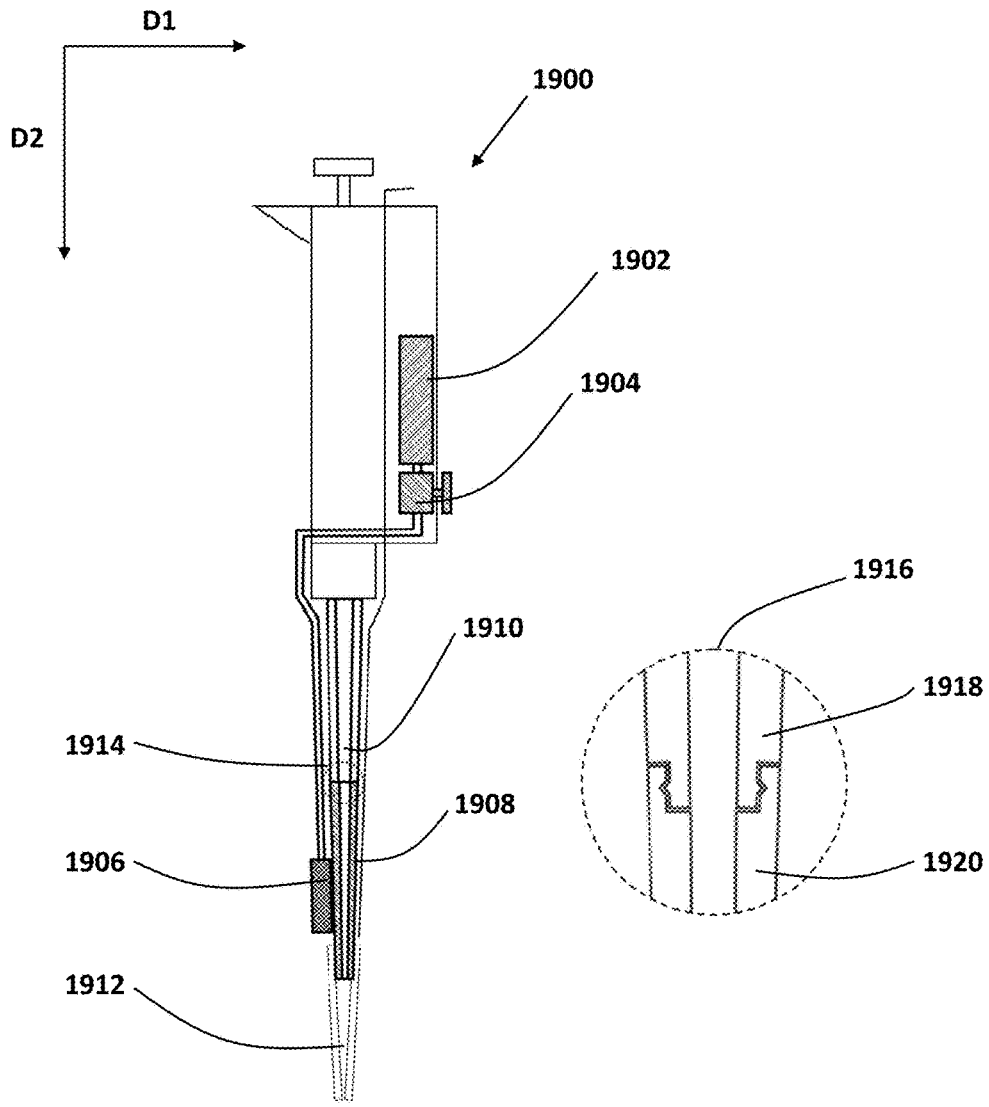
FIG. 19 provides a side perspective of a stirring device module built into a pipetting device having a built in vibration transmission interface.

Another embodiment of the present disclosure provides a pipette device used for measuring and/or transporting liquids, for example chemical or biological reagents, incorporating a stirring device having a vibration transmission interface 1900 is illustrated in FIG. 19. In the present embodiment, the stirring device is incorporated in the body of the pipette. The stirring device of the present embodiment comprises a power source 1902, a control unit 1904, a vibration inducing unit 1906 and a vibration transmission interface 1908. The vibration transmission interface 1908 is attached to the distal end of the pipette 1910. A disposable or reusable pipette tip 1912 is attached directly to the vibration transmission interface 1908. The proximal end of the vibration transmission interface 1908 is attached to the distal end of the pipette 1910, which is graphically represented at 1914. The attachment can be accomplished by having an interface having male and female joining parts, such as a bayonet mount, a screw mount or a push and locking mount. As noted previously the attachment point is graphically represented by 1914. An enlargement of 1914 is provided by 1916 showing a push and locking mount. The male 1918 and female 1920 joining parts are configured to fit securely using a set of ridges extending from the male parts fitting with corresponding indentations located on the female part. Alternatively, the attachment maybe the flat surface between the distal portion of the pipette and the proximal end of the vibration transmission interface. In all the above instances the attachment between the pipette and the vibration transmission interface can optionally utilize an adhesion or bonding agent to enhance the attachment.

Figure 20:
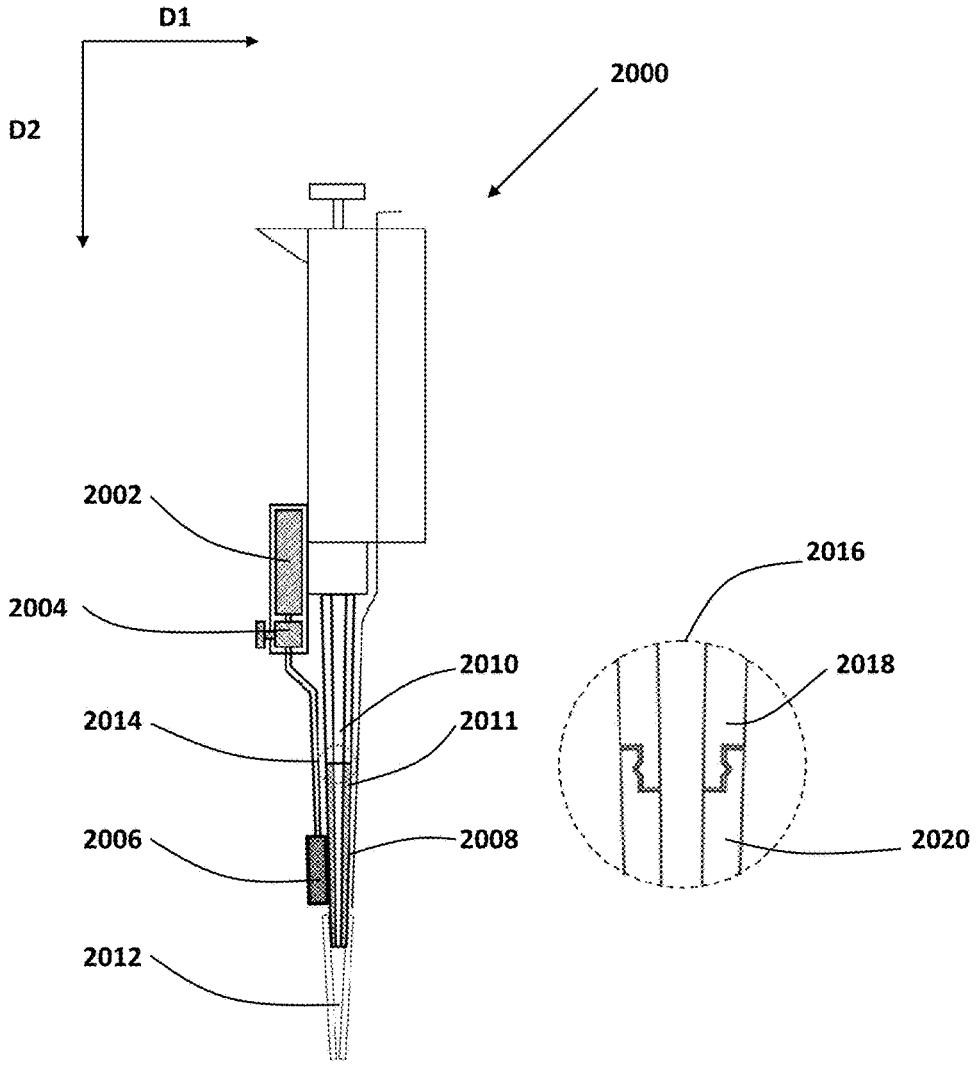
FIG. 20 provides a side perspective of a stirring device module that is attached externally to a pipetting device having a built in vibration transmission interface.

Another embodiment of the present disclosure provides a pipette device used for measuring and/or transporting liquids, chemical or biological reagents, incorporating a stirring device having a vibration transmission interface 2000 as illustrated in FIG. 20. In the present embodiment the stirring device is attached to the exterior of the pipette. The stirring device comprises a power source 2002, a control unit 2004, a vibration inducing unit 2006 and a vibration transmission interface 2008. The vibration transmission interface 2008 is attached to the distal end of the pipette 2010. A disposable or reusable pipette tip 2012 is attached directly to the vibration transmission interface 2008. The point of attachment between the proximal end of the vibration transmission interface 2011 and the distal end of the pipette 2010 occurs at the attachment point, which is graphically represented at 2014. The attachment can be accomplished by having an interface having male and female joining parts, such as a bayonet mount, a screw mount or a push and locking mount. As noted previously the attachment point is graphically represented by 2014. An enlargement of 2014 is provided by 2016 showing a push and locking mount. The male 2018 and female 2020 joining parts are configured to fit securely using a set of ridges extending from the male parts fitting with corresponding indentations located on the female part. Alternatively, the attachment maybe the flat surface between the distal portion of the pipette and the proximal end of the vibration transmission interface. In all the above instances the attachment between the pipette and the vibration transmission interface can optionally utilize an adhesion or bonding agent to enhance the attachment.

Figure 21:
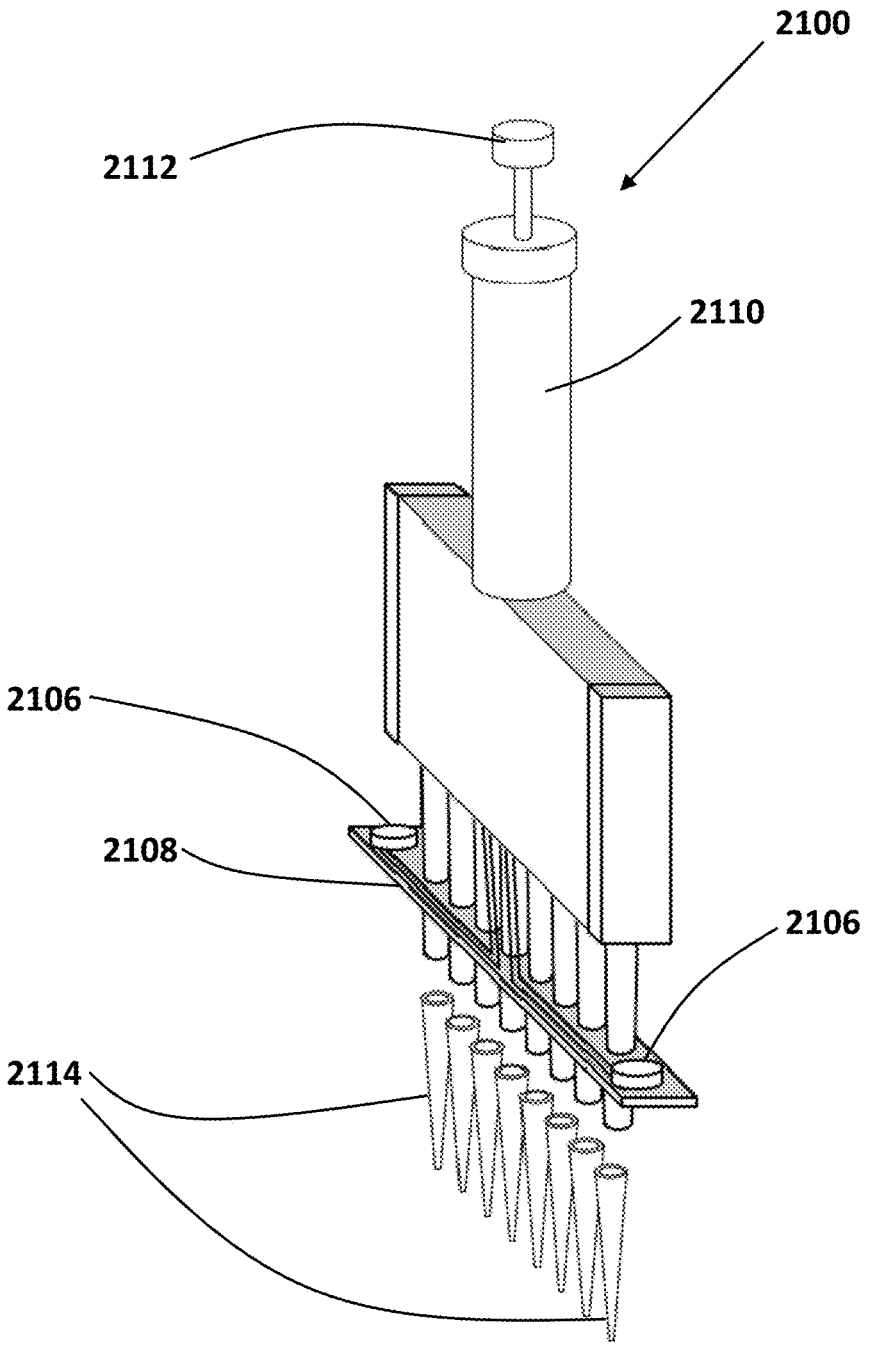
FIG. 21 provides a top down perspective view of a 8-channel pipette having a 8-channel stirrer module.

Another embodiment of the present disclosure provides a multiple channel pipette used for measuring and/or transporting liquids, chemical or biological reagents, incorporating a stirring device 2100 as illustrated in FIG. 21. The construction and mechanisms for multiple channel pipette devices are readily known to those in the art. For example see U.S. Pat. No. 8,201,466 "Multi-channel Pipette Including A Piston Holder with Guidance". FIG. 21 depicts an eight channel pipette having a stirring device. The eight channel pipette includes a handle 2110, controller 2112 and disposable or reusable pipette tips 2114. The stirring device comprises a power source (not shown), a control unit (not shown), a vibration inducing unit 2106, and a stirring device base 2108. The power source and control unit for the stirring device are located in the body of the 8 channel pipette. The vibration inducing unit 2106 is attached to the stirring device base 2108. The stirring device base 2108 also transmits the vibrations from the vibration inducing unit 2106 to the disposable or reusable pipette tips 2114.

Figure 22:
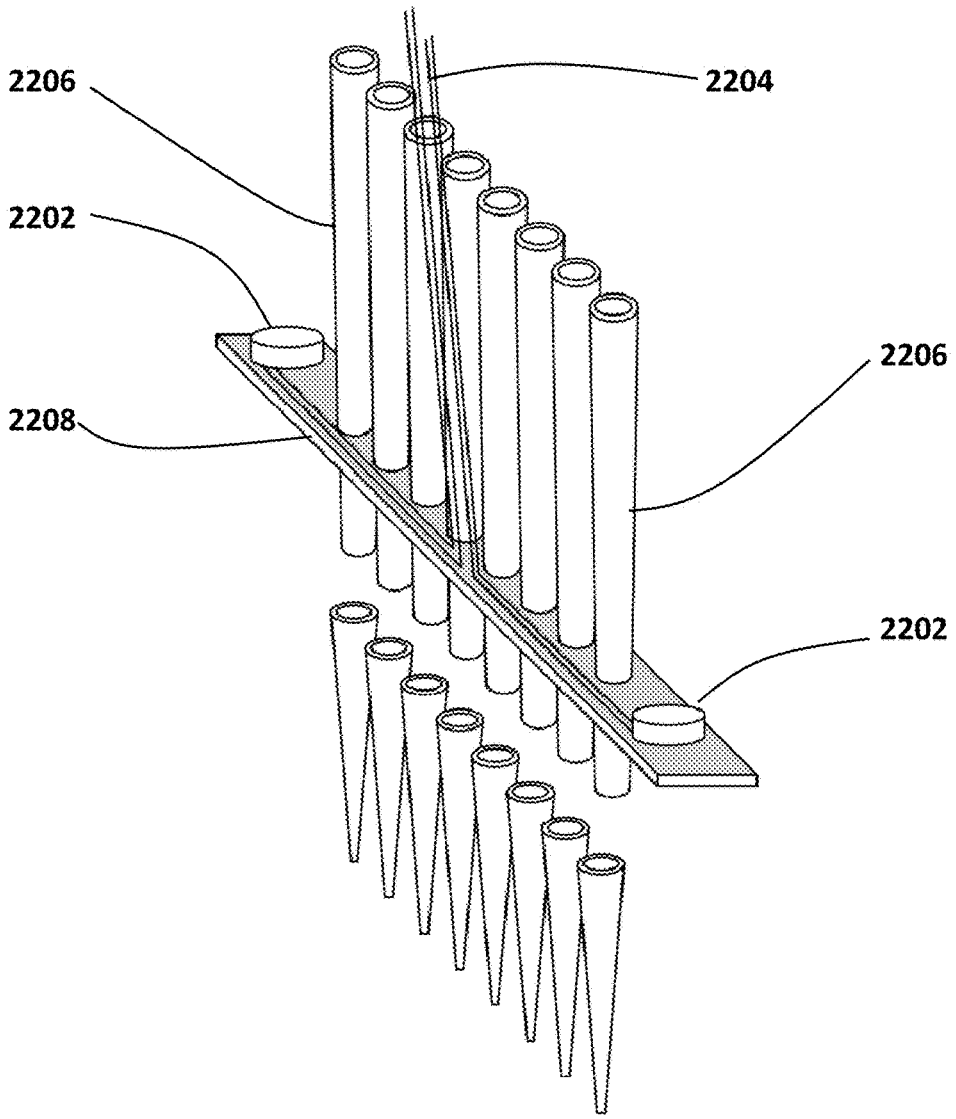
FIG. 22 provides a top down perspective view of a 8-channel vibration transmission interface.

FIG. 22 provides an illustration of the components of the stirring device that are external to the body of the eight channel pipette. The vibration inducing units 2202 are disk shaped vibrator motors, also referred to as coin motors. The vibration inducing units 2202 receive power via the power connections 2204, which are connected to the power source (not shown) and control unit (not shown) located in the body of the eight channel pipette. The vibration inducing units 2202 are built to vibrate at the same frequency when provided with the same voltage. The vibration inducing units 2202 are electrically configured to the power source so that both motors receive essentially the same voltage thereby ensuring that the vibrations are essentially at the same frequency so as to avoid cancellation of the vibrations.

The vibration transmission interfaces 2206 are formed from a material, typically a polymer that is more flexible than the material used to construct the body of the pipette. The greater flexibility of the vibration transmission interfaces 2206 provides a greater range of movement thereby enhancing the desired vibrations from the vibration inducing unit 2202. In addition, the vibration transmission interfaces 2206 dampen vibrations that would otherwise be transmitted to the body of the pipette. Vibrations such as these could have a deleteriously effect on the components of volumetric pipettes, or pipettes having electronic components housed within the body of the pipette. As discussed previously materials suitable for forming the vibration transmission interfaces are known to those of skill in the art. The vibration inducing units 2202 and vibration transmission interfaces 2206 are attached to the stirring device base 2208, which aligns the eight vibration transmission interfaces with the channels located on the pipette body. Optionally a portion of the power connections 2204 may be affixed to the stirring device base 2208.

Figure 23:
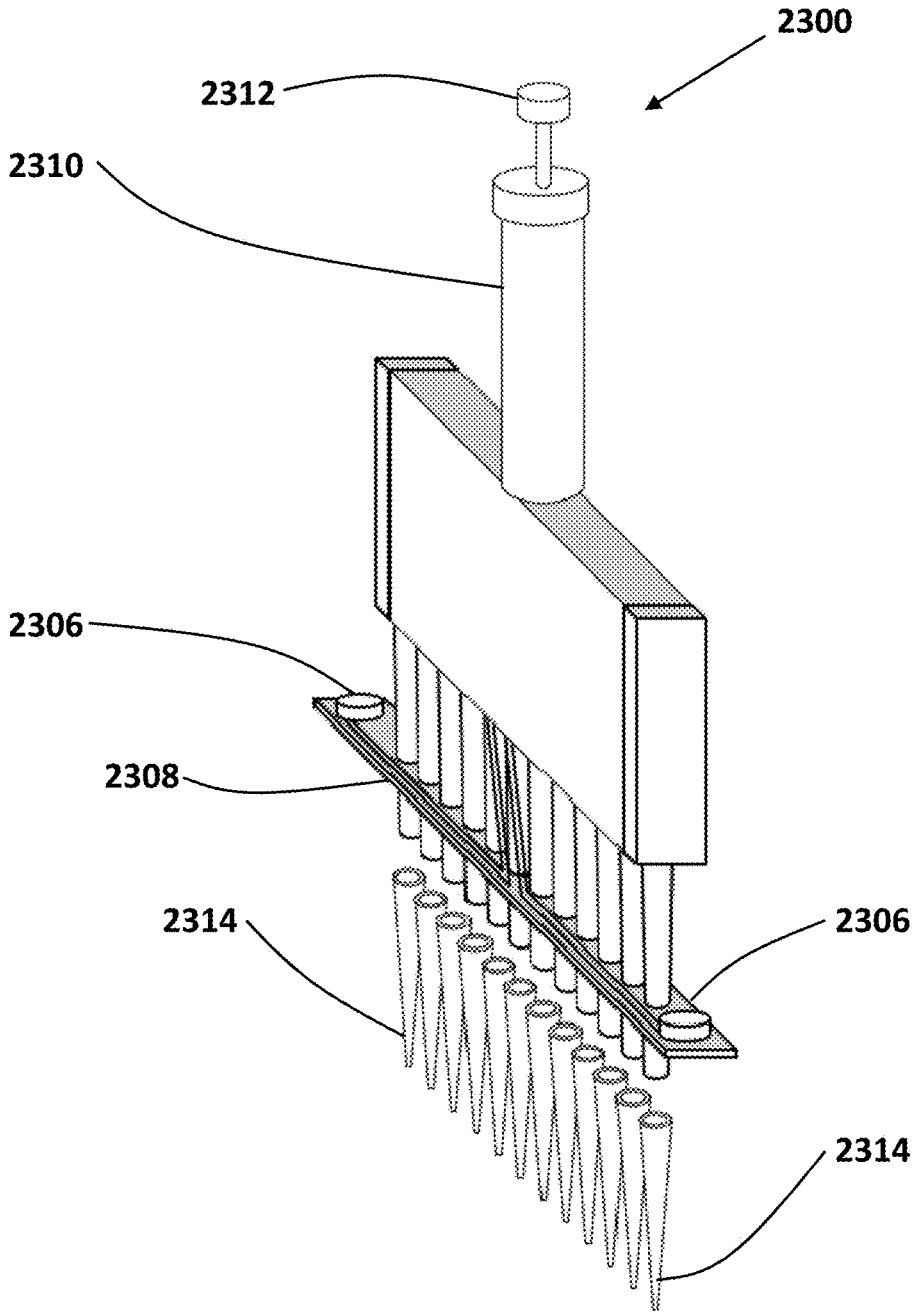
FIG. 23 provides a top down perspective view of a 12-channel pipette having a 12-channel stirrer module.

Another embodiment of the present disclosure provides a multiple channel pipette used for measuring and/or transporting liquids, chemical or biological reagents, incorporating a stirring device 2300 as illustrated in FIG. 23. As noted previously the construction and mechanisms for multiple channel pipette devices are readily known to those in the art. For example see U.S. Pat. No. 8,201,466 "Multi-channel Pipette Including A Piston Holder with Guidance". FIG. 23 depicts a twelve channel pipette having a stirring device. The twelve channel pipette includes a handle 2310, controller 2312 and disposable or reusable pipette tips 2314. The stirring device comprises a power source (not shown), a control unit (not shown), a vibration inducing unit 2306, and a stirring device base 2308. The power source and control units for the stirring device units are located in the body of the 12 channel pipette. The vibration inducing unit 2306 is attached to the stirring device base 2308. The stirring device base 2308 also transmits the vibrations from the vibration inducing unit 2306 to the disposable or reusable pipette tips 2314.

Figure 24:
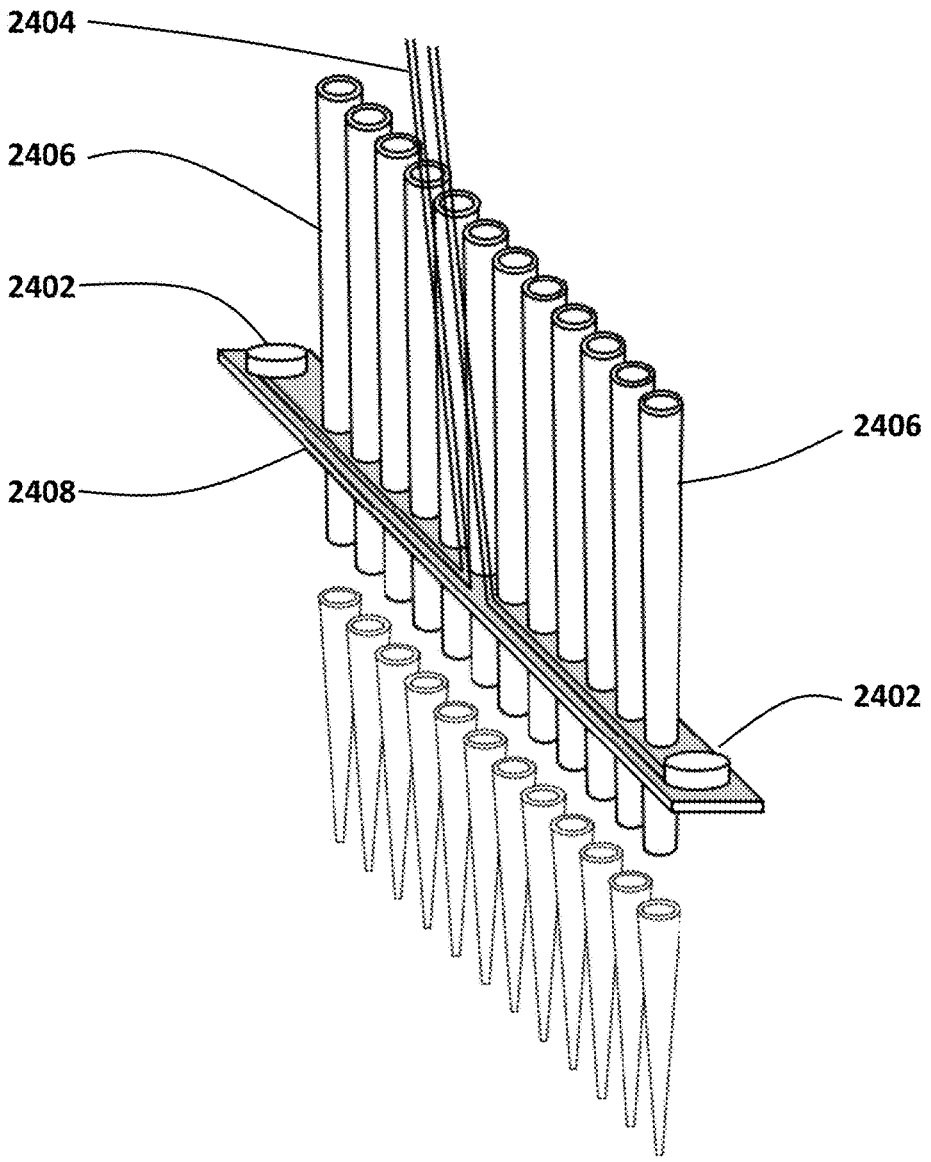
FIG. 24 provides a top down perspective view of a 12-channel vibration transmission interface.

FIG. 24 provides an illustration of the components of the stirring device that are external to the body of the twelve channel pipette. The vibration inducing units 2402 are disk shaped vibrator motors, also referred to as coin motors. The vibration inducing units 2402 receive power via the power connections 2404, which are connected to the power source (not shown) and control unit (not shown) located in the body of the twelve channel pipette. The vibration inducing units 2402 are built to vibrate at the same frequency when provided with the same voltage. The vibration inducing units 2402 are electrically configured to the power source so that both motors receive essentially the same voltage. The vibration transmission interfaces 2406 are formed from a material, typically a polymer that is more flexible than the material used to construct the body of the pipette. The greater flexibility of the vibration transmission device provides a greater range of movement thereby enhancing the desired vibrations from the vibration inducing unit 2402. In addition, the vibration transmission interfaces 2406 dampen vibrations that would otherwise be transmitted to the body of the pipette. Vibrations such as these could have a deleteriously effect on the components of volumetric pipettes, or pipettes having electronic components housed within the body of the pipette. As discussed previously materials suitable for forming the vibration transmission interfaces are known to those of skill in the art. The vibration inducing units 2402 and vibration transmission interfaces 2406 are attached to the stirring device base 2408, which aligns the twelve vibration transmission interfaces 2406 with the channels located on the pipette body. A portion of the power connections 2404 may be optionally affixed to the stirring device base 2408.

An embodiment of the present disclosure provides a microplate stirring device including, an orbital plate module having a proximal and distal side; at least one vibration inducing unit attached to the proximal side of said orbital plate module; and a base plate for receiving the microplate.

An aspect of the present disclosure provides a microplate stirring device where the orbital plate module has a plurality of pin probes extending from the distal side of the orbital plate module.

Another aspect of the present disclosure provides a microplate stirring device where the orbital plate module has 96 pin probes.

Another aspect of the present disclosure provides a microplate stirring device where the orbital plate module has 384 pin probes.

Another aspect of the present disclosure provides a microplate stirring device where the orbital plate module has 1536 pin probes.

Another aspect of the present disclosure provides a microplate stirring device including, a pin probe module having a plurality of pin probes.

Another aspect of the present disclosure provides a microplate stirring device where the pin probe module has 96 pin probes.

Another aspect of the present disclosure provides a microplate stirring device where the pin probe module has 384 pin probes.

Another aspect of the present disclosure provides a microplate stirring device where the pin probe has 1536 pin probes.

Another aspect of the present disclosure provides a microplate stirring device where the pin probe module is a pin probe lattice.

Another aspect of the present disclosure provides a microplate stirring device where the pin probe lattice has 96 pin probes.

Another aspect of the present disclosure provides a microplate stirring device where the pin probe lattice has 384 pin probes.

Another aspect of the present disclosure provides a microplate stirring device where the pin probe lattice has 1536 pin probes.

Another aspect of the present disclosure provides a microplate stirring device where the vibration inducing unit is a magnetic drive unit.

Another aspect of the present disclosure provides a microplate stirring device where the pin probe module has a contamination barrier.

Another aspect of the present disclosure provides a microplate stirring device where the orbital plate module has a contamination barrier.

An embodiment of the present disclosure provides a microplate stirring device including, a pin probe module having a proximal and distal side; at least one vibration inducing unit attached to the proximal side of said pin probe module; and a base plate for receiving the microplate.

Automated liquid handling systems are known and used in chemical, biochemical and clinical diagnostic and research laboratories. Automated liquid handling systems are readily known as automated dispensing systems, liquid handling robots, liquid handling robotic systems, liquid handling workstations, liquid dispensing workstations, liquid dispensing platforms or microplate dispensers. Regardless of the nomenclature adopted by the manufacturer, automated liquid handling systems share certain features including, the automated measuring and dispensing of liquid chemical and biochemical reagents, and utilizing microplates or small volume vessel arrays for conducting chemical or biochemical reactions in small volume wells, such as those in 96, 384 and 1536 well microplates. A number of automated liquid handling systems are commercially available. For example, Hamilton Microlab NIMBUS 96 Liquid Handling Workstation, http://www.hamiltonrobotics.com/hamilton-robotics/nimbus2/; Hamilton Microlab® STAR Liquid Handling Workstations, http://www.hamiltonrobotics.com/hamilton-robotics/star0/; Agilent Bravo Automated Liquid Handling Platform, http://www.chem.agilent.com/en-US/products-services/Instruments-Systems/Automation-Solutions/Bravo-Automated-Liquid-Handling-Platform/Pages/default.aspx; TECAN Freedom EVO liquid Handling and Robotics http://www.tecan.com/page/content/index.asp?MenuID=1&ID=2&Menu=1&Item=21.1; BioTek MultiFlo Microplate Dispenser http://www.biotek.com/products/liquid_handling/multiflo_microplate_dispenser.html; Thermo Scientific Matrix PlateMate Automated Pipetting System http://www.matrixtechcorp.com/automated/pipetting.aspx?id=28; Dynamic Devices Lynx LM Liquid Handling Robotic Workstation http://www.dynamicdevices.com/lynx-with-vvp; Beckman Biomek 4000 Laboratory Automation Workstation http://www.bclifesciences.com/automation/b2ktradein/index.html; Beckman Biomek FX Laboratory Automation Workstation https://www.beckmancoulter.com:443/wsrportal/wsrportal.portal?_nfpb=true&_windowLabel=UCM_RENDERER&_urlType=render&wIpUCM_RENDERER_path=%2Fwsr%2Fresearch-and-discovery%2Fproducts-and-services%2Fresearch-automation%2Fbiomek-fxp%2Findex.htm; and Perkin Elmer JANUS Automated Workstation http://www.perkinelmer.com/catalog/category/id/janus.

A typical automated liquid handling system includes a controller, liquid pipetting assembly and a probe head. The controller is typically a computer or microprocessor that controls the actions of the liquid pipetting assembly and the probe head. Among other functions, the controller controls the positioning of the probe head and/or microplate to ensure alignment of the probe head with the wells of the microplate; and the aspirating and dispensing of the desired type and amount of liquid(s). The liquid pipetting assembly includes components for measuring the desired amount of liquid to be aspirated or dispensed, and mechanical and/or electrical elements that physically dispense the liquid. The probe head includes liquid pipetting channels that aspirate or dispense liquid(s); and pipettes tips. A probe head can include sufficient liquid pipetting channels to aspirate liquid from or dispense liquid to all the wells of a microplate simultaneously, for example having 96, 384 or 1534 liquid pipetting channels for use with 96, 384 or 1534 well microplates. Alternatively a probe head can have sufficient liquid pipetting channels to accommodate one row or one column of microplate wells at a time, for example, 8 or 12 liquid pipetting channels for 96 well microplates, 16 or 24 liquid pipetting channels for 384 well microplates, or 32 or 48 liquid pipetting channels for 1534 well microplates. The probe head can be stationary in which case the microplate is positioned by the controller so that the liquid pipetting channels of the probe head are accurately aligned with the respective wells of the microplate. Alternatively the probe head can be positioned by the controller so that the liquid pipetting channels of the probe head are accurately aligned with the respective wells of the microplate; or both the probe head and the microplate can be positioned to accurately align the liquid pipetting channels of the probe head with the respective wells of the microplate.

Operationally, the controller sends instructions to the liquid pipetting assembly as to the type and amount of liquid that is to be aspirated or dispensed. The liquid pipetting assembly includes a pipetting mechanism having electrical and mechanical components that can direct or withdraw a necessary volume of air to the liquid handling channels located in the probe head to aspirate or dispense a desired volume of liquid. The controller aligns the probe head and/or the microplate so that the liquid handling channels in the probe head are aligned with the target wells of the microplate and the liquid is aspirated from or dispensed into the wells.

Some benefits of automated liquid handling systems that use microplates is the ability to conduct a large number of reactions requiring minimal human intervention; and the efficiency of being able to repeatedly measure and dispense small amounts of reagents in an accurate manner for a large number of reactions.

However as noted previously, the use of currently available microplates and microplates that are in development having even greater number of wells, is hampered by physical constraints resulting from the smaller wells and the corresponding smaller volumes that they accommodate. Materials and reagents used for screening assays are often difficult to dissolve. Failure to dissolve the materials for an assay can result in inaccurate or inconsistent data. It has been shown that mixing the contents of the well can alleviate this problem (Hancock, Michael K., Medina, Myleen N., Smith, Brendan M., and Orth, Anthony P., "Microplate Orbital Mixing Improves High-Throughput Cell-Based Reporter Assay Readouts", Journal of Biomolecular Screening 12(1); 2007, 140-144, www.sbsonline.com).

This problem is not easily addressed because of the size of the wells and the corresponding smaller volume of materials. The smaller well size and amounts of materials make it difficult to impart sufficient agitation for thorough mixing of the contents in the well. The following embodiments of the present disclosure provide solutions to this unmet need.

An embodiment of the present disclosure provides an automated liquid handling system having a stirring module assembly, capable of stirring twelve wells of a column or row of a microplate simultaneously. The stirring module assembly is comprised of two vibration inducing units, twelve vibration transmission interfaces and a stirring module base plate.

A stirring module assembly is typically incorporated into the probe head of an automated liquid handling workstation. The probe head can also be referred to as a pipette head, syringe head or dispenser head depending on the nomenclature used by the manufacturer of the automated liquid handling system. Regardless of the naming, a probe head houses the apparatus employed by an automated liquid handling system to aspirate a liquid from or dispense a liquid to a microplate or an array of vessels. A microplate, as previously noted, can have 6, 24, 96, 384 or 1536 sample wells arranged in a 2 by 3 rectangular matrix, such as the 8×12 matrix for 96 well microplates, the 16×24 matrix for 384 well microplates and the 32×48 matrix for 1536 well microplates. The stirring module assembly typically is controlled by the controller of the automated liquid handling system so that its operation is integrated with the operation of the automated liquid handling system. Optionally the stirring module assembly can also be operated manually.

Figure 84:
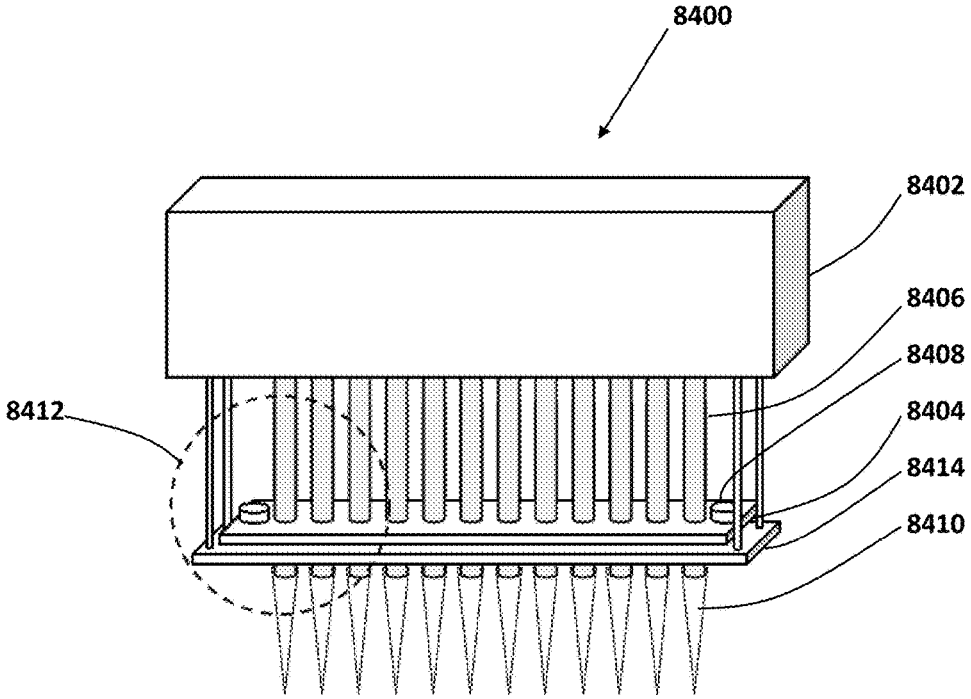
FIG. 84 provides a top down perspective view of a probe head having a 12 liquid handling channel stirring module assembly.

FIG. 84 provides a top down perspective view of a stirring module assembly having 12 channels 8400. The stirring module assembly is incorporated into the probe head of an automated liquid handling system 8402. The stirring module assembly having a stirring module base plate 8404, 12 vibration transmission interfaces, one for each of the liquid handling channels, and two vibration inducing units 8408. Each vibration transmission interface 8406 is attached to the stirring base plate 8404. The vibration inducing units 8408 are attached to the stirring module base plate 8404 as well. Activation of the vibration inducing units 8408 causes the stirring base plate 8404 to vibrate. The vibration is transmitted through to the pipette tips 8410 attached to the vibration transmission interfaces 8406. As described in FIGS. 12 through 15 and their associated text, the vibration from the vibration inducing unit 8408 causes a swirling motion to the pipette tips 8410 immersed in the solution, which results in the stirring of the solution. An ejector plate 8414 extends from the probe head and detaches the pipette tips when desired. A further discussion of the stirrer module assembly is directed to the partial view 8412 in FIG. 85, which describes a single vibration transmission interface having a flexible tube.

Figure 85:
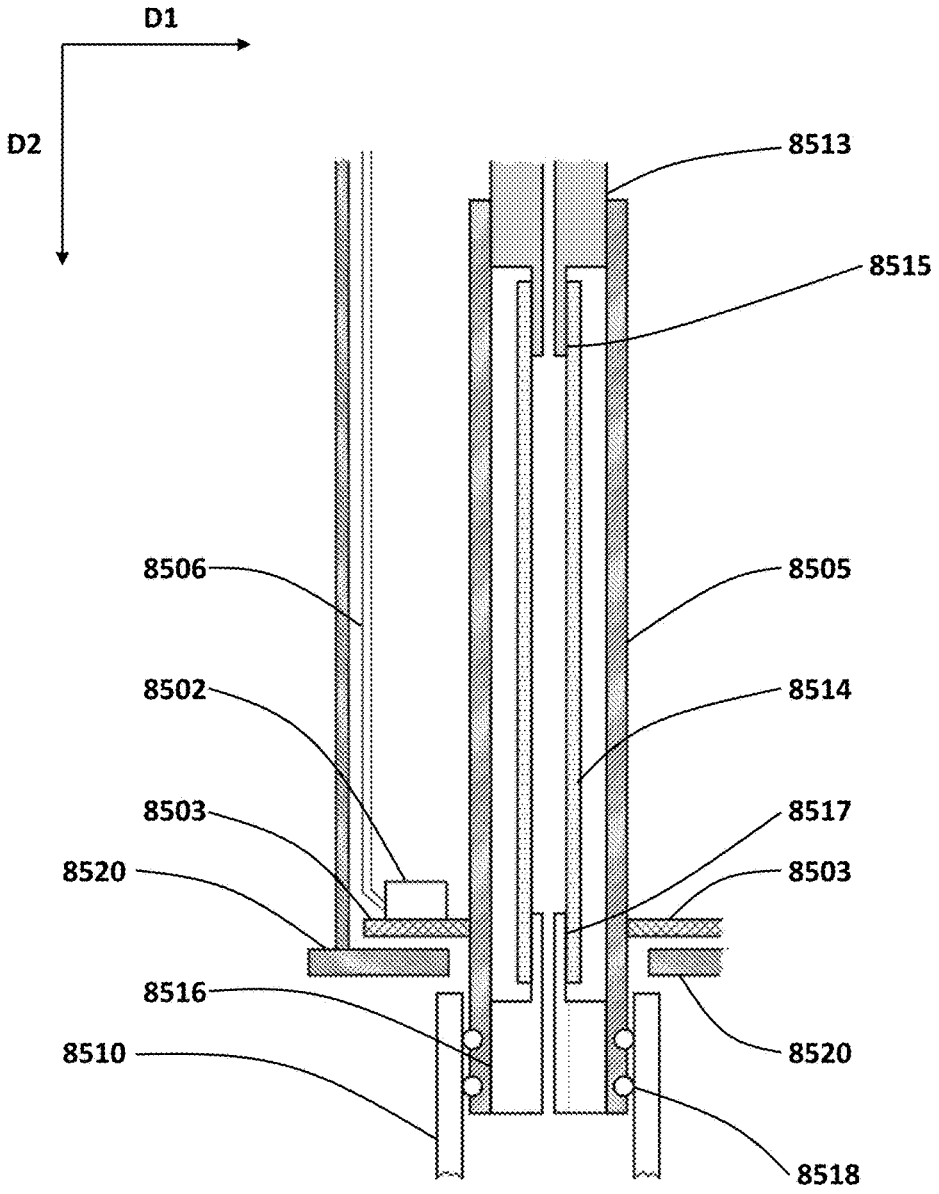
FIG. 85 provides a side view of a single liquid handling channel of a stirring module assembly.

FIG. 85 shows a side plan perspective of the partial view 8412 of a stirring module assembly 8400, as referred to in FIG. 84, having a lengthwise or longitudinal dimension extending in the D2 direction and a widthwise dimension extending in the D1 direction. In the present embodiment, a vibration inducing unit 8502 is attached to a stirring module base plate 8503. Wiring 8506 provides the vibration inducing unit 8502 with power from the liquid handling station (not shown). A vibration transmission interface 8505 is attached at its proximal portion to a port 8513 from the pipetting mechanism in the liquid handling system. The vibration transmission interface 8505, extending in the D2 direction, is attached to the stirring module base plate 8503 and extends distally beyond the stirring module base plate 8503. A pipette tip 8510 is detachably attached to the distal portion of the vibration transmission interface 8505. The vibration transmission interface 8505 encloses a flexible tube 8514. The proximal end of the flexible tube 8514 is attached to a distal extension 8515 of the port 8513 from the pipetting mechanism in the liquid pipetting assembly. The distal end of the flexible tube 8514 is attached to the proximal extension 8517 of a tube end piece 8516. The distal portion of the tube end piece 8516 is attached to the distal portion of the vibration transmission interface 8505. The distal portion of the vibration transmission interface 8505 has two O-rings 8518, which secures the detachably attached pipette tip 8510 in place. Liquid is aspirated into the pipette tip or dispensed from by the action of the pipetting mechanism in the liquid pipetting assembly. An ejector plate 8520 extends from the probe head (not shown) and is controlled by the controller for ejecting the pipette tips 8510. The pipette tip 8510 is ejected when the ejector plate 8520 is moved in the D2 direction, contacting the proximal end of the pipette tip and applying force until the pipette tip 8510 is dislodged from the distal portion of the vibration transmission interface 8505. The ejector plate 8520 is not in contact with the vibration transmission interface 8505 so that it does not hinder the vibration transmission interface 8505 from transmitting the vibrations from the vibration inducing unit 8502 to the pipette tip 8510. In the present embodiment, liquid is aspirated into, or dispensed from the pipette tip 8510 by the action the pipetting mechanism in the liquid pipetting assembly. The flexible tube 8514, enclosed within the vibration transmission interface 8505, forms an air tight seal with the distal extension 8515 of the port 8513 and the proximal extension 8517 of the tube end piece 8616 so that the air that originates from the pipetting mechanism is contained within the flexible tube 8514, and is used to aspirate and dispense the liquid from the pipette tip 8610.

The vibration transmission interface is made of a material having sufficient strength and rigidity to support the stirring module base plate and all the components attached to the stirring module base plate, while retaining sufficient flexibility to transmit the vibrations from the vibration inducing unit to the distal end of the pipette tip. The vibration transmission interface can be made from materials having the aforementioned characteristics. Materials suitable for forming the vibration transmission interface are known to those skilled in the art. Characteristics used for selecting a material or combination of materials may include, tensile strength, tens mod of elasticity, tensile elongation, flex mod of elasticity, compressive strength, hardness and izod impact. Suitable materials include but are not limited to, ABS, Acrylic (Continuously processed), Kydex® 100, Noryl® (modified PPO), PETG, Polycarbonate, Polycarbonate (20% glass filled) Polystyrene, Polysulfone, PVC (rigid), Radel R®, Ultem®, Ultem® (30% glass filled) Acetal (copolymer), Acetal (homopolymer), HDPE, LDPE, Nylon (6 cast), Nylon (6/6 Extruded), PBT, PEEK, PET (semicrystalline), PP (homopolymer), PP (copolymer), PPS, PTFE, PVDF (homopolymer), UHMW-PE, Polyamide-imide Tecator™ 2154, Polyimide Vespel® SP-1, Vespel® SP-21, Vespel® S-22, Vespel® S-211, Vespel® SP-3, Vespel® SCP-5000, Vespel® SCP-5050, XX (Paper Phenolic), CE (Canvas Phenolic), LE (Linen Phenolic), FR-4 (Glass Epoxy) and G7 (Glass silicone).

Referring to FIG. 84, when it is desired to have the materials in the wells of the microplate stirred, the probe head of the automated liquid handling system 8402 is positioned such that the distal end of the pipette tips 8410 are immersed in the liquid contained in the wells of the microplate (not shown). The stirring process is initiated when the controller of the automated liquid handling system (not shown) activates the vibration inducing unit 8408, which vibrates. The vibrations are transmitted to the stirring module base plate 8404 which in turn transmits the vibrations to the vibration transmission interface 8406 on through to the distal end of the pipette tips 8410, which are immersed in the solutions in the respective wells of the microplate. The vibration causes a swirling motion to the distal end of the pipette tip 8410, which results in the stirring of the liquid materials contained in the well of the microplate. The preceding description of the stirring module assembly and the stirring process is provided from the perspective of a single liquid handling channel and its associated pipette tip and well of a microplate. It should be understood that this description applies to all the liquid handling channels, associated pipette tips and their respective wells of the microplate. Similarly the stirring process occurs simultaneously for all the pipette tips and their respective wells for the stirring module assembly.

Figure 86:
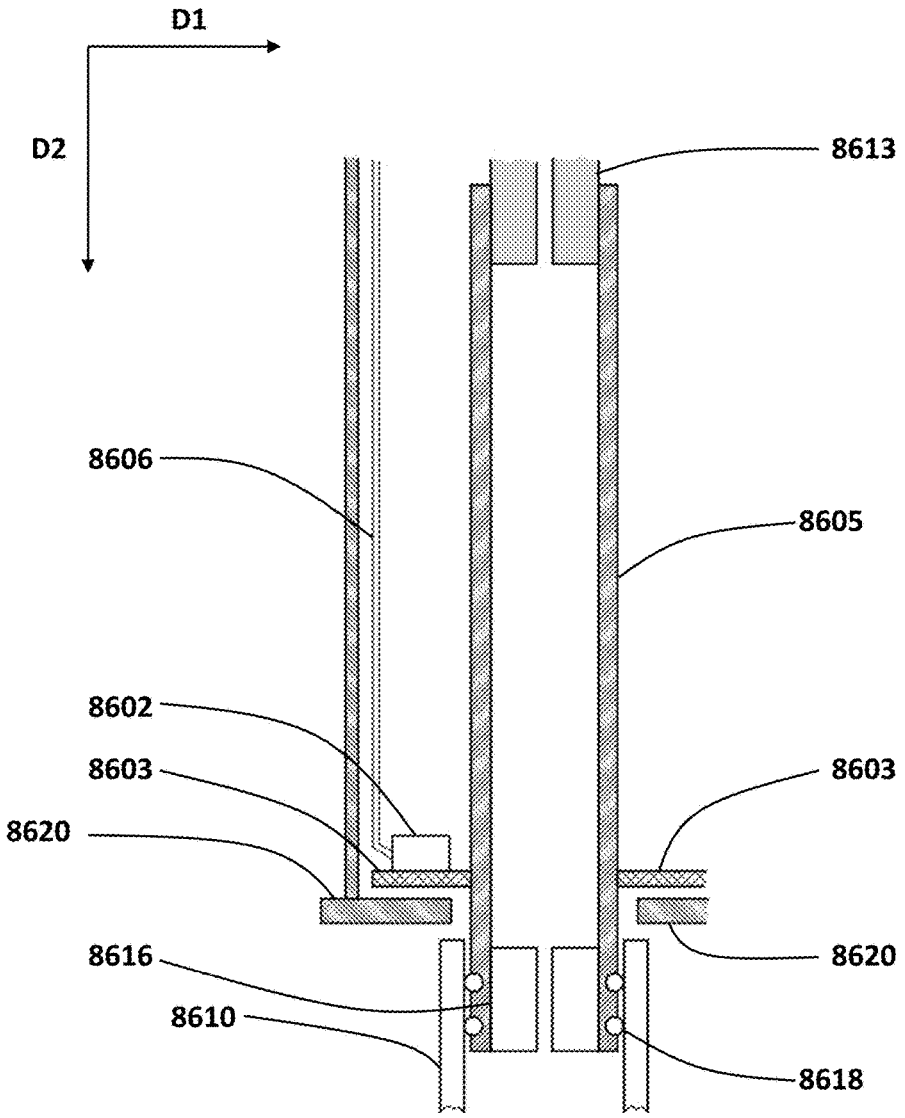
FIG. 86 provides a side view of a single liquid handling channel of a stirring module assembly.

Another aspect of the present embodiment provides a stirring module assembly having a vibration transmission interface that does not require a flexible tube. FIG. 86 refers again to the side plan perspective of the partial view 8412 of a stirring module assembly 8400, as referred to in FIG. 84. In the present alternate embodiment, a vibration inducing unit 8602 is attached to a stirring module base plate 8603. Wiring 8606 provides the vibration inducing unit 8602 with power from the liquid handling station (not shown). A vibration transmission interface 8605 is attached at its proximal portion to a port 8613 from the pipetting mechanism in the liquid handling system. The vibration transmission interface 8605, extending in the D2 direction, is attached to the stirring module base plate 8603 and extends distally beyond the stirring module base plate 8603. A pipette tip 8610 is detachably attached to the distal portion of the vibration transmission interface 8605. The distal portion of the vibration transmission interface 8605 is attached to an end piece 8616. The distal portion of the vibration transmission interface 8605 has two O-rings 8618, which secures the detachably attached pipette tip 8610 in place. Liquid is aspirated into or dispensed from the pipette tip 8610 by the action of the pipetting mechanism in the liquid handling assembly. An ejector plate 8620 extends from the probe head (not shown) and is controlled by the controller for ejecting the pipette tips 8610. The pipette tip 8610 is ejected when the ejector plate 8620 is moved in the D2 direction, contacting the proximal end of the pipette tip and applying force until the pipette tip 8610 is dislodged from the distal portion of the vibration transmission interface 8605. The ejector plate 8620 is not in contact with the vibration transmission interface 8605 so that it does not hinder the vibration transmission interface 8605 from transmitting the vibrations from the vibration inducing unit 8602 to the pipette tip 8610. In the present embodiment, liquid is aspirated into, or dispensed from the pipette tip 8610 by the action of the pipetting mechanism in the liquid pipetting assembly. The vibration transmission interface 8605 forms an air tight seal with the port 8613 and the end piece 8616 so that the air that originates from the pipetting mechanism is contained within the vibration transmission interface 8605, and is used to aspirate and dispense the liquid from the pipette tip 8610.

Another embodiment of the present disclosure provides an automated liquid handling system having a stirring module assembly capable of stirring 96 wells of a microplate simultaneously. The stirring module assembly is comprised of four vibration inducing units, 96 vibration transmission interfaces and a stirring module base plate.

Figure 87:
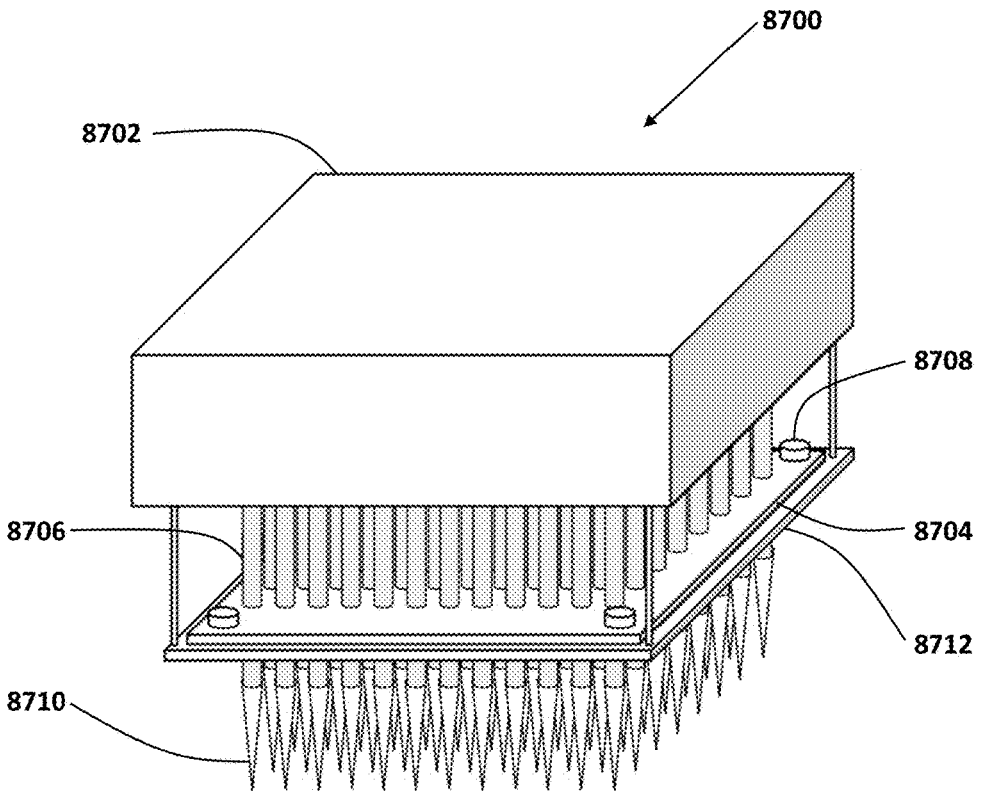
FIG. 87 provides a top down perspective view of a probe head having a 96 liquid handling channel stirring module assembly.

FIG. 87 provides a top down perspective view of a stirring module assembly 8700 having 96 liquid handling channels for dispensing liquids to a 96 well microplate. The stirring module assembly is incorporated into the probe head 8702 of a liquid handling system. The stirring module assembly having a stirring module base plate 8704, 96 vibration transmission interfaces, one for each of the liquid handling channels, and four vibration inducing units 8708. Each vibration transmission interface 8706 is attached to the stirring base plate 8704. The vibration inducing units 8708 are attached to the stirring base plate 8704. Activation of the vibration inducing units 8708 causes the stirring base plate 8704 to vibrate. The vibration is transmitted to the pipette tips 8710 attached to the vibration transmission interfaces 8706. As described in FIGS. 12 through 15 and their associated text, the vibration from the vibration inducing units 8708 causes a swirling motion to the pipette tips 8710 immersed in the solution, which results in the stirring of the solution. An ejector plate 8712 extends from the probe head 8702. The ejector plate 8712 ejects the pipette tips when desired by moving until making contact with the proximal end of the pipette tips 8710 and applying force to them until they are dislodged from their vibration transmission interfaces 8706.

An embodiment of the present disclosure provides an automated liquid handling system having a stirring module assembly capable of stirring 12 wells of a row or column of a 96 well microplate simultaneously. The stirring module assembly is comprised of a vibration transmission interface for each of the 12 liquid handling channels, each vibration transmission interface encloses a vibration inducing unit and a flexible tube.

Figure 88:
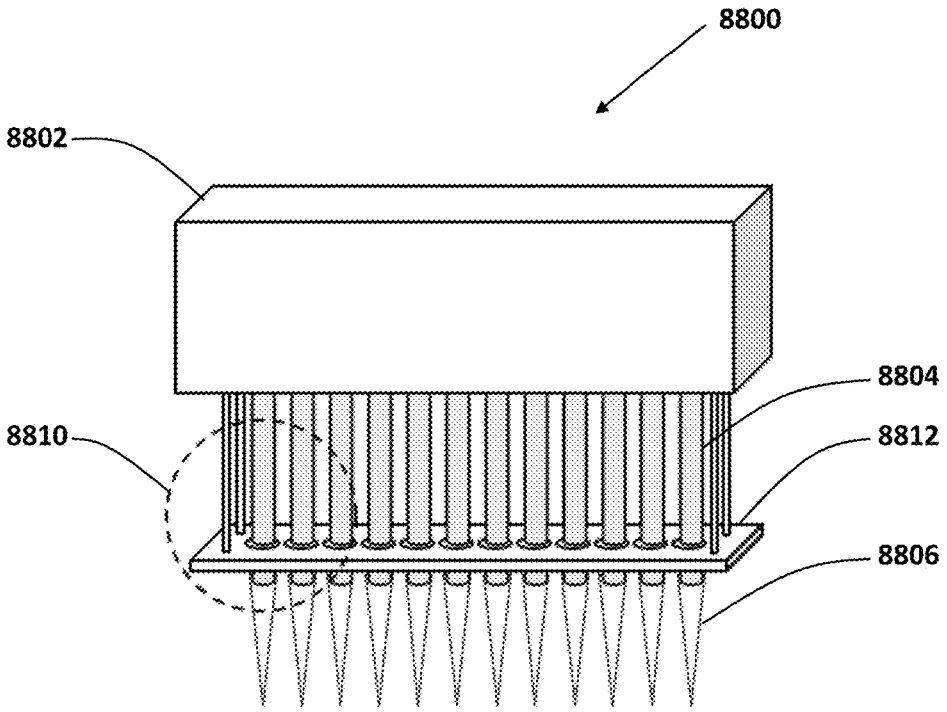
FIG. 88 provides a top down perspective view of a probe head having a 12 liquid handling channel stirring module assembly.

FIG. 88 provides a top down perspective view of a stirring module assembly having 12 channels 8800. The stirring module assembly is incorporated into the probe head of a liquid handling system 8802. The stirring module assembly having 12 vibration transmission interfaces, one for each of the twelve liquid handling channels, each vibration transmission interface 8804 encloses a vibration inducing unit (not shown) and a flexible tube (not shown) that connects the pipetting mechanism in the liquid pipetting assembly to the pipette tip 8806. An ejector plate 8812 extends from the probe head and detaches the pipette tips 8806 when desired. A further discussion of the stirrer module assembly is directed to the partial view of the stirrer module assembly 8810 in FIG. 89.

Figure 89:
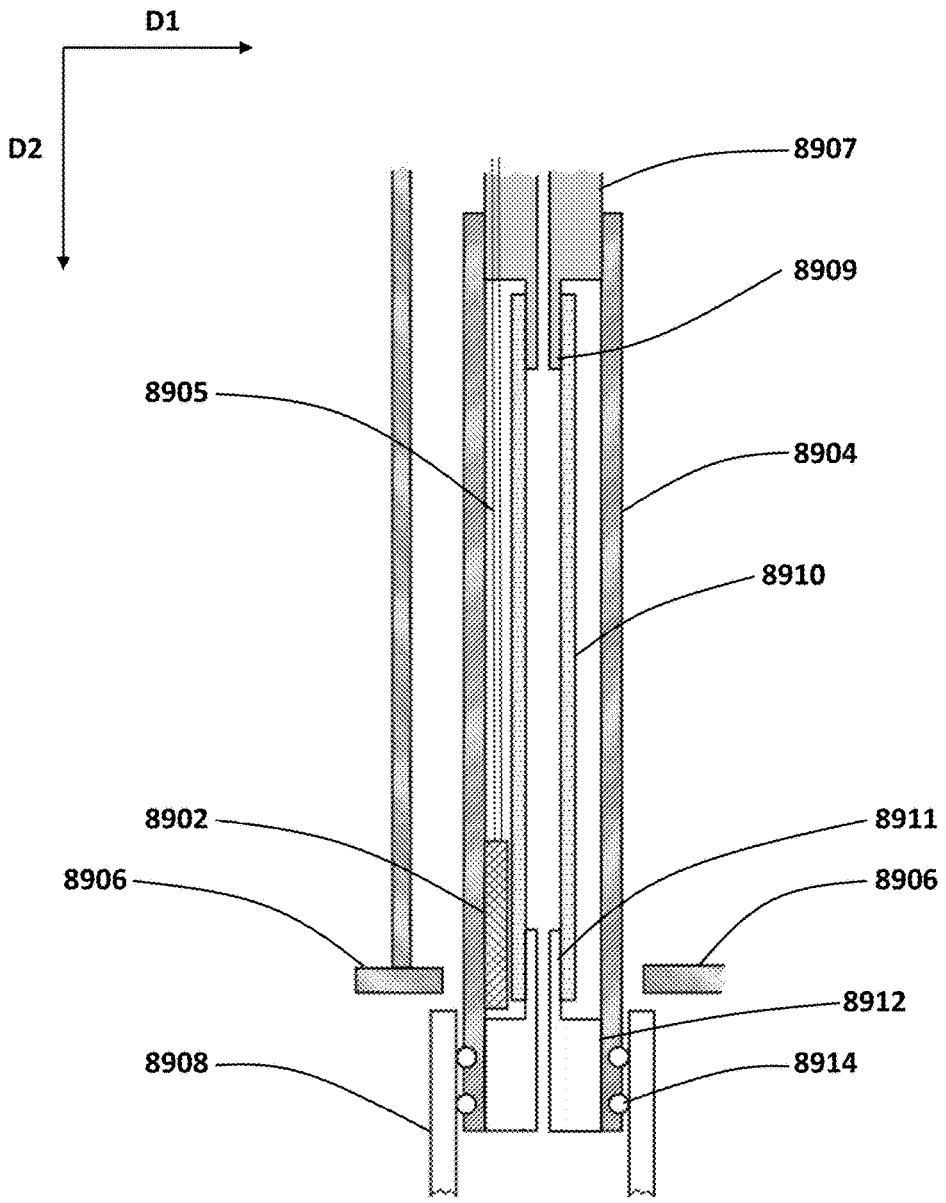
FIG. 89 provides a side view of single liquid handling channel of a stirring module assembly.

FIG. 89 shows a side plan perspective of the partial view 8810 of a stirring module assembly 8800, as referred to in FIG. 88, having a lengthwise or longitudinal dimension extending in the D2 direction and a widthwise dimension extending in the D1 direction. In the present embodiment, a vibration inducing unit 8902 is enclosed and attached to the interior surface of a vibration transmission interface 8904. Wiring 8905 from the liquid handling system controller (not shown) provides the vibration inducing unit 8902 with power. The vibration transmission interface 8904 is attached at its proximal portion to a port 8907 from the pipetting mechanism in the liquid handling system. The vibration transmission interface 8904 extends distally beyond an ejector plate 8906. A pipette tip 8908 is detachably attached to the distal portion of the vibration transmission interface 8904. The vibration transmission interface 8904 encloses a flexible tube 8910. The proximal end of the flexible tube 8910 is attached to a distal extension 8909 of the port 8907 from the liquid pipetting mechanism (not shown). The distal end of the flexible tube 8910 is attached to a proximal extension 8911 of a tube end piece 8912. The distal portion of the tube end piece 8912 is attached to the distal portion of the vibration transmission interface 8904. The distal portion of the vibration transmission interface 8804 includes two O-rings 8914, which secures the detachably attached pipette tip 8908. Liquid is aspirated into or dispensed from the pipette tip 8908 by the action of the pipetting mechanism in the liquid pipetting assembly. The ejector plate 8906 extends from the probe head (not shown) and ejects the pipette tip 8908. The pipette tip 8908 is ejected when the ejector plate 8906 is moved in the D2 direction, contacting the proximal end of the pipette tip 8908 and applying force until the pipette tip 8908 is dislodged from the distal portion of the vibration transmission interface 8904. The ejector plate 8906 is not in contact with the vibration transmission interface 8904 so that it does not hinder the vibration transmission interface 8904 from transmitting the vibrations from the vibration inducing unit 8902 to the pipette tip 8908. In the present embodiment, liquid is aspirated into, or dispensed from the pipette tip 8908 by the action of the pipetting mechanism in the liquid pipetting assembly. The flexible tube 8910, enclosed within the vibration transmission interface 8904, forms an air tight seal with the distal extension 8909 of the port 8907 and the proximal extension 8911 of the tube end piece 8912 so that the air that originates from the pipetting mechanism is contained within the flexible tube 8910, and is used to aspirate and dispense the liquid from the pipette tip 8908. When the vibration inducing unit 8902 is activated, the vibration is transmitted through the vibration transmission interface 8904 to the pipette tip 8908. As described in FIGS. 12 through 15 and their associated text, this vibration causes a swirling motion to the pipette tips immersed in the solution, which results in the stirring of the solution.

Another embodiment of the present disclosure provides an automated liquid handling system having a stirring module assembly capable of stirring 96 wells of a 96 well microplate simultaneously. The stirring module assembly is comprised of a vibration transmission interface for each of the 96 liquid handling channels, each vibration transmission interface encloses a vibration inducing unit and a flexible tube.

Figure 90:
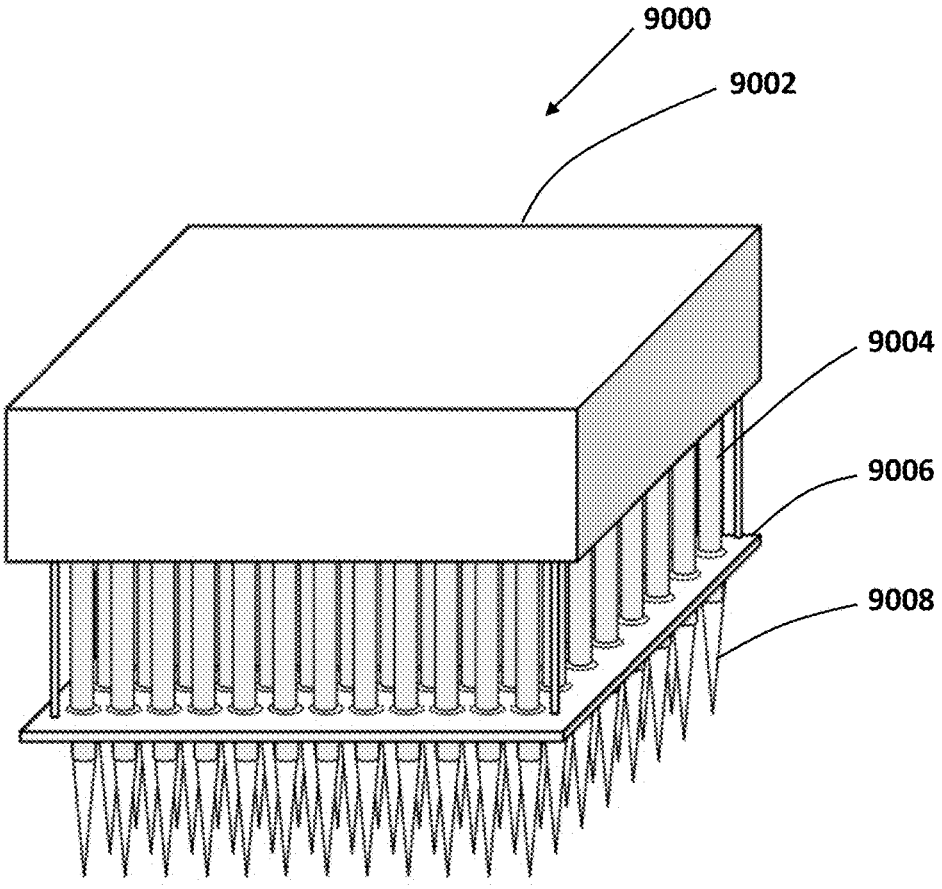
FIG. 90 provides a top down perspective view of a probe head having a 96 liquid handling channel stirring module assembly.

FIG. 90 provides a top down perspective view of a stirring module assembly 9000 having 96 liquid handling channels for aspirating or dispensing liquids to a 96 well microplate. The stirring module assembly is incorporated into the probe head 9002 of a liquid handling system. The stirring module assembly having 96 vibration transmission interfaces, one for each of the 96 liquid handling channels, each vibration transmission interface 9004 encloses a vibration inducing unit (not shown) and a flexible tube (not shown) that connects the pipetting mechanism in the liquid pipetting assembly to the pipette tip 9008. The vibration transmission interface 9004 is described in FIG. 89 and its associated text. An ejector plate 9006 extends from the probe head 9002 and ejects the pipette tips 9008 when desired by extending until making contact with the proximal end of the pipette tips 9008 and applying force to them until they are dislodged from their vibration transmission interfaces 9004. Activation of the vibration inducing units causes the vibration transmission interfaces 9004 to vibrate. The vibration is transmitted to the pipette tips 9008 attached to the vibration transmission interfaces 9004. As described in FIGS. 12 through 15 and their associated text, the vibration from the vibration inducing units causes a swirling motion to the pipette tips 9008 immersed in the solution, which results in the stirring of the solution.

An embodiment of the present disclosure provides an automated liquid handling system having a stirring module assembly capable of stirring 12 wells of a row or column of a 96 well microplate simultaneously. The stirring module assembly is comprised of a vibration transmission interface for each of the 12 liquid handling channels each vibration transmission interface encloses a vibration inducing module and a flexible tube; and an ejector sleeve for each of the 12 liquid handling channels for ejecting the detachably attached pipette tips.

Figure 91:
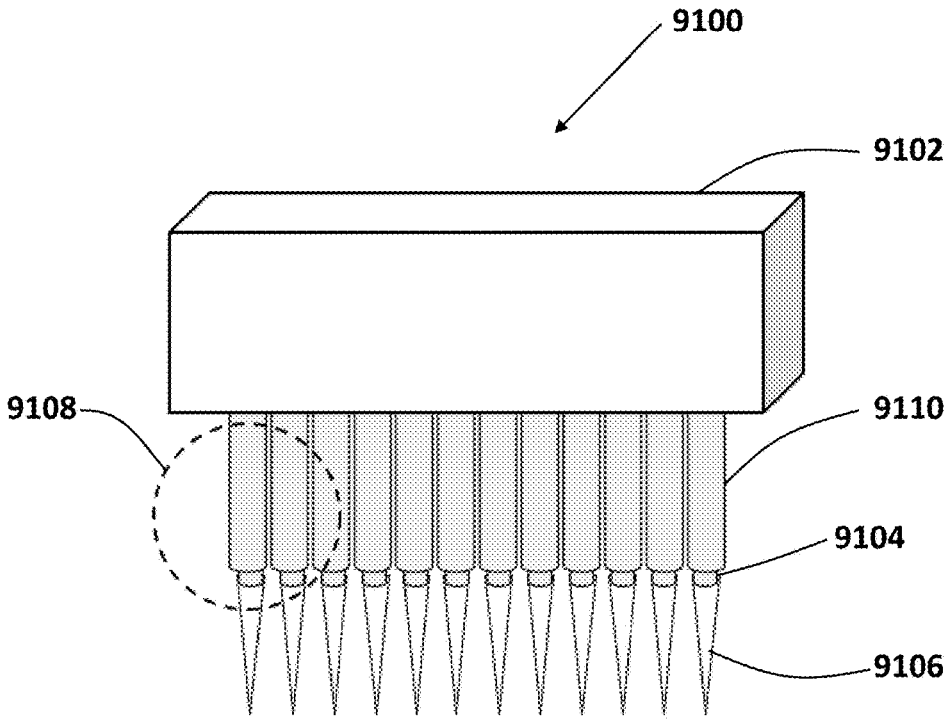
FIG. 91 provides a top down perspective view of a probe head having a 12 liquid handling channel stirring module assembly.

FIG. 91 provides a top down perspective view of a stirring module assembly having 12 liquid handling channels 9100. The stirring module assembly is incorporated into the probe head of a liquid handling system 9102. The stirring module assembly having a vibration transmission interface 9104 for each of the twelve liquid handling channels, each vibration transmission interface 9104 encloses a vibration inducing unit (not shown) and a flexible tube (not shown) that connects the pipetting mechanism in the liquid pipetting assembly to the pipette tip 9106. Each vibration transmission interface 9104 is enclosed by an ejector sleeve 9110 that extends distally from the probe head to the distal end of the vibration transmission interface 9104 without making contact with the proximal end of the pipette tip 9106. When desired the ejector sleeve 9110 is moved distally the necessary distance to eject the pipette tip 9106 from the vibration transmission interface 9104. A further discussion of the stirrer module assembly is directed to the partial view of the stirrer module assembly 9108 in FIG. 92.

Figure 92:
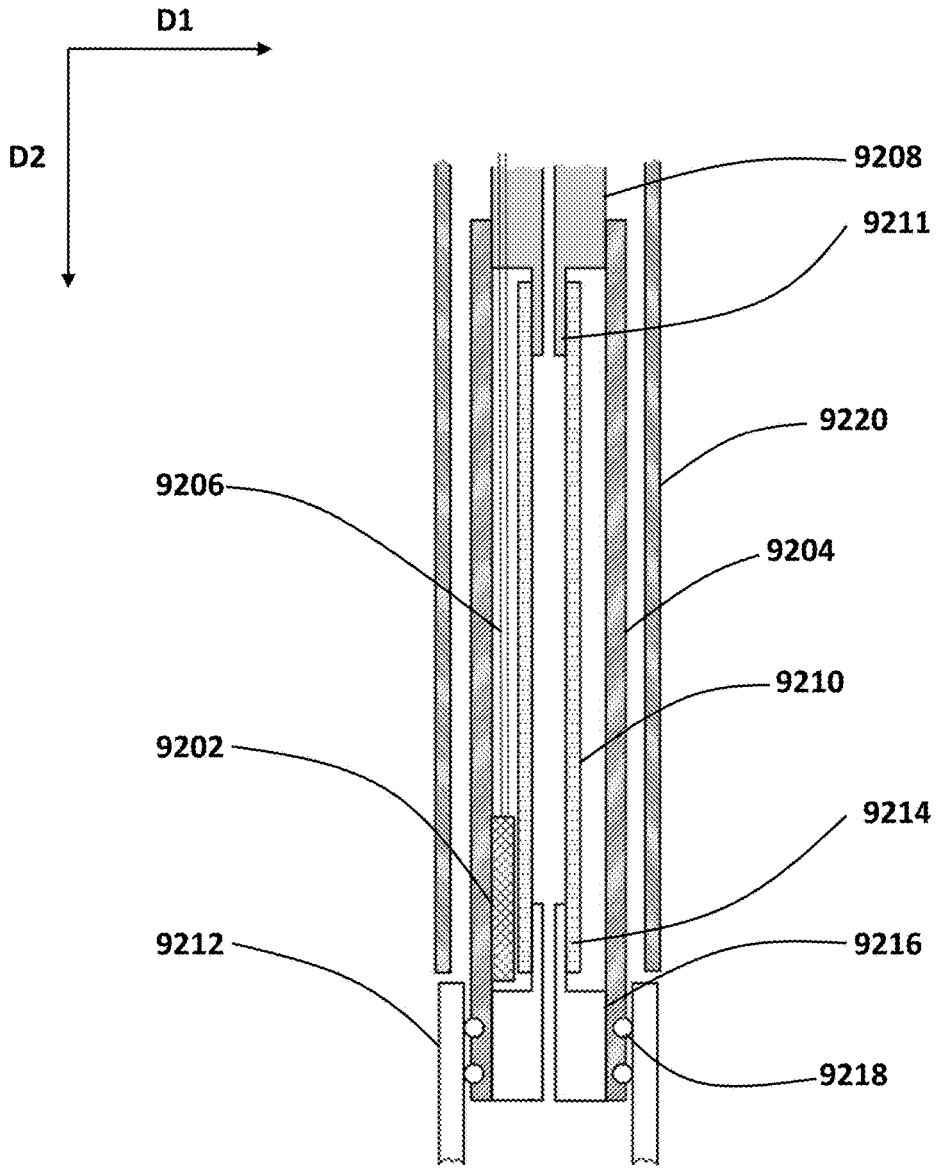
FIG. 92 provides a side view of single liquid handling channel of a stirring module assembly.

FIG. 92 shows a side plan perspective of the partial view 9108 of a stirring module assembly 9100, as referred to in FIG. 91, having a lengthwise or longitudinal dimension extending in the D2 direction and a widthwise dimension extending in the D1 direction. In the present embodiment, a vibration inducing unit 9202 is enclosed and attached to the interior surface of the vibration transmission interface 9204. Wiring 9206 from the liquid handling system controller (not shown) provides the vibration inducing unit 9202 with power. The vibration transmission interface 9204 is attached at its proximal portion to a port 9208 from the pipetting mechanism in the liquid handling system. The vibration transmission interface 9204 extends distally beyond an ejector sleeve 9220. A pipette tip 9212 is detachably attached to the distal portion of the vibration transmission interface 9204. The vibration transmission interface 9204 encloses a flexible tube 9210. The proximal end of the flexible tube 9210 is attached to a distal extension 9211 of the port 9208 from the liquid pipetting mechanism (not shown). The distal end of the flexible tube 9210 is attached to a proximal extension 9214 of a tube end piece 9216. The distal portion of the tube end piece 9216 is attached to the distal portion of the vibration transmission interface 9204. The distal end of the vibration transmission interface 9204 includes two O-rings 9218, which secures the detachably attached pipette tip 9212. Liquid is aspirated into or dispensed from the pipette tip 9212 by the action of the pipetting mechanism in the liquid pipetting assembly. The ejector sleeve 9220 extends from the probe head (not shown) and ejects the pipette tip 9212. The pipette tip 9212 is ejected when the ejector sleeve 9220 is moved in the D2 direction, contacting the proximal end of the pipette tip 9212 and applying force until the pipette tip 9212 is dislodged from the distal portion of the vibration transmission interface 9204. The ejector sleeve 9220 is not in contact with the vibration transmission interface 9204 so that it does not hinder the vibration transmission interface 9204 from transmitting the vibrations from the vibration inducing unit 9202 to the pipette tip 9212. In the present embodiment, liquid is aspirated into, or dispensed from the pipette tip 9212 by the action of the pipetting mechanism in the liquid pipetting assembly. The flexible tube 9210, enclosed within the vibration transmission interface 9204, forms an air tight seal with the distal extension 9211 of the port 9208 and the proximal extension 9214 of the tube end piece 9216 so that the air that originates from the pipetting mechanism is contained within the flexible tube 9210, and is used to aspirate and dispense the liquid from the pipette tip 9212. When the vibration inducing unit 9202 is activated, the vibration is transmitted through the vibration transmission interface 9204 to the pipette tip 9212. As described in FIGS. 12 through 15 and their associated text, this vibration causes a swirling motion to the pipette tips immersed in the solution, which results in the stirring of the solution.

Another embodiment of the present disclosure provides an automated liquid handling system having a stirring module assembly capable of stirring 96 wells of a 96 well microplate simultaneously. The stirring module assembly is comprised of a vibration transmission interface for each of the 96 liquid handling channels, each vibration transmission interface encloses a vibration inducing module and a flexible tube; and an ejector sleeve for each of the 96 liquid handling channels for ejecting the detachably attached pipette tips.

Figure 93:
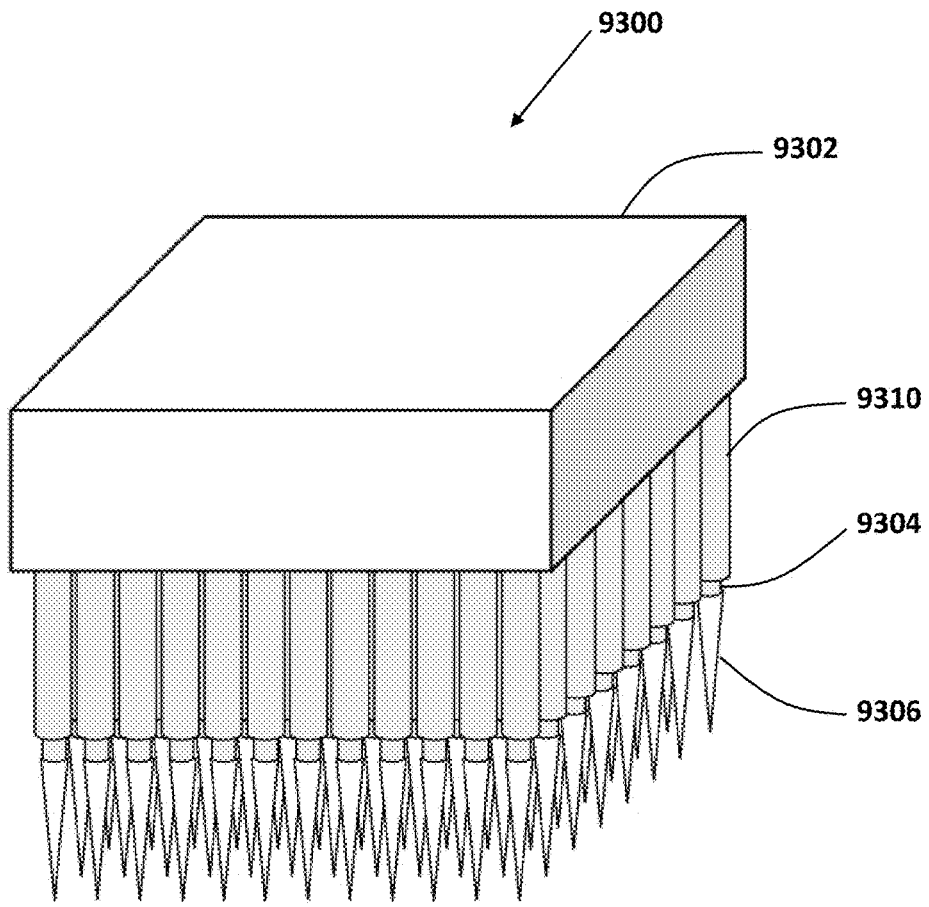
FIG. 93 provides a top down perspective view of a probe head having a 96 liquid handling channel stirring module assembly.

FIG. 93 provides a top down perspective view of a stirring module assembly having 96 liquid handling channels 9300. The stirring module assembly is incorporated into the probe head of a liquid handling system 9302. The stirring module assembly having a vibration transmission interface 9304 for each of the 96 liquid handling channels, each vibration transmission interface 9304 encloses a vibration inducing unit (not shown) and a flexible tube (not shown) that connects the pipetting mechanism in the liquid pipetting assembly to the pipette tip 9306. The vibration transmission interface 9304 is described in FIG. 92 and its associated text. Each vibration transmission interface 9304 is enclosed by an ejector sleeve 9310 that extends distally from the probe head to the distal end of the vibration transmission interface 9304 without making contact with the proximal end of the pipette tip 9306. The ejector sleeve 9310 extends from the probe head 9302 and ejects the pipette tips 9306 when desired by extending until making contact with the proximal end of the pipette tips 9306 and applying force to them until they are dislodged from their vibration transmission interfaces 9304. Activation of the vibration inducing units causes the vibration transmission interfaces 9304 to vibrate. The vibration is transmitted to the pipette tips 9306 attached to the vibration transmission interfaces 9304. As described in FIGS. 12 through 15 and their associated text, the vibration from the vibration inducing units causes a swirling motion to the pipette tips 9306 immersed in the solution, which results in the stirring of the solution.

An aspect of the stirring module assembly provides a vibration transmission interface having a flexible section between the proximal end and distal end of the vibration transmission interface. A vibration inducing unit is mounted distal to the flexible section. Hence, the flexible section affords increased flexibility to the vibration transmission interface, so that the distal end of the vibration transmission interface can vibrate with the vibration inducing unit without being hampered by the mass of the proximal end of the vibration transmission interface, and the apparatus that the proximal end is attached to. Further the flexible section permits the vibration transmission interface to be made from less flexible materials because the increase in flexibility at the distal end derived from the flexible section will provide the needed flexibility for stirring.

Figure 94:
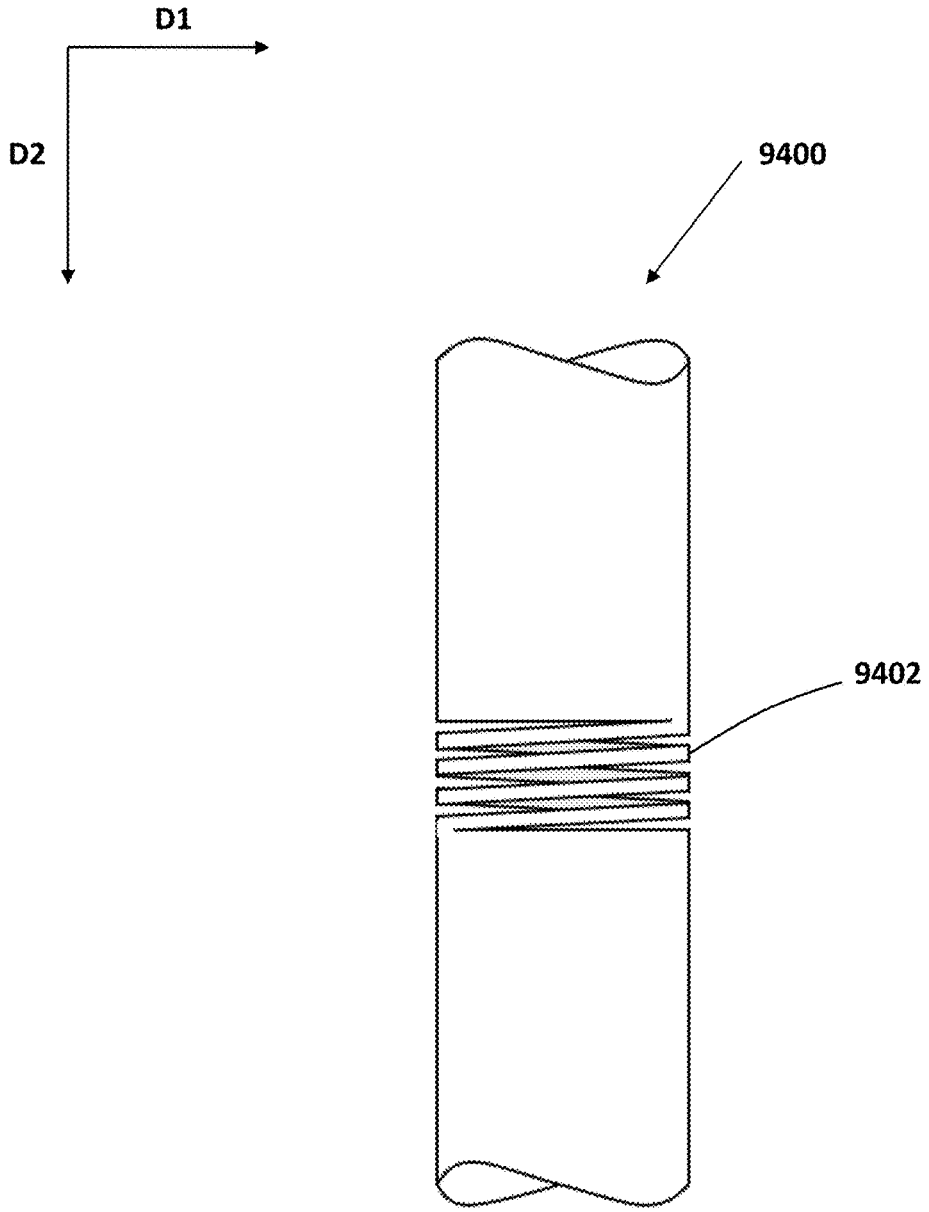
FIG. 94 provides a side view of vibration transmission interface having a flexible section.

FIG. 94 provides a side view of a flexible section of a vibration transmission interface 9400 having a helical space in the wall of the vibration transmission interface 9402 which allows cross sectional compression of the vibration transmission interface thereby facilitating the vibration of the distal end of the vibration transmission interface 9400.

Figure 95:
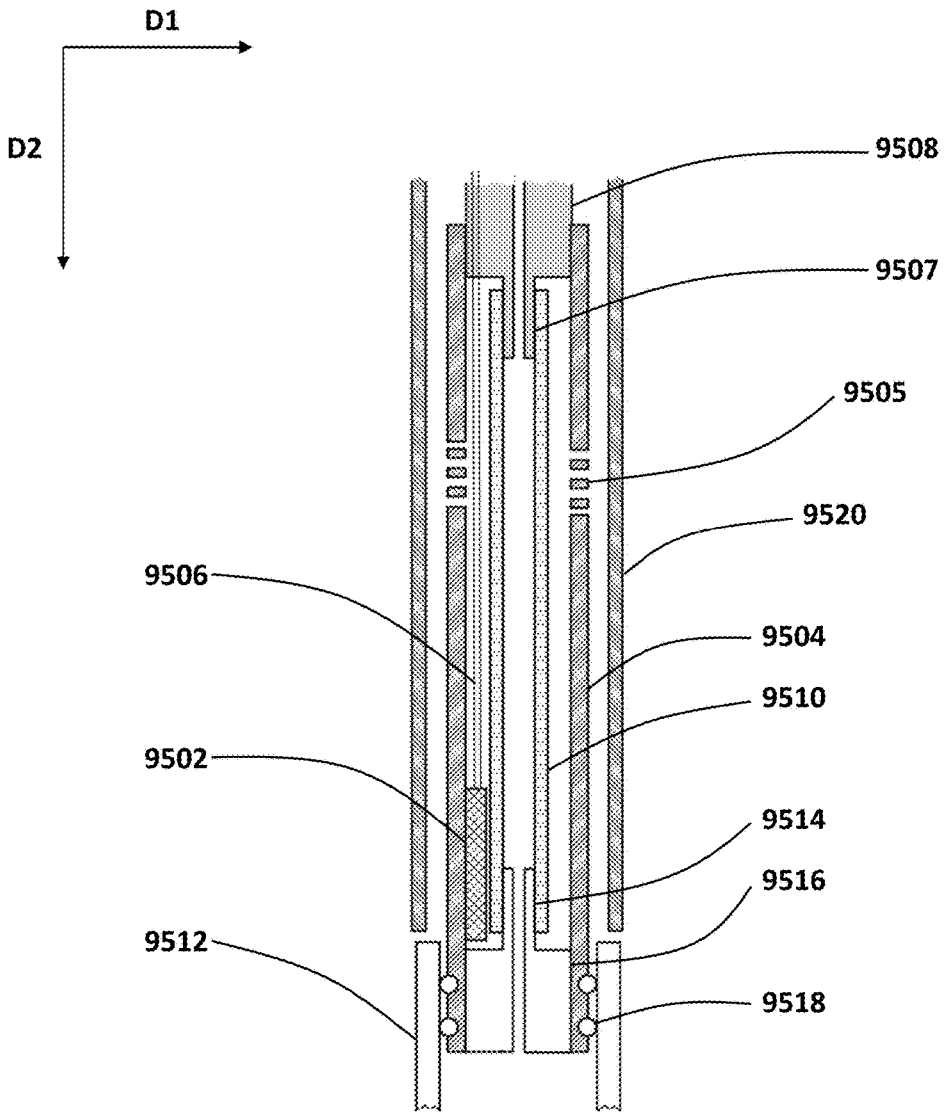
FIG. 95 provides a side view of a single liquid handling channel of a stirring module having a vibration transmission interface with a flexible section.

FIG. 95 shows a side plan perspective of the partial view 9108 of a stirring module assembly 9100, as referred to in FIG. 91, having a lengthwise or longitudinal dimension extending in the D2 direction and a widthwise dimension extending in the D1 direction. In the present embodiment, a vibration inducing unit 9502 is enclosed and attached to the interior surface of a vibration transmission interface 9504. Wiring 9506 from the liquid handling system controller (not shown) provides the vibration inducing unit 9502 with power. The vibration transmission interface 9504 having a flexible section 9505 (graphically represented), which is described in FIG. 94. The vibration transmission interface 9504 is attached at its proximal portion to a port 9508 from the pipetting mechanism in the liquid handling system. The vibration transmission interface 9504 extends distally beyond an ejector sleeve 9520. A pipette tip 9512 is detachably attached to the distal portion of the vibration transmission interface 9504. The vibration transmission interface 9504 encloses a flexible tube 9510. The proximal end of the flexible tube 9510 is attached to a distal extension 9507 of the port 9508 from the liquid pipetting mechanism (not shown). The distal end of the flexible tube 9510 is attached to a proximal extension 9514 of a tube end piece 9516. The distal portion of the tube end piece 9516 is attached to the distal portion of the vibration transmission interface 9504. The distal end of the vibration transmission interface 9504 includes two O-rings 9518, which secures the detachably attached pipette tip 9512. Liquid is aspirated into or dispensed from the pipette tip 9512 by the action of the pipetting mechanism in the liquid pipetting assembly. The ejector sleeve 9520 extends from the probe head (not shown) and ejects the pipette tip 9512. The pipette tip 9512 is ejected when the ejector sleeve 9520 is moved in the D2 direction, contacting the proximal end of the pipette tip 9512 and applying force until the pipette tip 9512 is dislodged from the distal portion of the vibration transmission interface 9504. The ejector sleeve 9520 is not in contact with the vibration transmission interface 9504 so that it does not hinder the vibration transmission interface 9504 from transmitting the vibrations from the vibration inducing unit 9502 to the pipette tip 9512. In the present embodiment, liquid is aspirated into, or dispensed from the pipette tip 9512 by the action of the pipetting mechanism in the liquid pipetting assembly. The flexible tube 9510, enclosed within the vibration transmission interface 9504, forms an air tight seal with the distal extension 9507 of the port 9508 and the proximal extension 9514 of the tube end piece 9516 so that the air that originates from the pipetting mechanism is contained within the flexible tube 9510, and is used to aspirate and dispense the liquid from the pipette tip 9508. When the vibration inducing unit 9502 is activated, the vibration is transmitted through the vibration transmission interface 9504 to the pipette tip 9512. As described in FIGS. 12 through 15 and their associated text, this vibration causes a swirling motion to the pipette tips immersed in the solution, which results in the stirring of the solution.

An embodiment of the present disclosure provides a hand held pipette for aspirating and dispensing liquids including, a hand held portion having a plunger, piston and spring assembly for aspirating and dispensing liquids; an ejector assembly for ejecting pipette tips; and a stirring device assembly, including a vibration inducing unit, a power source for the vibration inducing unit, and a control for the vibration inducing unit.

An aspect of the present embodiment provides a hand held pipette where the stirring device includes at least one vibration transmission interface.

Another aspect of the present embodiment provides a hand held pipette where the stirring device includes one vibration transmission interface.

Another aspect of the present embodiment provides a hand held pipette where the stirring device includes a plurality of vibration transmission interfaces.

Another aspect of the present embodiment provides a hand held pipette where the vibration inducing unit produces vibrations in a range of about 10 vibrations per second to about 250 vibrations per second.

Another aspect of the present embodiment provides a hand held pipette where the stirring device has 8 vibration transmission interfaces.

Another aspect of the present embodiment provides a hand held pipette where the stirring device has 12 vibration transmission interfaces.

Another aspect of the present embodiment provides a hand held pipette where the stirring device includes a flexible joint.

An embodiment of the present disclosure provides a microplate mixing apparatus for stirring and/or mixing the contents of a microplate having a first plurality of wells comprising: an orbital plate module having a case with a proximal end and a distal end forming an internal space, a vibration inducing unit enclosed within the internal space of the case, the case attached at the distal end to a plate, the plate affixed orthogonally to the case with a second plurality of engaging spikes; a pin probe module, the pin probe module having a third plurality of engaging recesses for receiving the second plurality of engaging spikes, and a fourth plurality of pin probes extending orthogonally from the pin probe module, wherein each pin probe is aligned with an individual well of the microplate, and a fifth plurality of pillars extending orthogonally from the pin probe module where the pillars are longer than the pin probes; and a base plate for receiving the microplate having a sixth plurality of pillar recesses for receiving the fifth plurality of pillars. As used herein the term "base plate" refers to a component of the microplate mixing apparatus of the present disclosure. The base plate holds or in other words receives the microplate used in the mixing process. The base plate typically has a flat surface upon which to receive the microplate, optionally the base plate may have alignment grooves, alignment fixtures, a light temporary adhesive or non-slip padding or any combination herein, to ensure that the microplate is aligned with the other components of the microplate mixing apparatus. The non-slip pad is typically made of dimpled silicone elastomer; the material has an extremely high coefficient of friction, which prevents devices from sliding around on dry surfaces, Non-slip pads are available commercially from suppliers such as Flexible Innovations, Ltd. 1120 S. Freeway, Ste 132 Fort Worth, Tex. 76104, USA http://geckostrips.com/geckostrips/non-slip-technology; HandStands Corporation, 102 West 12200, South Draper, Utah 84020, USA http://www.handstands.com/stickypadproducts.php; Duraco Express, 7400 W. Industrial Drive, Forest Park, Ill. 60130, USA http://www.duracoexpress.com/NoSkid-Foam-Tape; and VEX Robotics, Inc. 1519 Interstate 30 West Greenville, Tex. 75402, USA http://www.vexrobotics.com/mat-g.html.

An aspect of the present embodiment provides a microplate mixing apparatus further comprising a control module, where the control module controls the amount of power provided to the vibration inducing unit.

An aspect of the present embodiment provides a microplate mixing apparatus where the control module is a microprocessor enabled device.

An aspect of the present embodiment provides a microplate mixing apparatus where the first plurality of wells for the microplate is ninety-six (96); and the fourth plurality of pin probes is ninety-six (96).

An aspect of the present embodiment provides a microplate mixing apparatus where the first plurality of wells for the microplate is three hundred and eighty four (384); and the fourth plurality of pin probes is three hundred and eighty four (384).

Yet another aspect of the present embodiment provides a microplate mixing apparatus where the first plurality of wells for the microplate is one thousand five hundred thirty-six (1536); and the fourth plurality of pin probes is one thousand five hundred thirty-six (1536).

An embodiment of the present disclosure provides a microplate mixing apparatus for stirring and/or mixing the contents of a microplate having a first plurality of wells, comprising: the microplate mixing apparatus having an orbital plate module in detachable contact with a pin probe module, and the pin probe module in detachable contact with a base plate; the orbital plate module having a case with a proximal end and a distal end forming an internal space, a vibration inducing unit enclosed within the internal space of the case, the case attached at the distal end to a plate, the plate affixed orthogonally to the case with a second plurality of engaging spikes; the pin probe module having a third plurality of engaging recesses for receiving the second plurality of engaging spikes, and a fourth plurality of pin probes extending orthogonally from the pin probe module, wherein each pin probe is aligned with each individual well of the microplate having a first plurality of wells, and a fifth plurality of pillars extending orthogonally from the pin probe module where the pillars are longer than the pin probes; and the base plate for receiving the microplate having a sixth plurality of pillar recesses for receiving the fifth plurality of pillars.

An embodiment of the present disclosure provides a microplate mixing apparatus for stirring and/or mixing the contents of a microplate having a first plurality of wells comprising: an orbital plate module having a case with a proximal end and a distal end forming an internal space, a vibration inducing unit enclosed within the internal space of the case, the case attached at the distal end to a plate, the plate affixed orthogonally to the case having a second plurality of pin probes extending orthogonally from the orbital plate module, wherein each pin probe is aligned with an individual well of the microplate, and a third plurality of pillars extending orthogonally from the plate where the pillars are longer than the pin probes; and a base plate for receiving the microplate having a fourth plurality of pillar recesses for receiving the third plurality of pillars.

An embodiment of the present disclosure provides a microplate mixing apparatus for stirring and/or mixing the contents of a microplate having a first plurality of wells comprising: the microplate mixing apparatus having an orbital plate module in detachable contact with a base plate; the orbital plate module having a case with a proximal end and a distal end forming an internal space, a vibration inducing unit enclosed within the internal space of the case, the case attached at the distal end to a plate, the plate affixed orthogonally to the case having a second plurality of pin probes extending orthogonally from the orbital plate module, wherein each pin probe is aligned with an individual well of the microplate, and a third plurality of pillars extending orthogonally from the plate where the pillars are longer than the pin probes; and the base plate for receiving the microplate having a fourth plurality of pillar recesses for receiving the third plurality of pillars.

Figure 6:
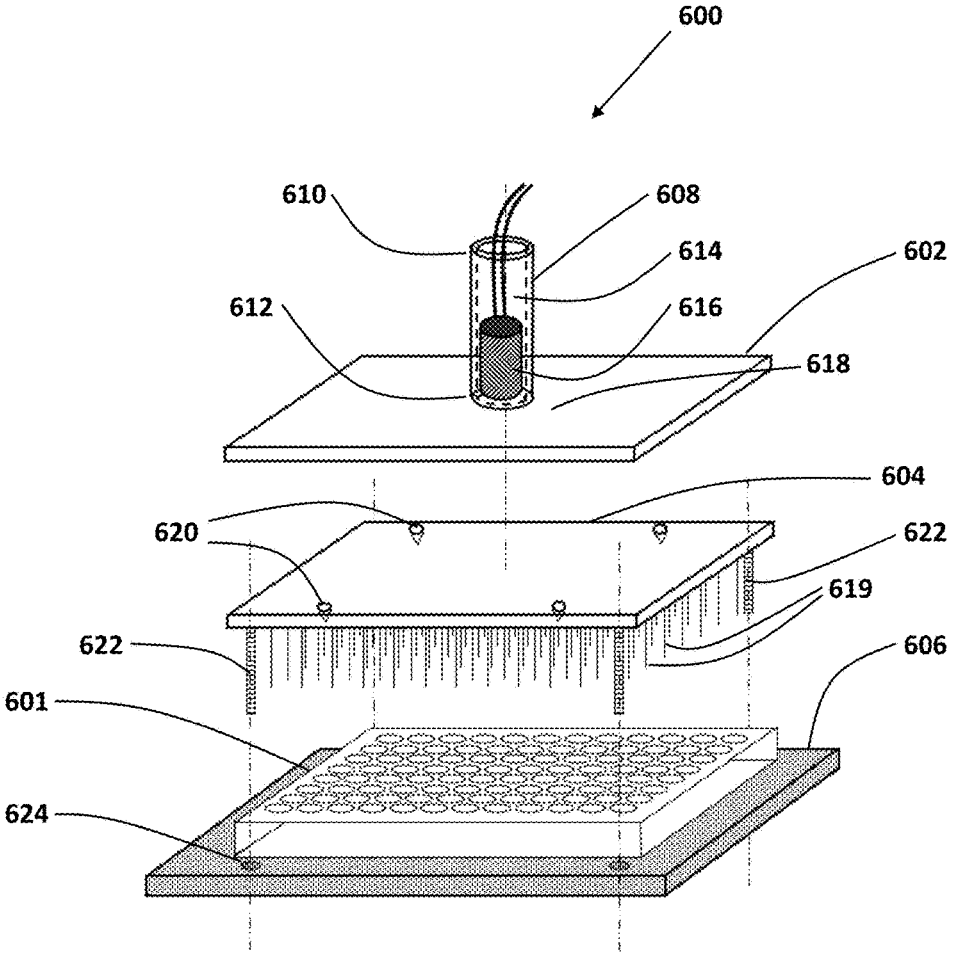
FIG. 6 provides a top down perspective view of a microplate mixing apparatus of the present disclosure.

FIG. 6 shows a top cross section perspective view of a microplate mixing apparatus 600 for mixing and/or stirring the contents of a microplate 601 having an orbital plate module 602, a pin probe module 604 and a base plate 606. The orbital plate module 602 has a case 608 with a proximal end 610 and a distal end 612 forming an internal space 614 which encloses a vibration inducing unit 616 which is attached to a power source (not shown) and a control module (not shown). The case 608 is attached at its distal end 612 to a plate 618 where the plate is affixed orthogonally to the case. The plate 618 has a set of four engaging spikes (not shown) on the side opposite to the side of the plate that the case 608 is affixed. The plate 618 and the pin module 604 are detachably affixed. As used herein, the term "detachably affixed" means that two modules, parts, components or units may be attached so that they may be manipulated as a single unit. However when desired by the user, the two parts can be detached to obtain the original undetached modules, parts, components or units. The pin probe module has 96 pin probes 619 arranged in an 8 by 12 matrix pattern that corresponds to the arrangement of the 96 wells of the microplate 601. The pin probe module 604 has a set of four engaging recesses 620 that the engaging spikes fit into to ensure that the orbital plate module 602 and the pin probe module 604 are engaged and to maintain the alignment when attached. The pin probe module 604 also has four pillars 622 which are used to align the pin probe module to the base plate 606. The base plate 606 receives the microplate 601. The base plate may optionally have alignment grooves or alignment fixtures to ensure that the microplate 601 is aligned with the pin probe module 604. The base plate has four pillar recesses 624 that receive the corresponding pillars 622.

Figure 7:
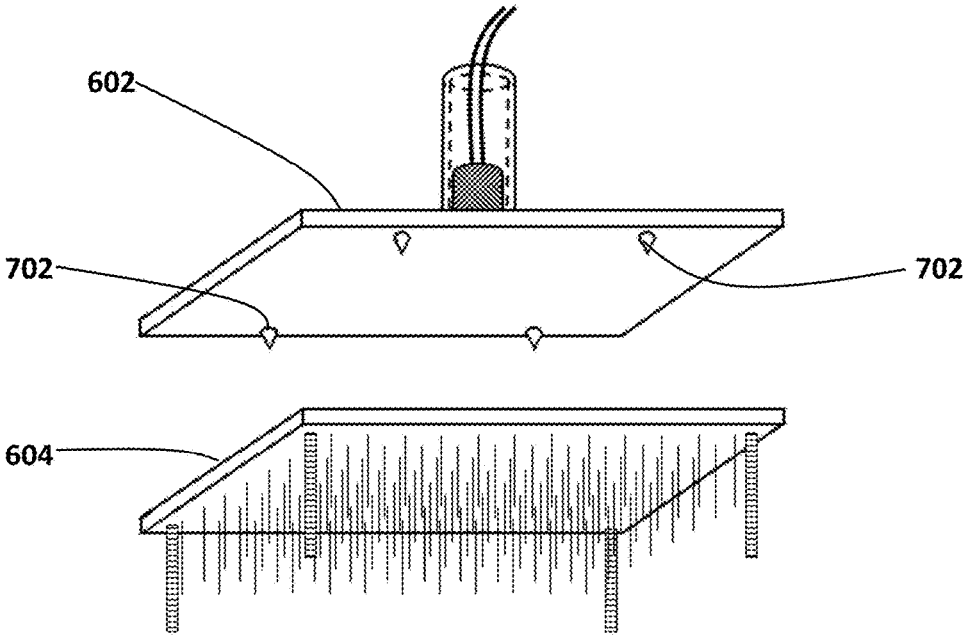
FIG. 7 provides a bottom up perspective view of a microplate mixing apparatus of the present disclosure.

FIG. 7 shows a bottom up perspective view of the orbital plate module 602 and the pin probe module 604. The microplate 601 and base plate 606 are not shown. As described previously, the orbital plate module has four engaging spikes 702 that are received by the corresponding four engaging recesses 620 (not shown) located on the top side of the pin probe module 604.

Figure 8:
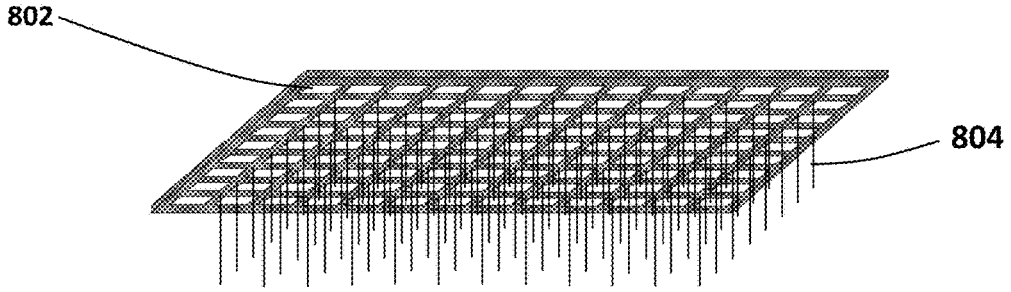
FIG. 8 provides a bottom up perspective view of a lattice pin probe module component of a microplate mixing apparatus of the present disclosure.

FIG. 8 shows a bottom up perspective view of an alternate embodiment of a pin probe module having a lattice plate. The present lattice plate can be used in place of pin probe module. The lattice plate having 96 pin probes 802 extending distally from lattice plate arranged in a 8×12 matrix pattern corresponding to the wells of a 96 well microplate. The body of the lattice plate includes 96 openings 804 in the body also arranged in a 8×12 matrix pattern corresponding to the wells of a 96 well microplate.

Figure 9:
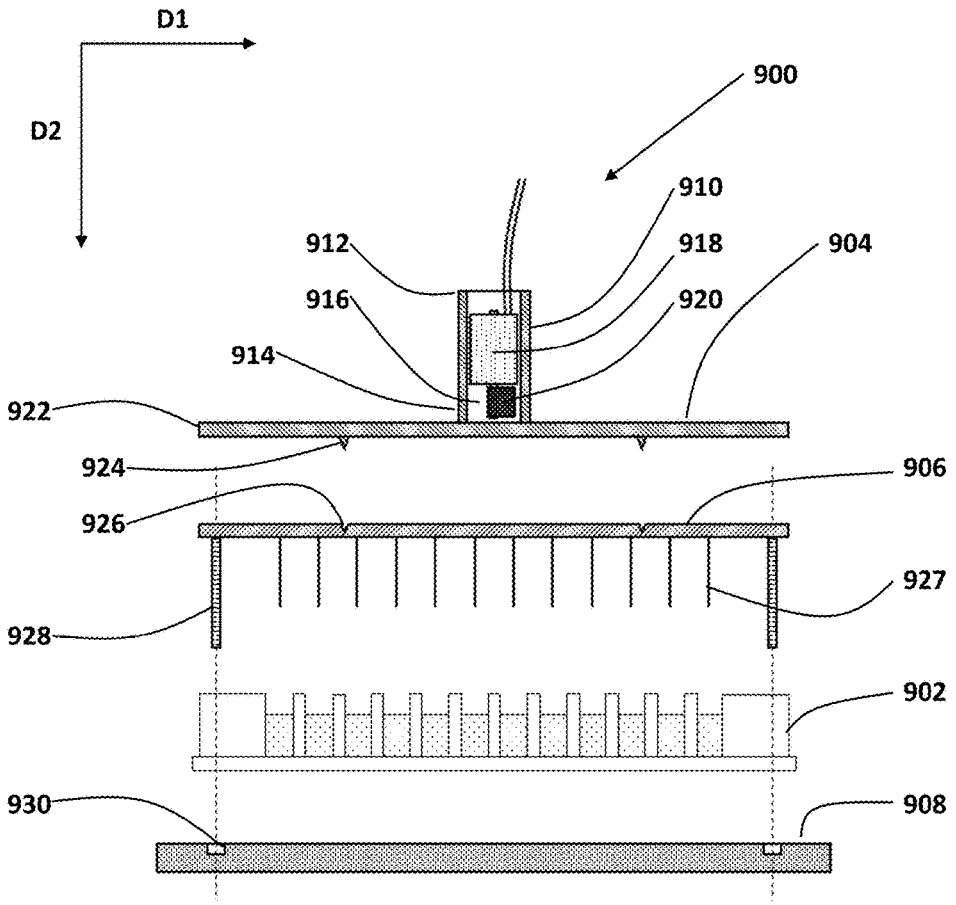
FIG. 9 provides a side perspective of a microplate mixing apparatus of the present disclosure.

FIG. 9 provides a cross section view of a microplate mixing apparatus 900 for mixing and/or stirring the contents of a microplate 902 having an orbital plate module 904, a pin probe module 906 and a base plate 908. The orbital plate module 904 has a case 910 with a proximal end 912 and a distal end 914 forming an internal space 916 which encloses a vibration inducing unit 918 which is attached to a power source (not shown) and a control module (not shown). The vibration inducing unit 918 utilizes a rotating eccentric mass 920, such that, when rotated the off centered mass provides an orbital motion. The case 910 is attached at its distal end 914 to a plate 922 where the plate is affixed orthogonally to the case in the D2 direction. The plate 922 has a set of four engaging spikes 924 on the side opposite to the side of the plate 922 that the case 910 is affixed. The plate 922 and the pin module 906 are detachably affixed. As used herein, the term "detachably affixed" or "detachably attached" means that two modules, parts, components or units may be attached so that they may be manipulated and function as a single unit. However when desired by the user, the two parts can be detached to obtain the original undetached modules, parts, components or units. The pin probe module 906 has 96 pin probes arranged in an 8 by 12 matrix pattern that corresponds to the arrangement of the 96 wells of the microplate 902. From the perspective of this FIG. 9 only the front most row of 12 wells are shown. The pin probe module 906 has a set of four engaging recesses 926 that the engaging spikes 924 fit into to ensure that the orbital plate module 904 and the pin probe module 906 are engaged and to maintain the alignment when attached. The pin probe module 906 also has four pillars 928 which are used to align the pin probe module to the base plate 908. The base plate 908 receives the microplate 902. The base plate 908 may optionally have alignment grooves or alignment fixtures to ensure that the microplate 902 is aligned with the pin probe module 906. The base plate has four pillar recesses 930 that receive the corresponding pillars 928.

Figure 10:
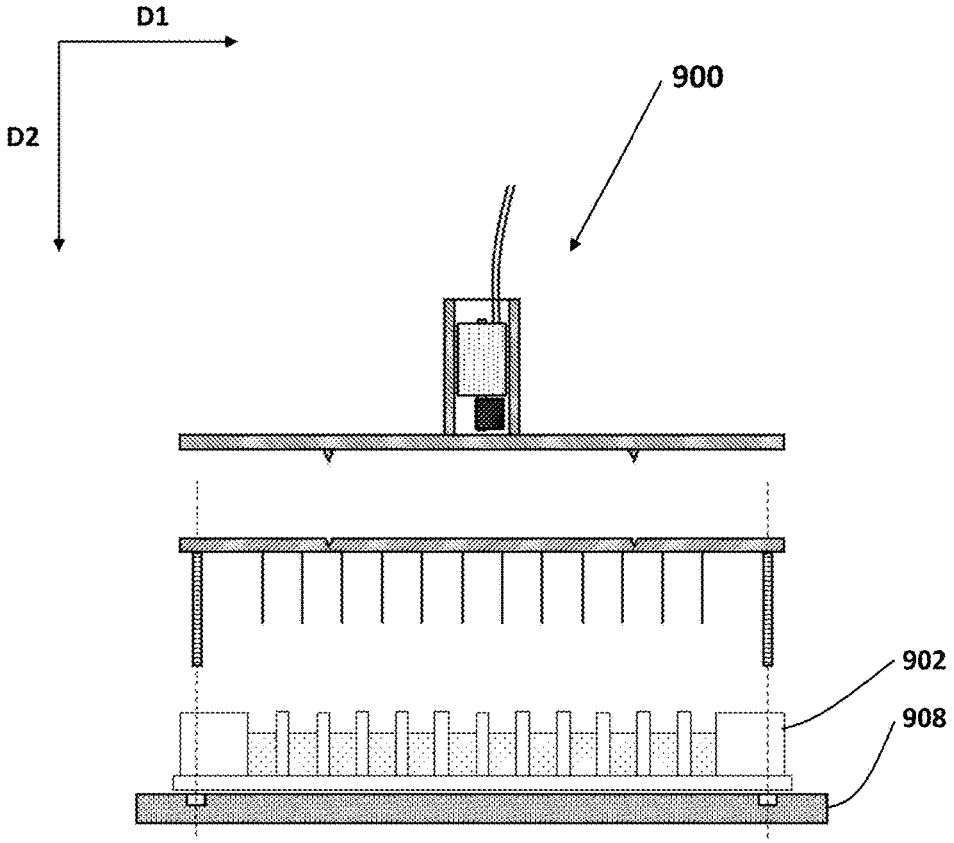
FIG. 10 provides a side perspective of a partially configured microplate mixing apparatus of the present disclosure.

FIG. 10 provides a cross section view of the microplate mixing apparatus 900 where the microplate 902 is seated on the base plate 908.

Figure 11:
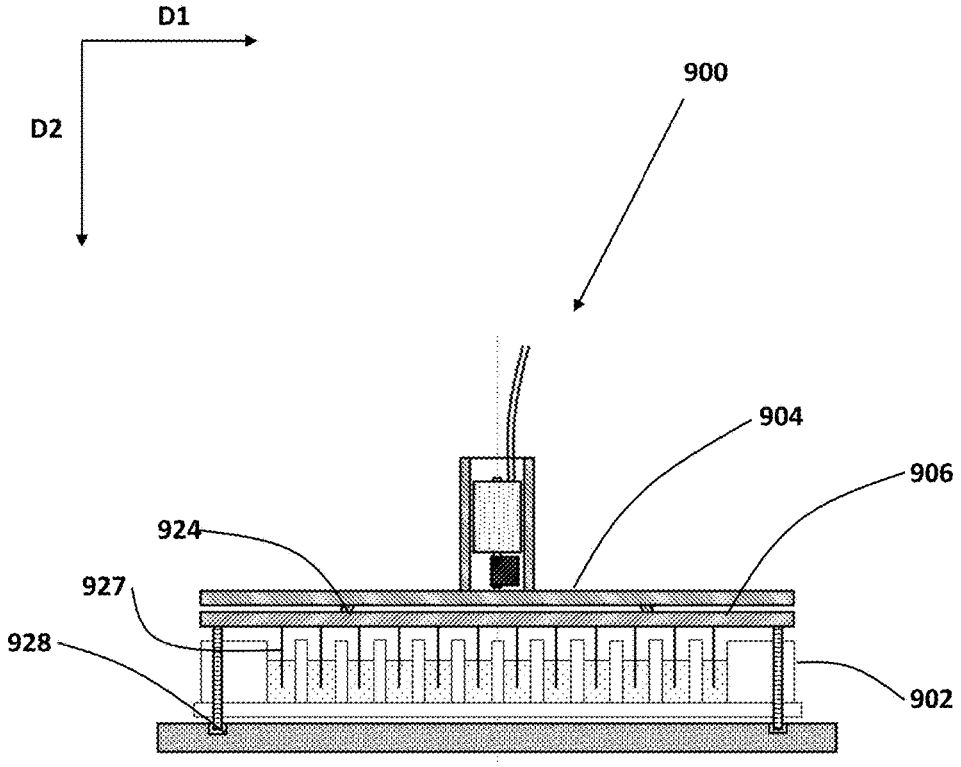
FIG. 11 provides a side perspective of a fully configured microplate mixing apparatus of the present disclosure.

FIG. 11 provides a cross section view of the microplate mixing apparatus 900 where orbital plate module 904 and the pin probe module 906 are attached. The engaging spikes 924 are shown received by the engaging recesses 926. The pillars 928 are shown received by the pillar recesses 930. The pin probes 927 of the pin probe module 906 are shown positioned within the wells of the microplate 902 in contact with the materials in the wells for the stirring and/or mixing process. Upon completion of the stirring process, the attached orbital plate module 904 and the pin probe module 906 are moved along the D2 direction so that the pin probes 927 are no longer in contact with the materials in the well and are clear of the microplate 902.

Another embodiment of the present disclosure provides a microplate mixing apparatus for stirring and/or mixing the contents of a microplate having a first plurality of wells and a second plurality of microplate notches, comprising: an orbital plate module in detachable contact with a pin probe module, and the pin probe module in detachable contact with the microplate, and a base plate; the orbital plate module having a case with a proximal end and a distal end forming an internal space, a vibration inducing unit enclosed within the internal space of the case, the case attached at the distal end orthogonally to the proximal side of the orbital plate module, the orbital plate module having a third plurality of orbital plate engaging spikes extending from the distal side; the pin probe module having a fourth plurality of engaging recesses on the proximal side for receiving the third plurality of orbital plate engaging spikes, and a fifth plurality of pin probes on the distal side extending orthogonally from the pin probe module, where the number of fifth plurality pin probes and the first plurality of microplate wells are the same, and each pin probe is aligned with each individual well of the microplate, and a sixth plurality of pin probe module alignment spikes extending orthogonally from the distal side of the pin probe module that align with the second plurality of microplate notches; and a base plate for receiving the microplate.

Figure 32:
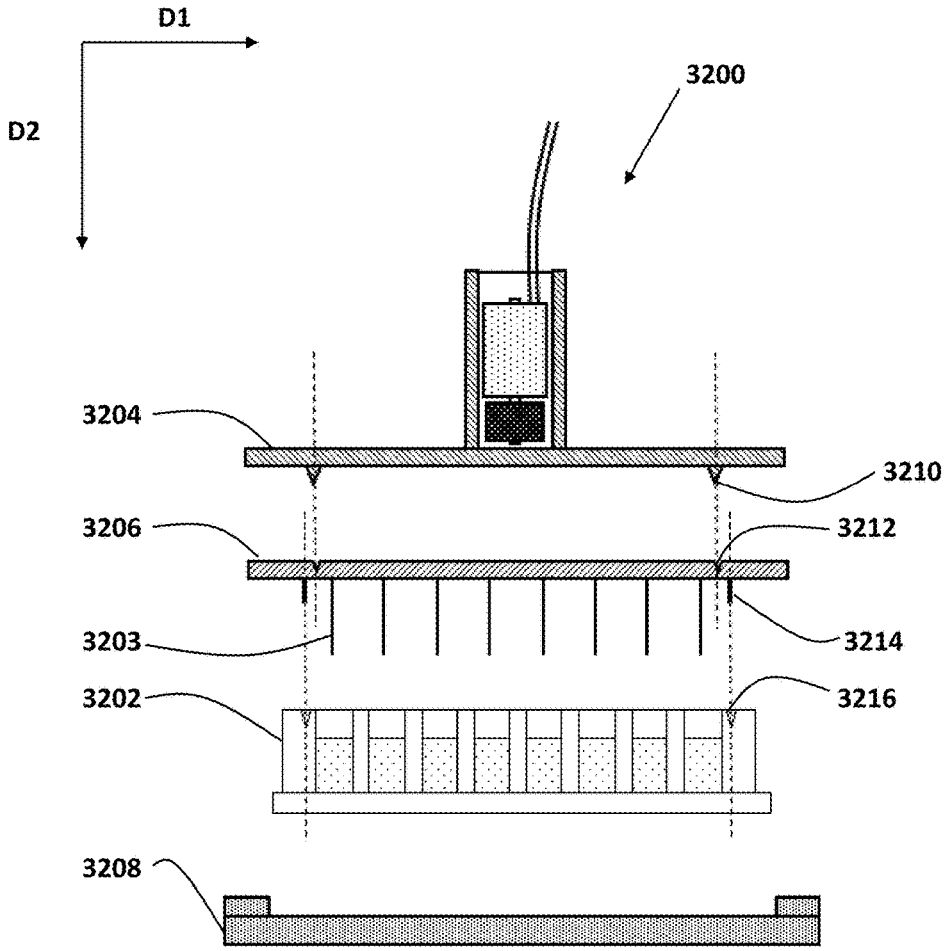
FIG. 32 provides a side perspective view along the 8 well dimension of a 8 by 12 microplate mixing apparatus.

FIG. 32 provides a cross section view of a microplate mixing apparatus of the present embodiment. The microplate mixing apparatus 3200 for mixing and/or stirring the contents of a microplate 3202 having an orbital plate module 3204, a pin probe module 3206 and a base plate 3208. The orbital plate module 3204 has been previously taught in FIG. 9 and its associated disclosure. The orbital plate module 3204 has a set of engaging spikes 3210 located on the distal side of the orbital plate module. The pin probe module 3206 has four of engaging recesses 3212 located on the proximal surface. The engaging recesses 3212 align with and receive the engaging spikes 3210. The orbital plate module 3204 and the pin probe module 3206 are detachably affixed. As used herein, the term "detachably affixed" or "detachably attached" means that two modules, parts, components or units may be attached so that they may be manipulated and function as a single unit. However when desired by the user, the two parts can be detached to obtain the original undetached modules, parts, components or units. The pin probe module 3206 has 96 pin probes arranged in an 8 by 12 matrix pattern that corresponds to the arrangement of the 96 wells of the microplate 3202. From the perspective of FIG. 32, only the front row of 8 pins 3203 is shown. The four engaging recesses 3212 that receive the engaging spikes 3210 ensure that the orbital plate module 3204 and the pin probe module 3206 are engaged when attached. Similarly the pin probe module 3206 has alignment spikes 3214 extending orthogonally from the pin probe module. The microplate 3202 has a set of microplate notches 3216 which receive the alignment spikes 3214 to align the pin probe module 3206 to the microplate 3202. The alignment spikes 3214 are of equal length and have sufficient vertical strength to support the weight of the pin probe module 3206 or the pin probe module 3206 and the orbital plate module 3204, together. The alignment spikes 3214 also have sufficient yield strength such that they can sustain the continuous orbital movement of the pin probe module 3206. The yield strength of the alignment spikes 3214 can be decreased by making them thinner. The decrease in yield strength in the alignment spikes 3214 will result in greater orbital movement. The alignment spikes 3214 are sufficiently long such that the pin probe module 3206 can orbit above the microplate 3202 without touching the microplate. The alignment spikes 3214 can be made from materials such as, high carbon steel (for example, piano wire and spring steel), or polymer materials, such as nylon, polystyrene, polypropylene, PEEK or acetal. The base plate 3208 receives the microplate 3202. The base plate 3208 may optionally have alignment grooves or alignment fixtures to ensure that the microplate 3202 is properly seating on the base plate 3208.

Figure 33:
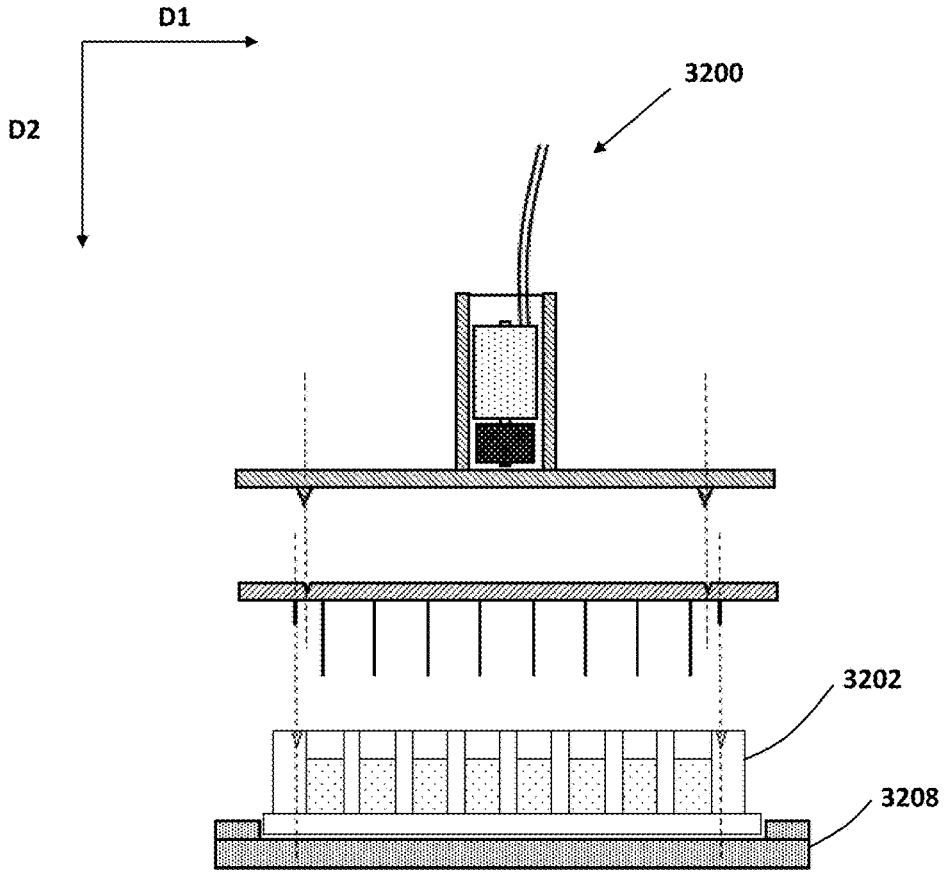
FIG. 33 provides a side perspective view along the 8 well dimension of a partially configured 8 by 12 microplate mixing apparatus.

FIG. 33 provides a cross section view of the microplate mixing apparatus 3200 where the microplate 3202 is seated on the base plate 3208.

Figure 34:
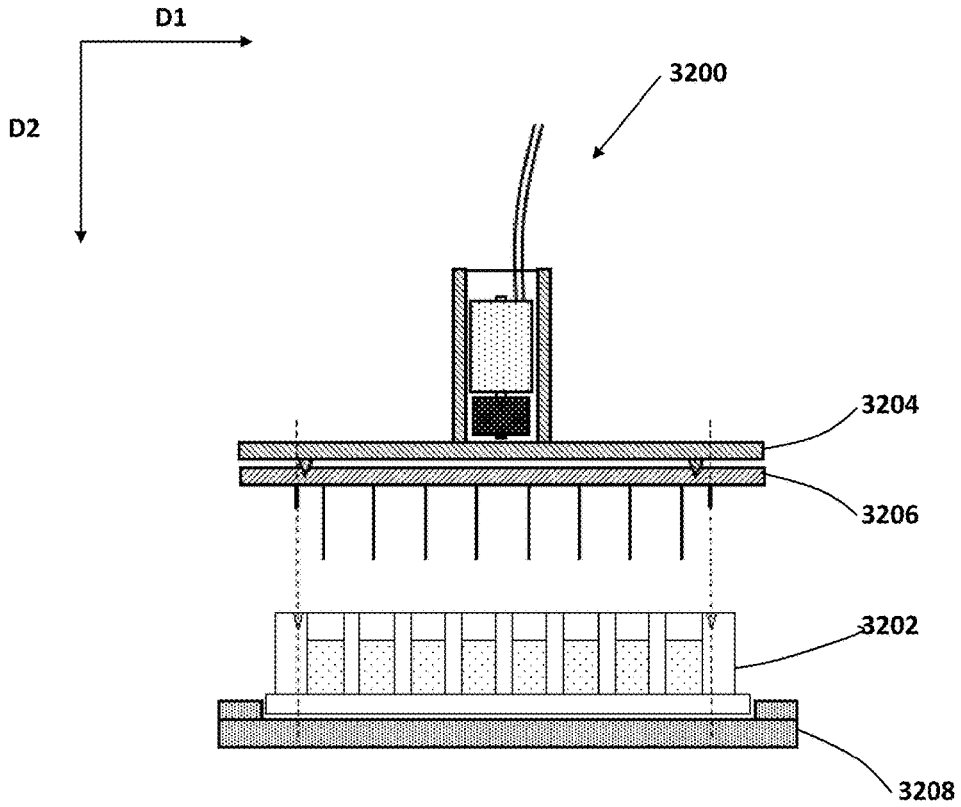
FIG. 34 provides a side perspective view along the 8 well dimension of a partially configured 8 by 12 microplate mixing apparatus.

FIG. 34 provides a cross section view of the microplate mixing apparatus 3200 where the microplate 3202 is seated on the base plate 3208, and the orbital plate module 3204 is detachably attached to the pin probe module 3206.

Figure 35:
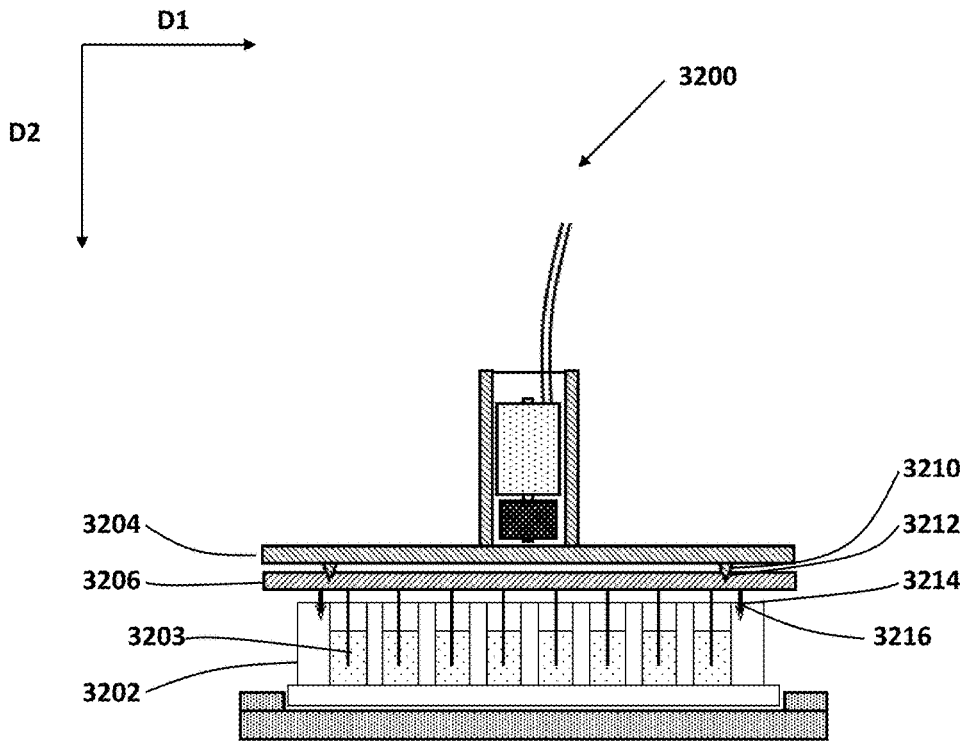
FIG. 35 provides a side perspective view along the 8 well dimension of a fully configured 8 by 12 microplate mixing apparatus.

FIG. 35 provides a cross section view of the microplate mixing apparatus 3200 where orbital plate module 3204 and the pin probe module 3206 are detachably attached. The engaging spikes 3210 are shown received by the engaging recesses 3212. The pin probe alignment spikes 3214 are shown received by the microplate notches 3216. The pin probes 3203 of the pin probe module 3206 are shown positioned within the wells of the microplate 3202 in contact with the materials in the wells for the stirring and/or mixing process. Upon completion of the stirring process, the attached orbital plate module 3204 and the pin probe module 3206 are moved along the D2 direction so that the pin probes 3203 are no longer in contact with the materials in the well and are clear of the microplate 3202. The pin probe module, after being used for stirring or mixing, may be disposed or washed and reused. Each pin probe on the pin probe module upon removal from the well carries a small volume of liquid or solution from the well. The liquid on the pin probe may be transferred to another well and used for other analyses or experiments. The liquid may also be blotted onto a sheet of medium such as nitrocellulose and polyvinylidene difluoride (PVDF) for experiments such as immuno-blotting and nucleic acid hybridization.

Figure 36:
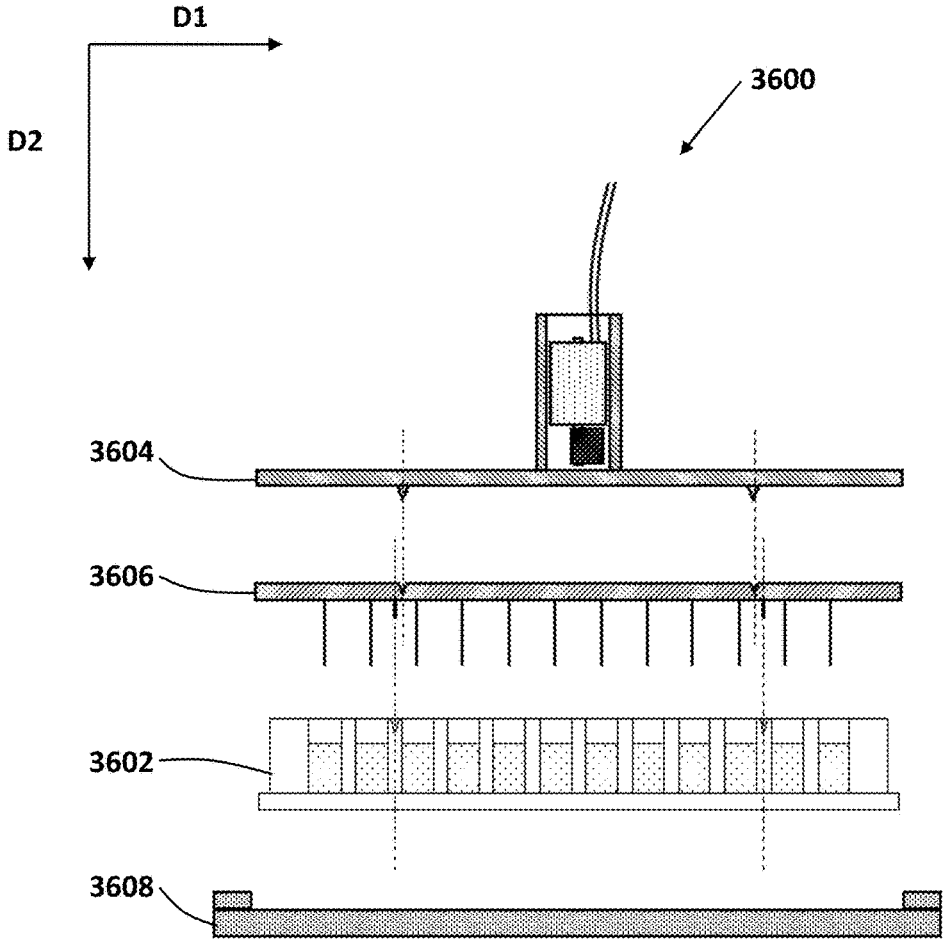
FIG. 36 provides a side perspective view along the 12 well dimension of a 8 by 12 microplate mixing apparatus.

Another embodiment of the present invention provides a microplate mixing apparatus 3600 for stirring and/or mixing the contents of a microplate 3602 (as shown in FIG. 36) having an orbital plate module 3604, a pin probe module 3606 and a base plate 3608. The present embodiment is taught in FIG. 32 and its associated disclosure, where the present components microplate 3602, orbital plate module 3604, pin probe module 3606, and base plate 3608 correspond to microplate 3202, orbital plate module 3204, pin probe module 3206, and base plate 3208, respectively. The present embodiment is configured to accept the microplate 3602 along the 12-well dimension in the D1 direction.

Figure 37:
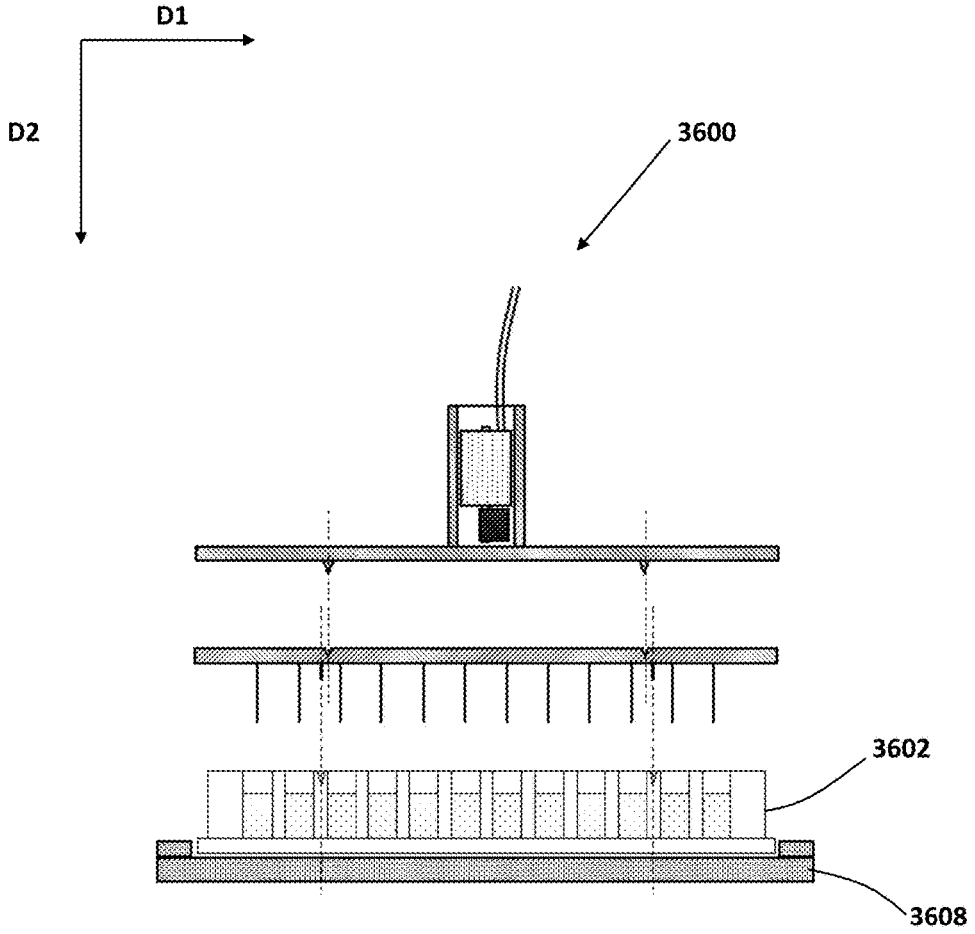
FIG. 37 provides a side perspective view along the 12 well dimension of a partially configured 8 by 12 microplate mixing apparatus.

FIG. 37 provides a cross section view of the microplate mixing apparatus 3600 where the microplate 3602 is seated on the base plate 3608.

Figure 38:
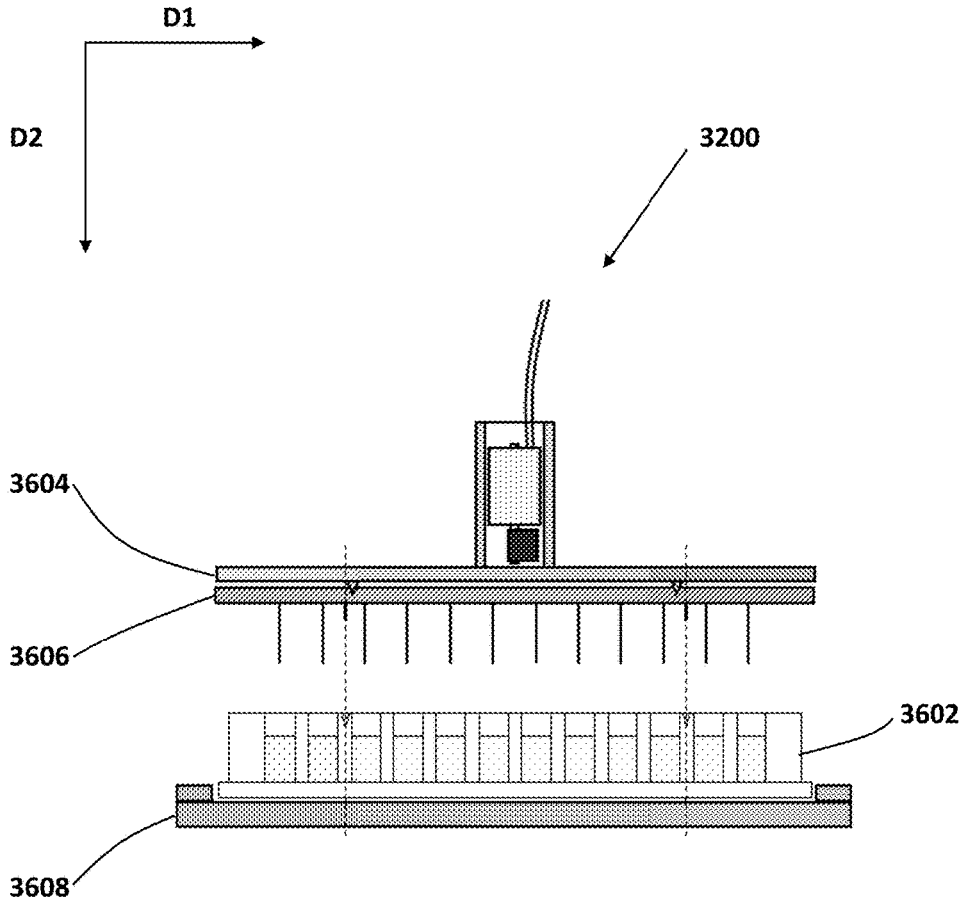
FIG. 38 provides a side perspective view along the 12 well dimension of a partially configured 8 by 12 microplate mixing apparatus.

FIG. 38 provides a cross section view of the microplate mixing apparatus 3600 where the microplate 3602 is seated on the base plate 3608, and the orbital module plate 3604 is detachably attached to the pin probe module 3606.

Figure 39:
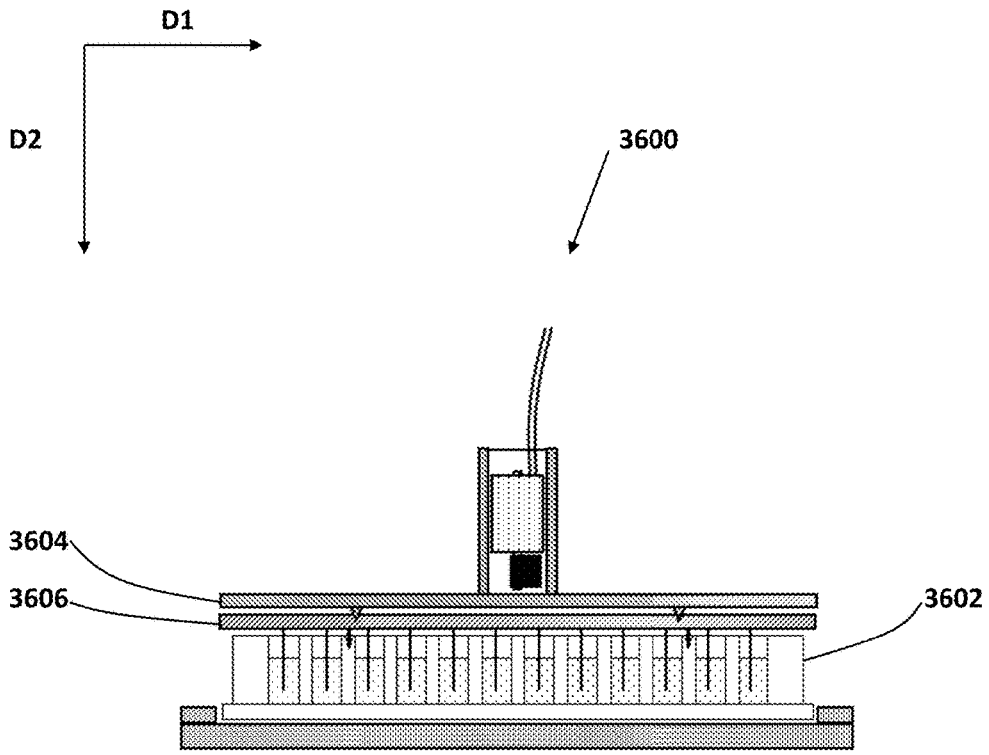
FIG. 39 provides a side perspective view along the 12 well dimension of a fully configured 8 by 12 microplate mixing apparatus.

FIG. 39 provides a cross section view of the microplate mixing apparatus 3600 where orbital plate module 3604 and the pin probe module 3606 are detachably attached. The pin probes of the pin probe module 3606 are shown positioned within the wells of the microplate 3602 in contact with the materials in the wells for the stirring and/or mixing process. Upon completion of the stirring process, the attached orbital plate module 3604 and the pin probe module 3606 are moved along the D2 direction so that the pin probes are no longer in contact with the materials in the well and are clear of the microplate 3602.

Figure 40:
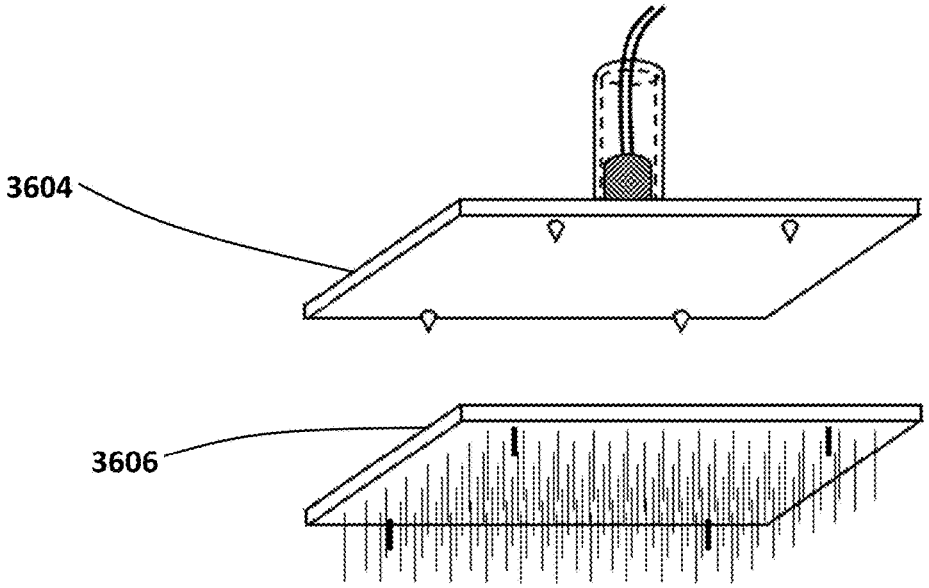
FIG. 40 provides a bottom up perspective view of an embodiment of a microplate mixing apparatus.

FIG. 40 provides a bottom up perspective view of the orbital plate module 3604 and the pin probe module 3606.

Figure 41:
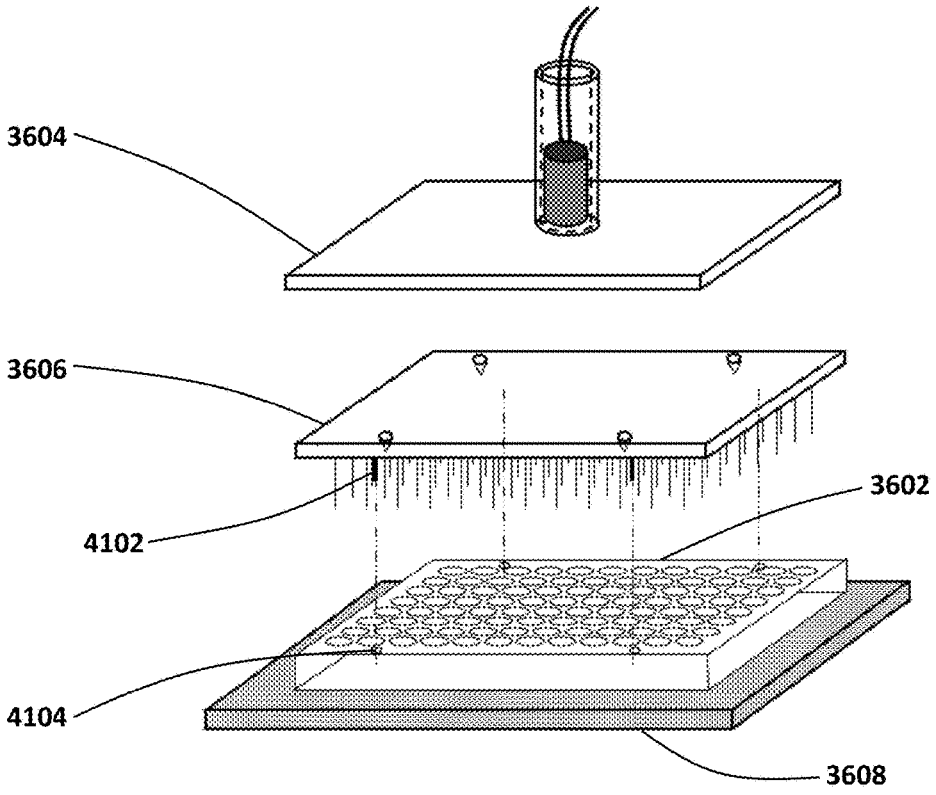
FIG. 41 provides a top down perspective view of an embodiment of a microplate mixing apparatus.

FIG. 41 provides a top down perspective view of the orbital plate module 3604, the pin probe module 3606, the microplate 3602 and the base plate 3608. Also shown are the pin probe module alignment spikes 4102 and the corresponding microplate notches 4104.

Figure 78:
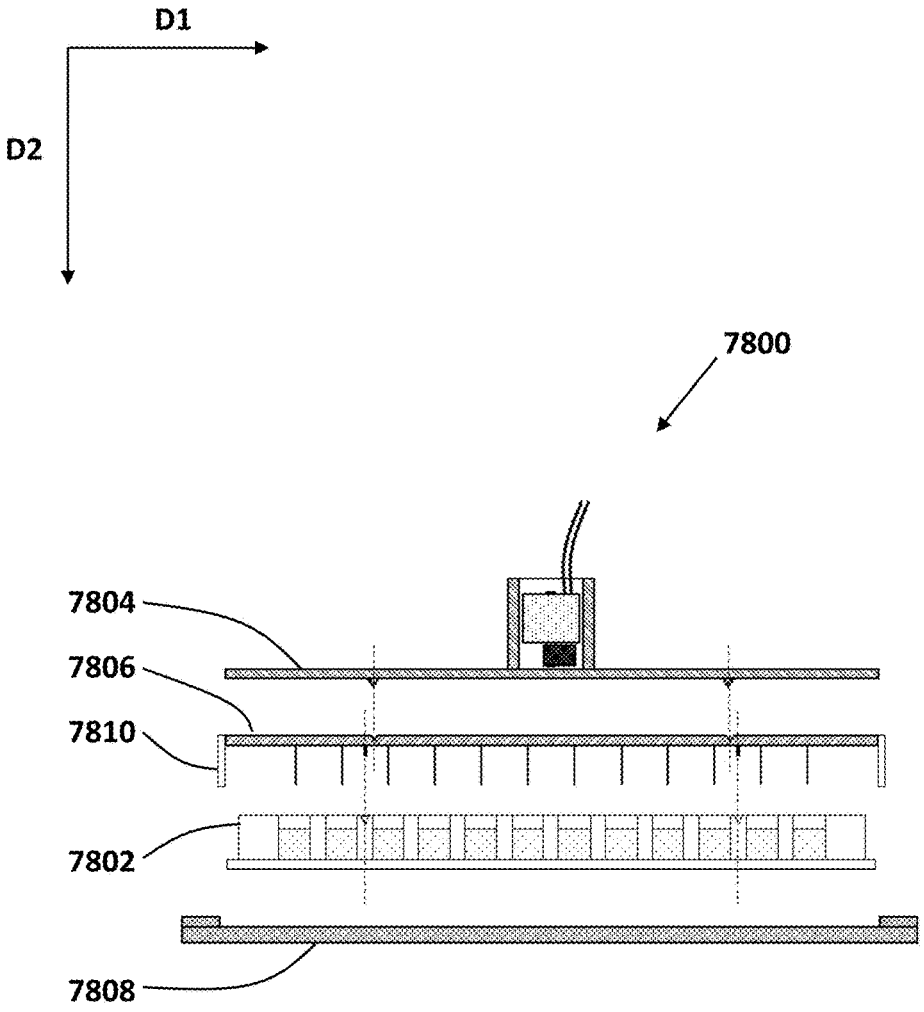
FIGS. 78, 79, 80 and 81 provide cross section views of a microplate mixing apparatus having a contamination barrier.

Another embodiment of the present invention provides a microplate mixing apparatus 7800 for stirring and/or mixing the contents of a microplate 7802. FIG. 78 provides a cross section view of a microplate mixing apparatus having an orbital plate module 7804, a pin probe module 7806, the pin probe module 7806 includes a contamination barrier 7810 and a base plate 7808. The present embodiment is taught in FIG. 32 and its associated disclosure, where the present components microplate 7802, orbital plate module 7804, pin probe module 7806, and base plate 7808 correspond to microplate 3202, orbital plate module 3204, pin probe module 3206, and base plate 3208, respectively. The present embodiment is configured to accept the microplate 7802 along the 12-well dimension in the D1 direction. The contamination barrier 7810 borders the four peripheral edges of the pin probe module 7806 (only two sides of the contamination barrier 7810 are shown from the perspective of the current figure). The contamination barrier 7810 provides a barrier to spurious air currents and possible air borne contamination that could jeopardize the reproducibility of the microplate well reactions.

Figure 79:
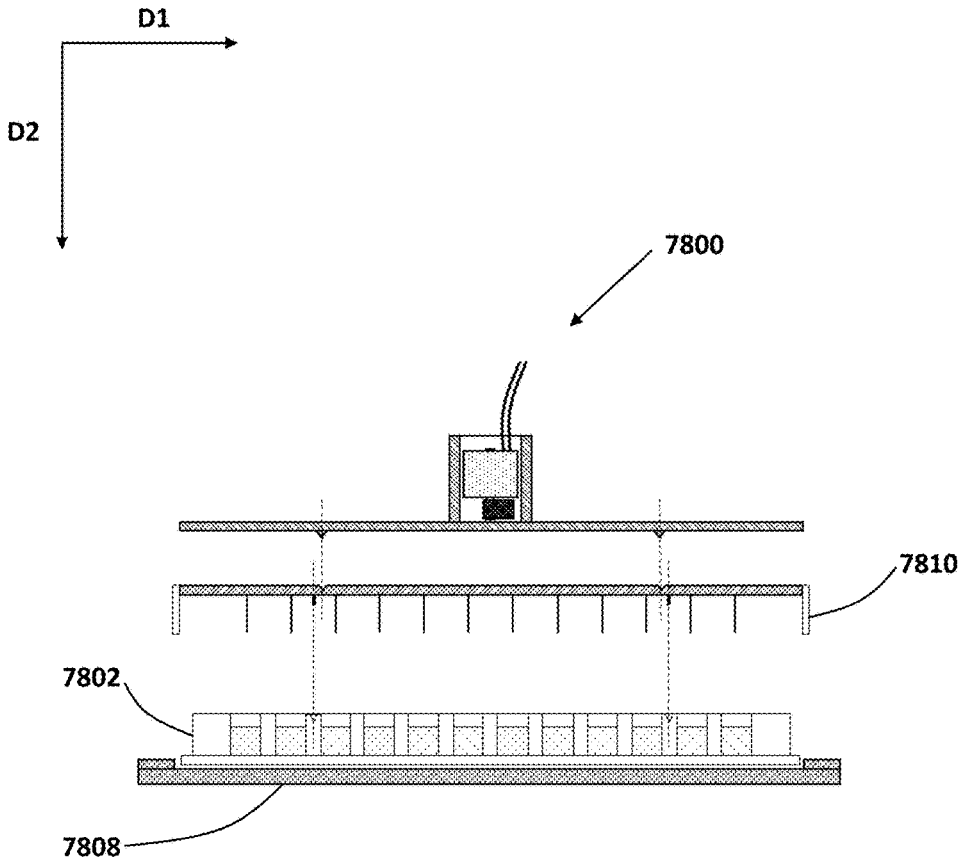

FIG. 79 provides a cross section view of a microplate mixing apparatus 7800 having a contamination barrier 7810, where the microplate 7802 is seated on the base plate 7808.

Figure 80:
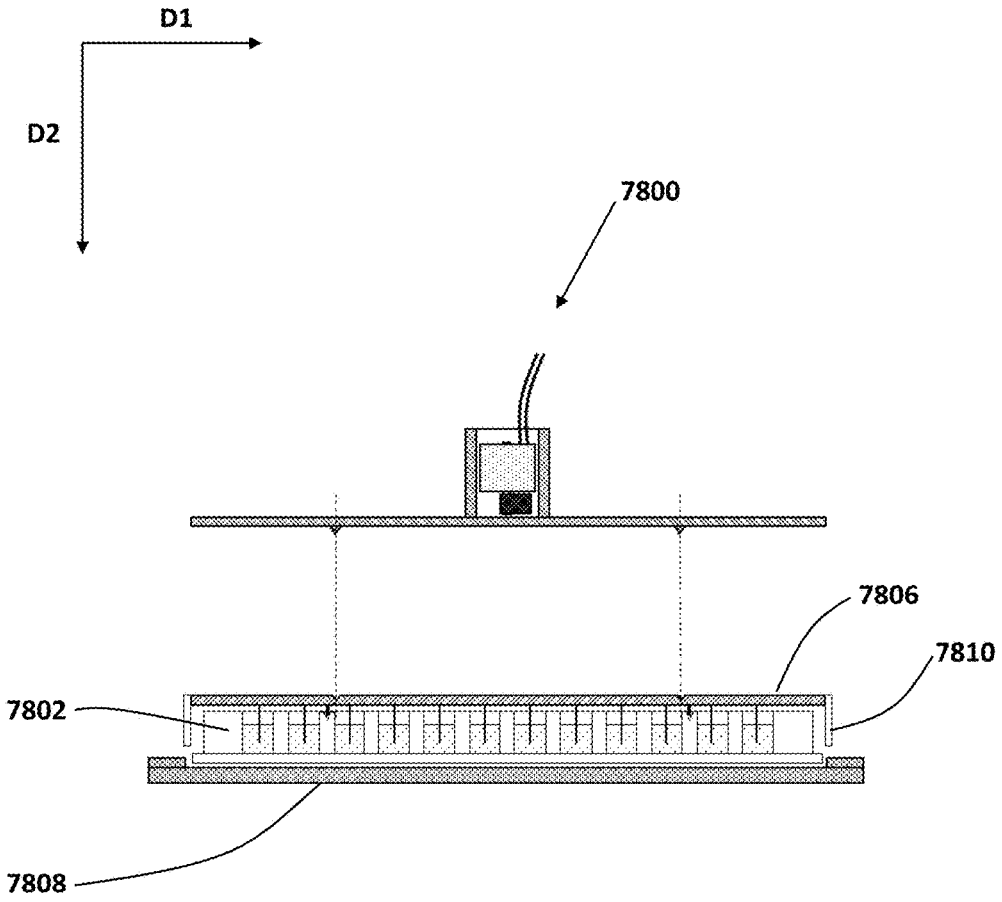

FIG. 80 provides a cross section view of the microplate mixing apparatus 7800 having a contamination barrier 7810 where the microplate 7802 is seated on the base plate 7808, and the pin probe module 7806 and the contamination barrier 7810 are positioned over the microplate 7802.

Figure 81:
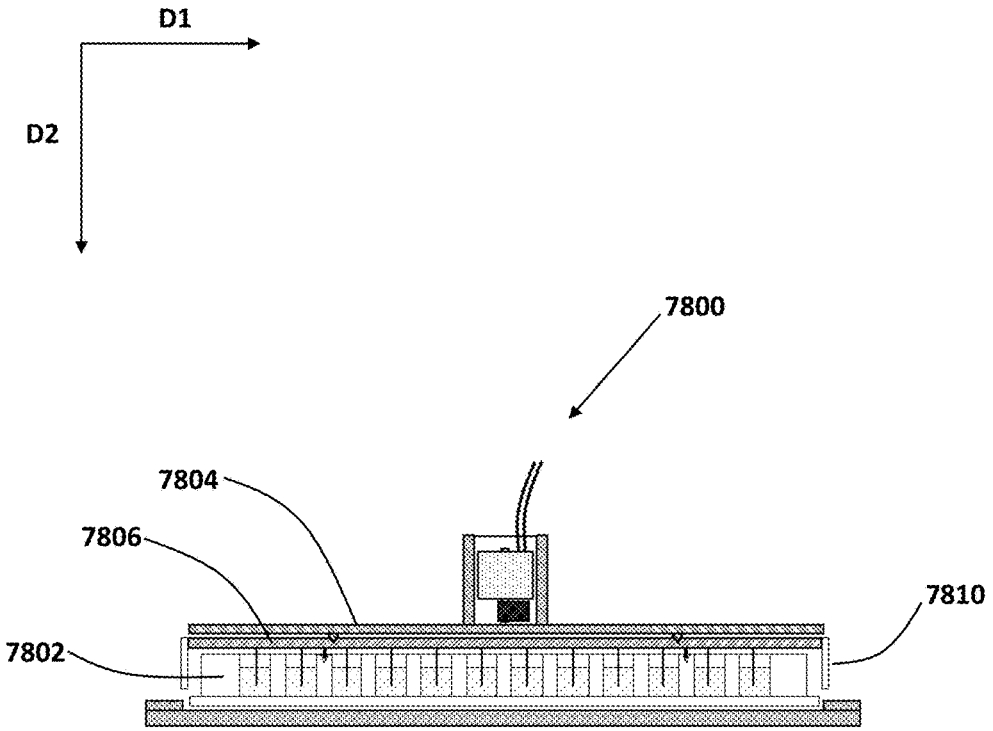

FIG. 81 provides a cross section view of the microplate mixing apparatus 7800 having a contamination barrier 7810 where orbital plate module 7804 and the pin probe module 7806 are detachably attached. The pin probes of the pin probe module 7806 are shown positioned within the wells of the microplate 7802 in contact with the materials in the wells for the stirring and/or mixing process. Upon completion of the stirring process, the attached orbital plate module 7804 and the pin probe module 7806 are moved along the D2 direction so that the pin probes are no longer in contact with the materials in the well and are clear of the microplate 7802.

Figure 82:
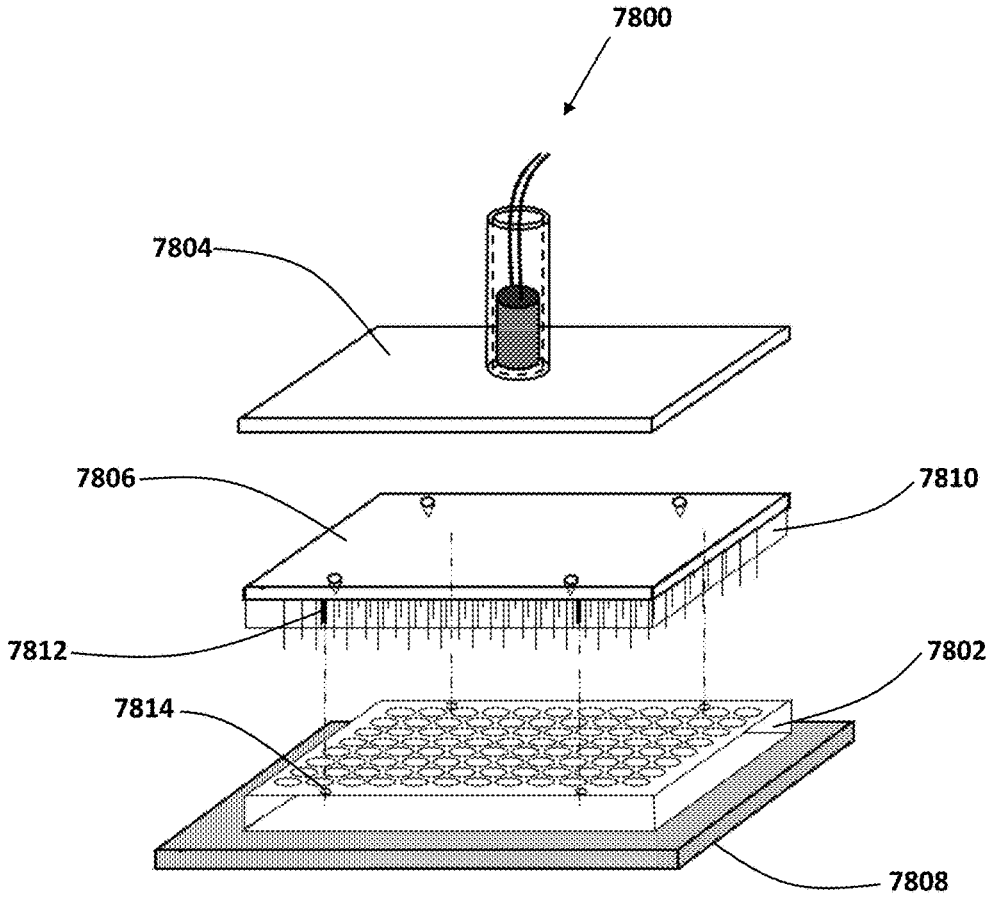
FIG. 82 provides a top down perspective view of the microplate mixing apparatus having a contamination barrier.

FIG. 82 provides a top down perspective view of the microplate mixing apparatus 7800 showing the orbital plate module 7804, the pin probe module 7806, the contamination barrier 7810, the microplate 7802 and the base plate 7808. Also shown are the pin probe module alignment spikes 7812 and the corresponding microplate notches 7814.

Figure 83:
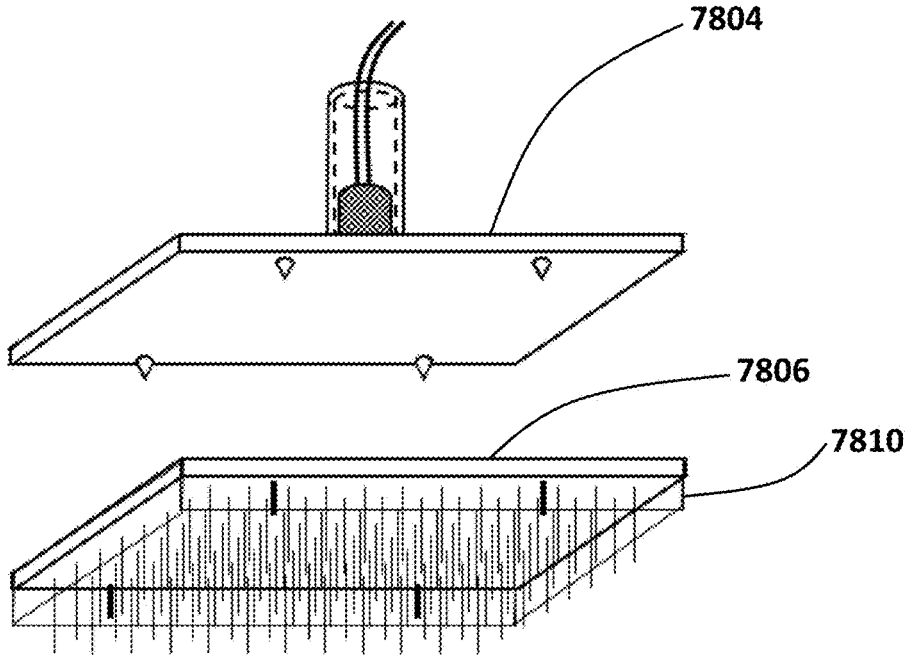
FIG. 83 provides a bottom up perspective view of the orbital plate module having a contamination barrier.

FIG. 83 provides a bottom up perspective view of the orbital plate module 7804, the pin probe module 7806 and the contamination barrier 7810.

Figure 42:
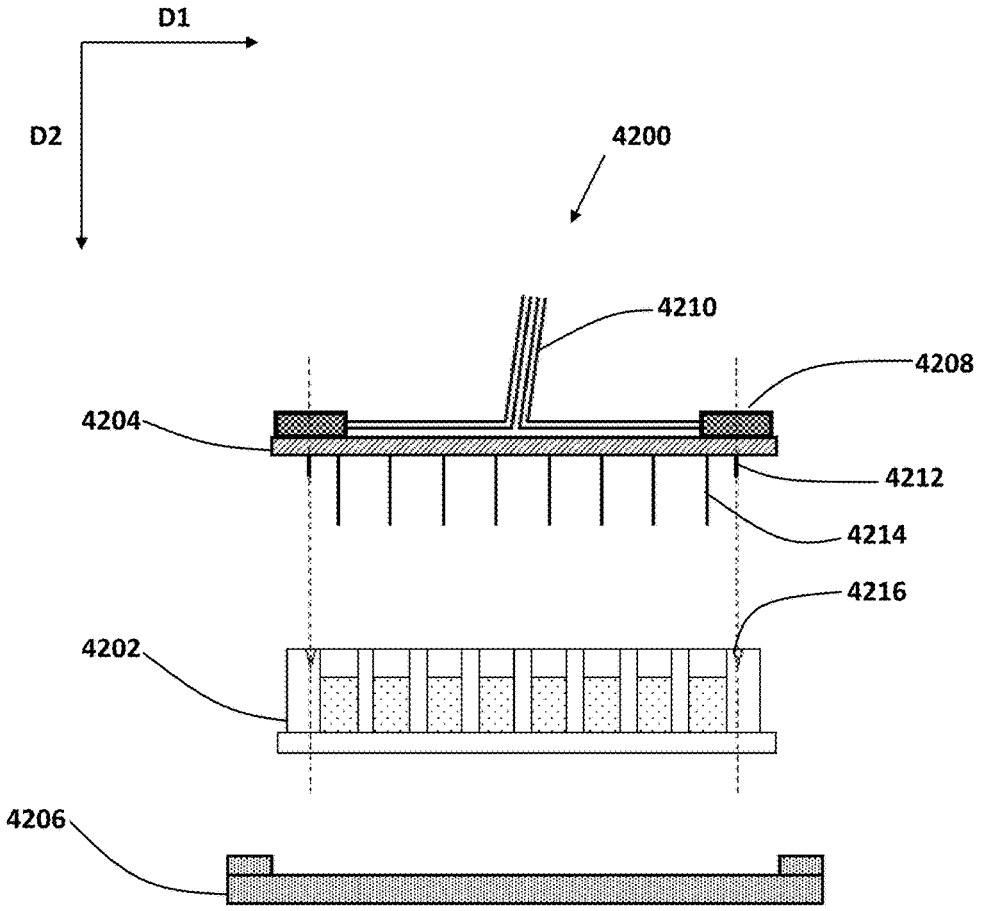
FIG. 42 provides a side perspective view along the 8 well dimension of a 8 by 12 microplate mixing apparatus having 4 coin motors.
Figure 45:
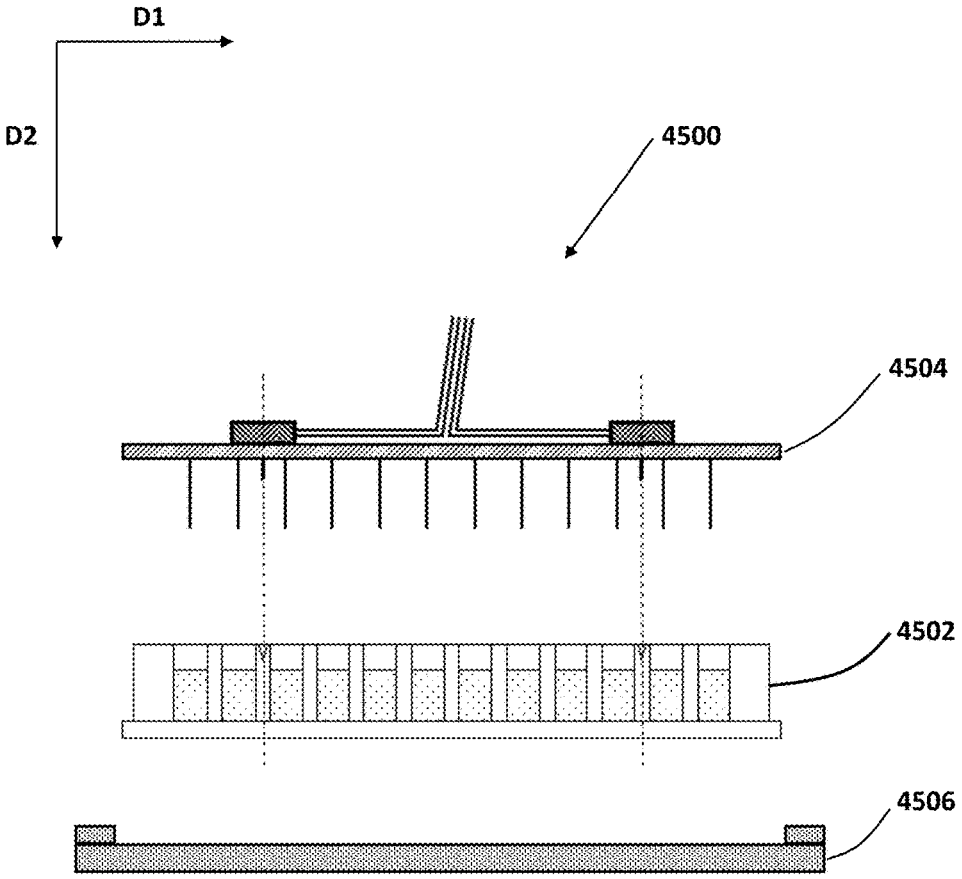
FIG. 45 provides a side perspective view along the 12 well dimension of a 8 by 12 microplate mixing apparatus having 4 coin motors.
Figure 52:
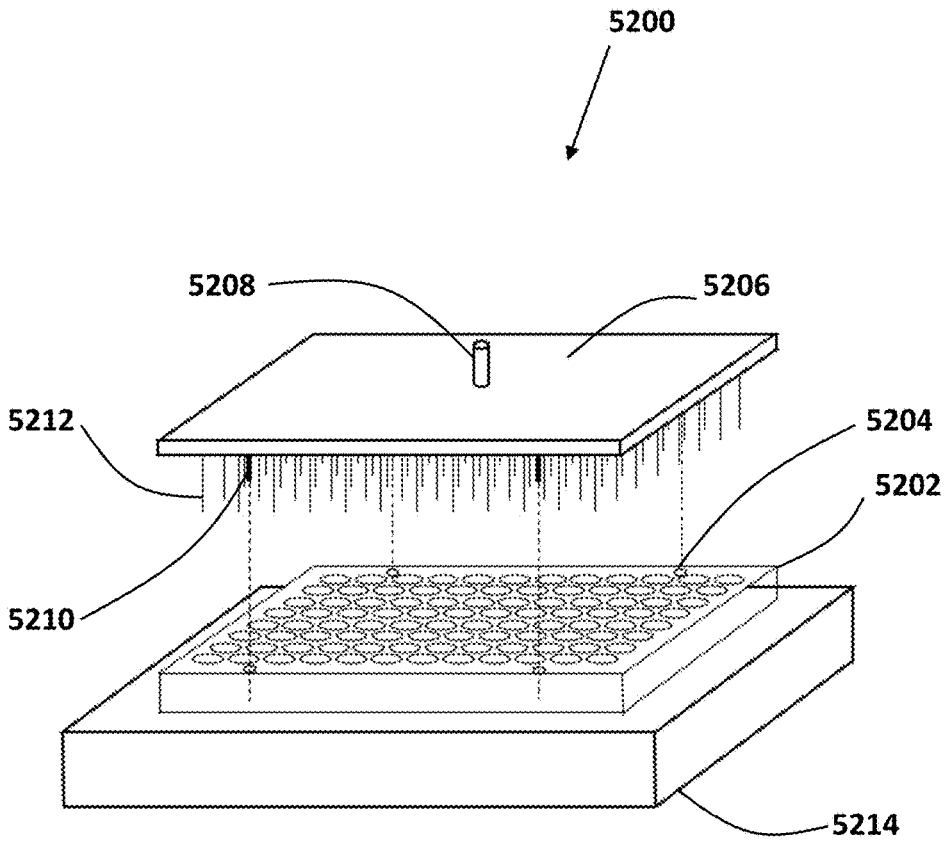
FIG. 52 provides a top down perspective view of a microplate mixing apparatus having a magnet drive unit and magnet motive element.

Another embodiment of the present disclosure provides an orbital plate module having a plurality of pin probes extending from its distal side, for example orbital plate modules 4204, 4504 and 5206, described in FIGS. 42, 45 and 52, respectively, having a contamination barrier as described previously.

Another embodiment of the present disclosure provides a microplate mixing apparatus for stirring and/or mixing the contents of a microplate having a first plurality of wells and a second plurality of microplate notches, comprising an orbital plate module and a base. On the proximal side of the orbital plate module are four disk shaped vibration inducing units. On the distal side of the orbital plate module are a third plurality of orbital plate engaging spikes extending from the distal side that are received by the second plurality of microplate notches, and a fourth plurality of pin probes extending orthogonally from the distal side, where the number of fourth plurality pin probes and the first plurality of microplate wells are the same, and each pin probe is aligned with each individual well of the microplate.

FIG. 42 provides a cross section view of a microplate mixing apparatus of the present disclosure. The microplate mixing apparatus 4200 for mixing and/or stirring the contents of a microplate 4202 having an orbital plate module 4204 and a base plate 4206. Attached to the proximal side of the orbital plate module 4204 are disk shaped vibration inducing units, also referred to as coin motors, 4208 and power connection 4210 that provide power to the coin motors 4208 from a power source (not shown) and control unit (not shown). The coin motors 4208 are built to vibrate at essentially the same frequency when provided with essentially the same voltage. The coin motors 4208 are electrically configured to the power source so that all the motors receive essentially the same voltage thereby ensuring that the vibrations are essentially at the same frequency so as to avoid cancellation of the vibrations. It is known that multiple eccentric rotating mass motors when attached to a single object and aligned in the same axis direction automatically run in a synchronized fashion at the same speed and in the same phase. Extending from the distal side of the orbital plate module 4204 are four alignment spikes 4212 and 96 pin probes arranged in an 8 by 12 matrix pattern that corresponds to the arrangement of the 96 wells of the microplate 4202. The perspective provided by FIG. 42 shows only the front row of 8 pins probes 4214. Microplate 4202 is a standard 8×12, 96 well plate that has been modified with the addition of alignment notches 4216. The positioning of the four alignment notches 4216 correspond to the position of the four alignment spikes 4212. The four alignment notches 4216 receive the alignment spikes 4212 and together ensure that the orbital plate module 4204 and the microplate 4202 are aligned when in contact. The alignment spikes 4212 are of equal length and have sufficient vertical strength to support the weight of the orbital plate module 4204. The alignment spikes 4212 also have sufficient yield strength such that they can sustain the continuous orbital movement of the orbital plate module 4204. The yield strength of the alignment spikes 4212 can be decreased by making them thinner. The decrease in yield strength in the alignment spikes 4212 will result in greater orbital movement. The alignment spikes 4212 are sufficiently long such that the orbital plate module 4204 can orbit above the microplate 4202 without touching the microplate. The alignment spikes 4212 can be made from materials such as, high carbon steel (for example, piano wire and spring steel), or polymer materials, such as nylon, polystyrene, polypropylene, PEEK or acetal. The base plate 4206 receives the microplate 4202. The base plate 4206 may optionally have alignment grooves and alignment fixtures to ensure that the microplate 4202 is properly seated on the base plate 4206.

Figure 43:
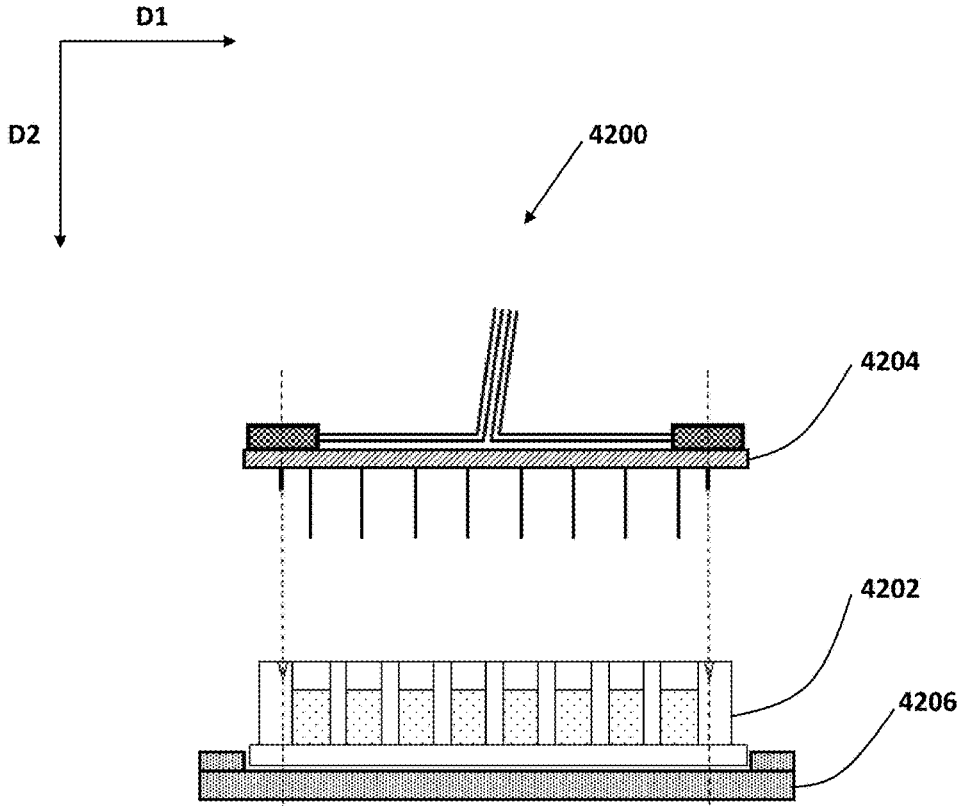
FIG. 43 provides a side perspective view along the 8 well dimension of a partially configured 8 by 12 microplate mixing apparatus having 4 coin motors.

FIG. 43 provides a cross section view of a microplate mixing apparatus 4200 where the microplate 4202 is seated on the base plate 4206.

Figure 44:
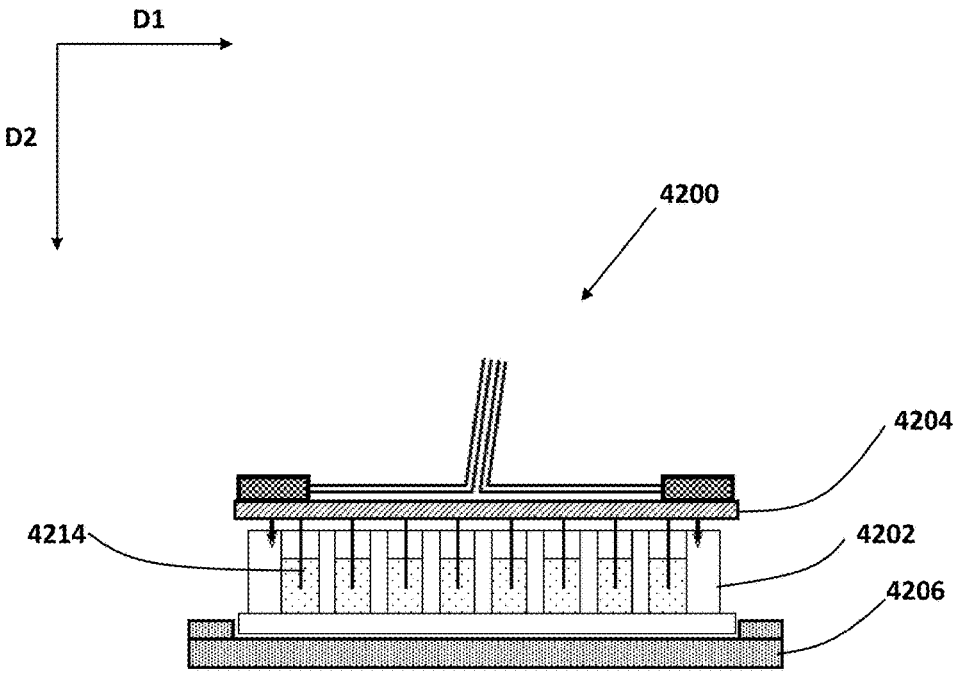
FIG. 44 provides a side perspective view along the 8 well dimension of a fully configured 8 by 12 microplate mixing apparatus having 4 coin motors.

FIG. 44 provides a cross section view of the microplate mixing apparatus 4200 where orbital plate module 4204 and the microplate 4202 are aligned and in contact, and the microplate 4202 is seated on the base plate 4206. The pin probes 4214 of the orbital plate module 4204 are shown positioned within the wells of the microplate 4202 in contact with the materials in the wells for the stirring and/or mixing process. Upon completion of the stirring process, the attached orbital plate module 4204 is moved along the D2 direction so that the pin probes 4214 are no longer in contact with the materials in the well and are clear of the microplate 4202.

Another embodiment of the present invention provides a microplate mixing apparatus 4500 as shown in FIG. 45 for stirring and/or mixing the contents of a microplate 4502 having an orbital plate module 4504 and a base plate 4506. The present embodiment is taught in FIG. 42 and its associated disclosure, where the present components microplate 4502, orbital plate module 4504 and base plate 4506 correspond to microplate 4202, orbital plate module 4204, and base plate 4206, respectively. However the present embodiment is configured to accept the microplate 4502 along the 12-well dimension in the D1 direction.

Figure 46:
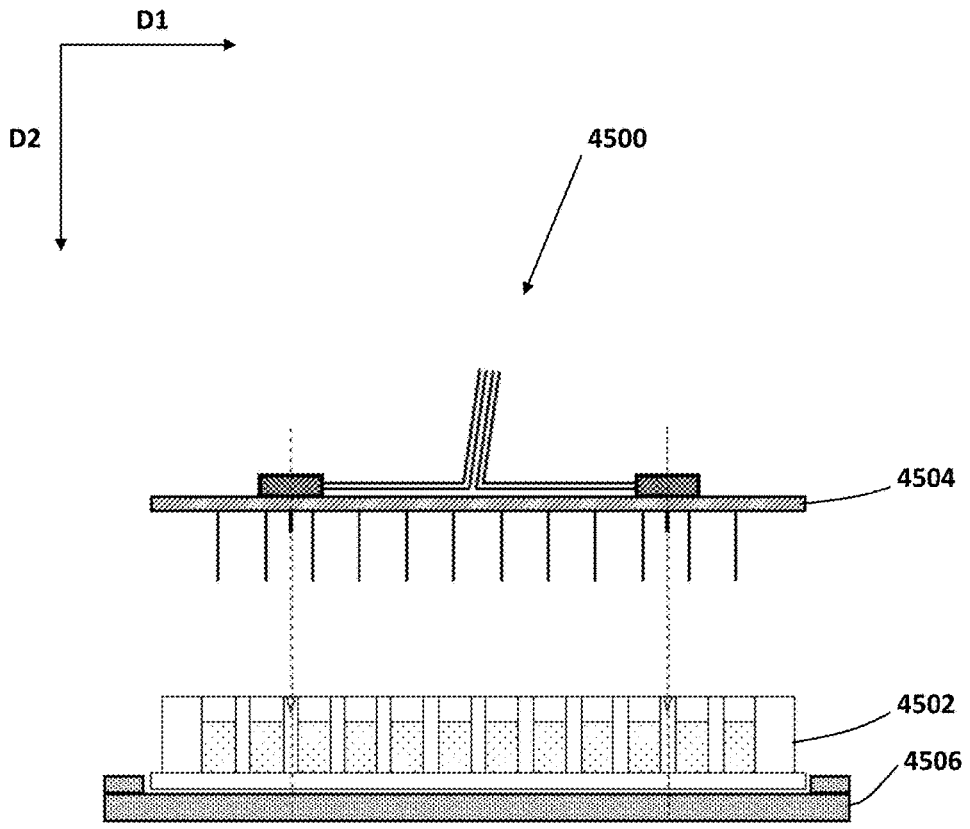
FIG. 46 provides a side perspective view along the 12 well dimension of a partially configured 8 by 12 microplate mixing apparatus having 4 coin motors.

FIG. 46 provides a cross section view of the microplate mixing apparatus 4500 where the microplate 4502 is seating on the base plate 4506.

Figure 47:
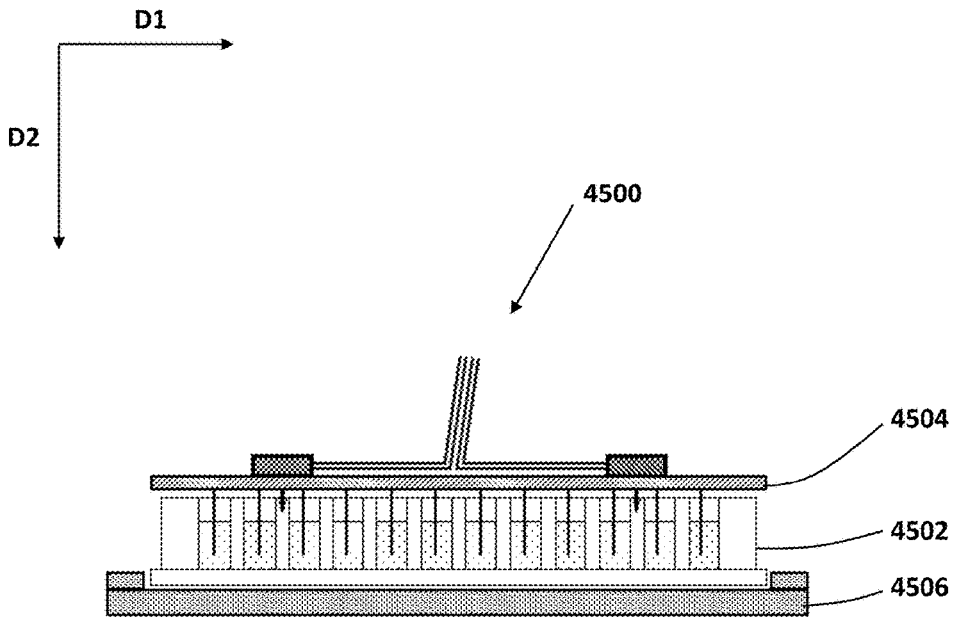
FIG. 47 provides a side perspective view along the 12 well dimension of a fully configured 8 by 12 microplate mixing apparatus having 4 coin motors.

FIG. 47 provides a cross section view of the microplate mixing apparatus 4500 where orbital plate module 4504 and the microplate 4502 are aligned and in contact, and the microplate 4502 is seated on the base plate 4506. The pin probes of the orbital plate module 4504 are shown positioned within the wells of the microplate 4502 in contact with the materials in the wells for the stirring and/or mixing process. Upon completion of the stirring process, the attached orbital plate module 4504 is moved along the D2 direction so that the pin probes are no longer in contact with the materials in the well and are clear of the microplate 4502.

Figure 48:
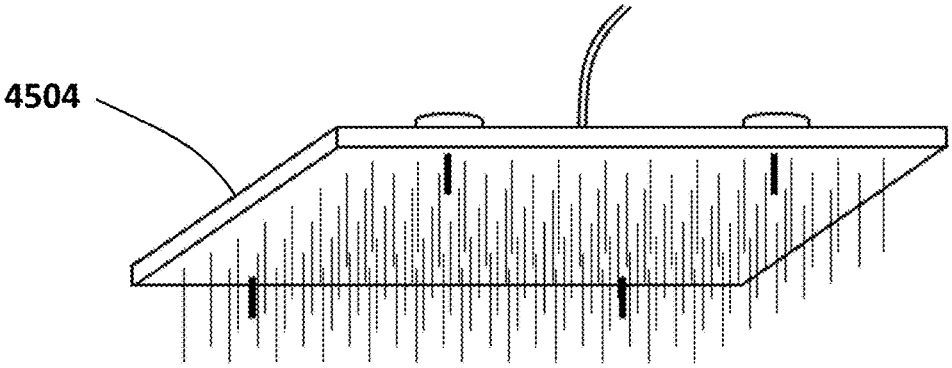
FIG. 48 provides a bottom up perspective view of the orbital plate module having four coin motors.

FIG. 48 provides a bottom up perspective view of the orbital plate module 4504.

Figure 49:
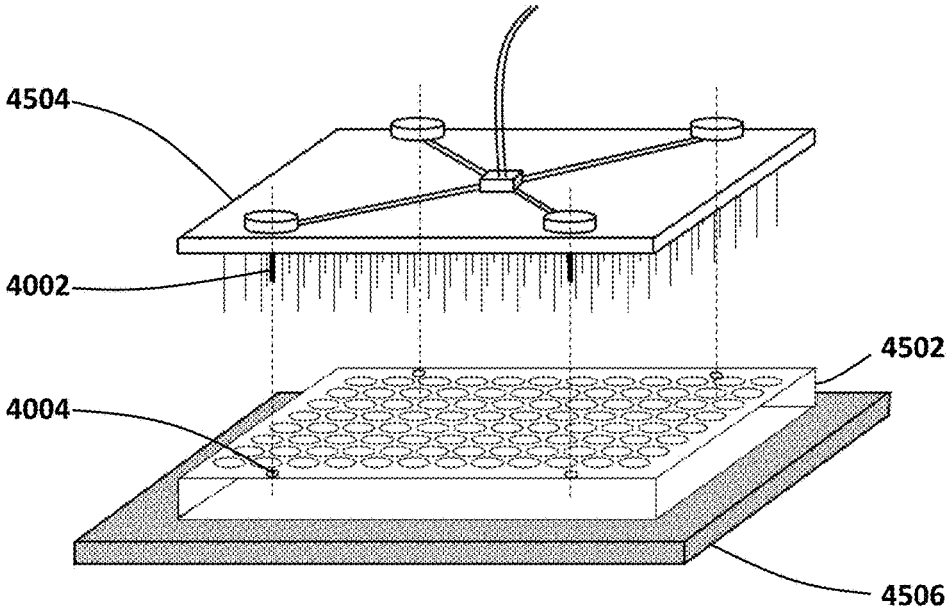
FIG. 49 provides a top down perspective view of the orbital plate module having four coin motors.

FIG. 49 provides a top down perspective view of the orbital plate module 4504, the microplate 4502 and the base plate 4506. Also shown are the pin probe module alignment spikes 4002 and the corresponding microplate notches 4004.

Figure 50:
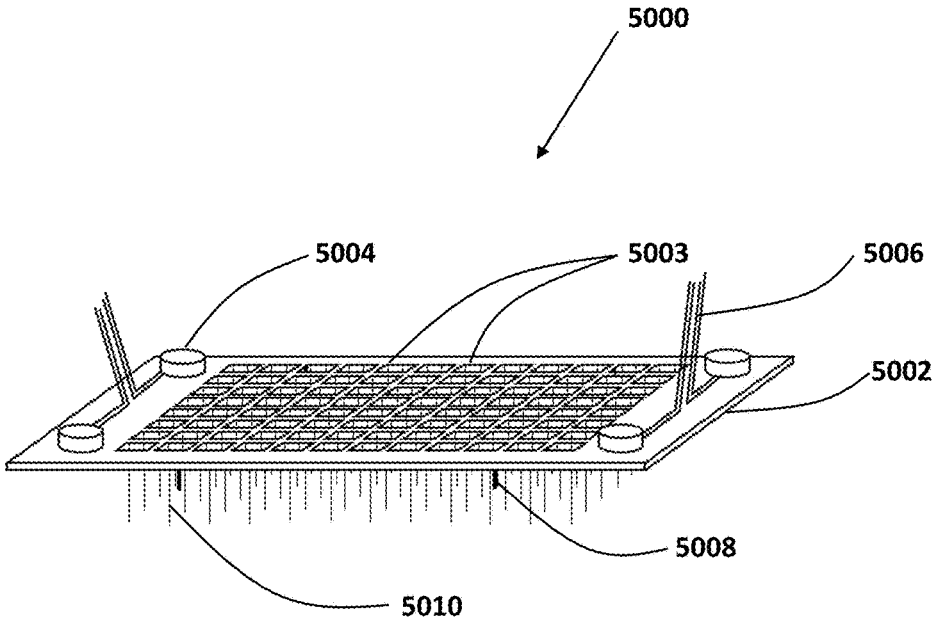
FIG. 50 provides a top down perspective view of a orbital lattice module.

Another embodiment of the present disclosure provides an orbital lattice module 5000 as shown in FIG. 50. FIG. 50 provides a top down perspective view of orbital lattice module 5000 of the present disclosure. The orbital lattice module 5000 is useful for mixing and/or stirring the contents of a microplate, such as microplate 4202 and microplate 4502 previously taught in FIG. 42 and FIG. 45 and their associated disclosure, respectively, where the openings of the lattice allow for the addition, and/or removal of materials from the microplate without having to displace the orbital lattice module 5000. The orbital lattice module 5000 enables stirring during addition and mixing of contents in the microplate. The orbital lattice module 5000 is comprised of a lattice plate 5002 having 96 openings 5003 arranged in a 8×12 matrix configuration that corresponds to the placement of the 96 wells of the microplate, four vibration inducing units 5004, such as coin motors that are connected to power connectors 5006 providing power to the four vibration inducing units attached to the proximal surface of the lattice plate; and extending from the distal surface of the lattice plate four alignment spikes 5008 that aligned with the corresponding microplate notches (as taught for microplate 4202 and microplate 4502), and 96 pin probes 5010 arranged in a 8×12 matrix configuration that corresponds to the placement of the 96 wells of the microplate. The orbital lattice module 5000 when placed in contact with a microplate can mix and/or stir the contents of the microplate, permits the addition or removal of materials with the orbital lattice module 5000 in place, and enables the simultaneous addition or removal material while the contents are being mixed or stirred.

Figure 51:
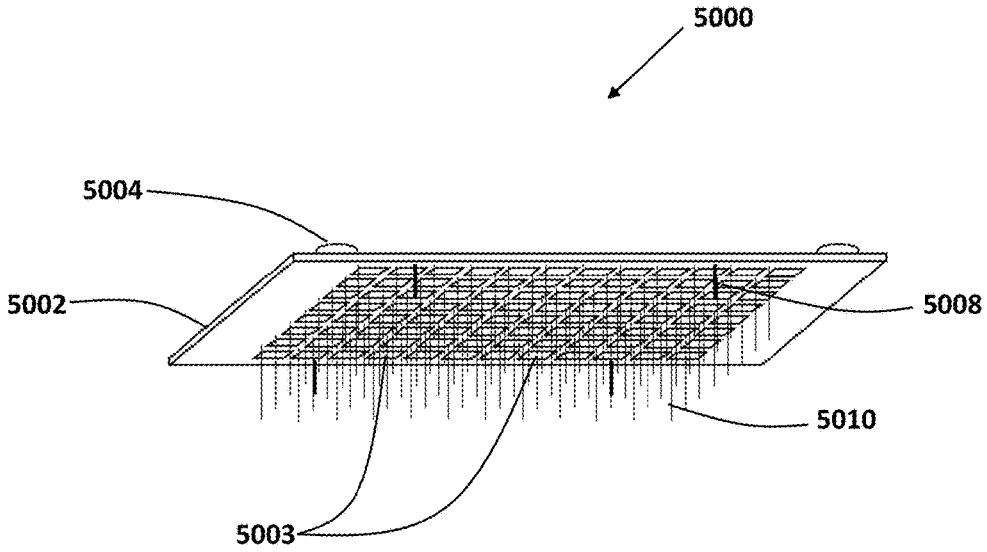
FIG. 51 provides a bottom up perspective view of an orbital lattice module.

FIG. 51 provides a bottom up perspective view of the orbital lattice module 5000 (power connectors 5006 are not shown).

Another embodiment of the present disclosure provides a microplate mixing apparatus for mixing and/or stirring the contents of a microplate having a pin probe plate, a vibration inducing unit and ejector mechanism all attached to a robotic arm of a workstation.

Figure 96:
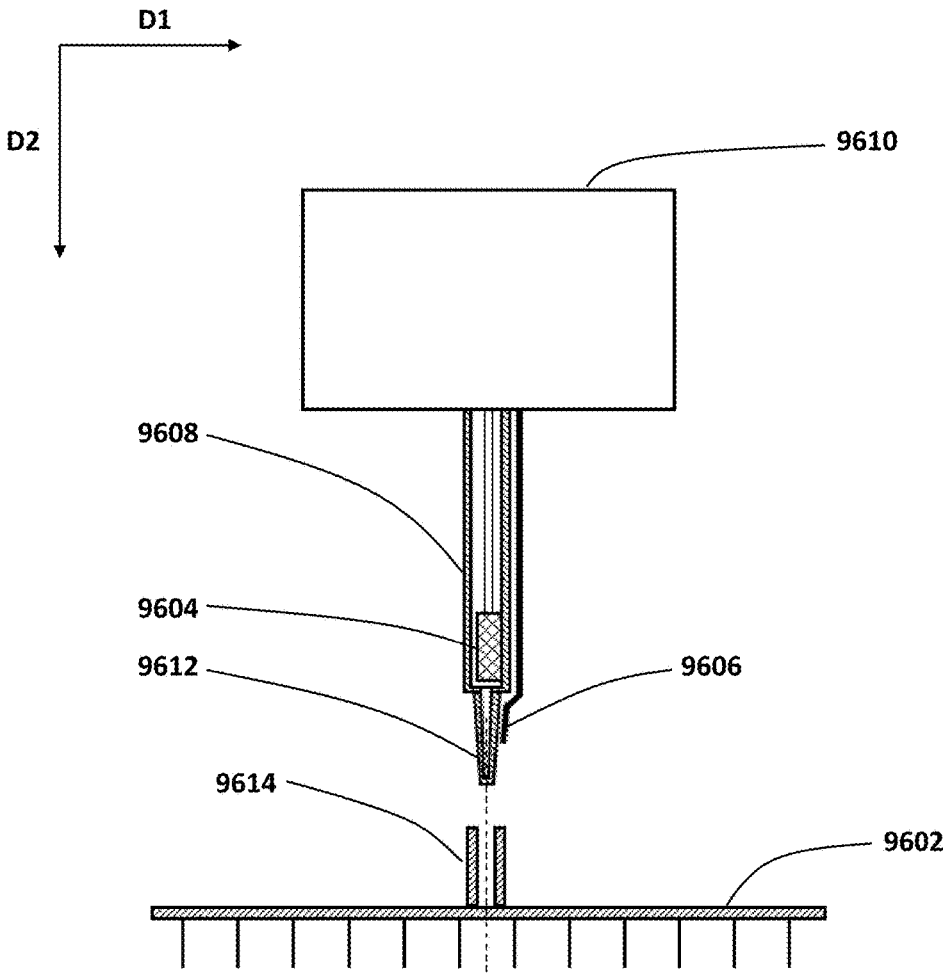
FIG. 96 provides a side view of a microplate stirrer for use with a screen assembly having robotic arm.

FIG. 96 provides a side section view of an 8×12 matrix 96 well microplate pin probe module 9602, a vibration inducing unit 9604 and an ejector mechanism 9606. The vibration inducing unit 9604 is enclosed within a housing 9608. The ejector mechanism 9606 is adjacent to the housing. The housing 9608 is attached at its proximal end to a robotic arm 9610 that is part of a microplate screening workstation (not shown). The housing 9608 having at its distal end an extension 9612 that is detachably attached to a receiver piece 9614 on the pin probe module 9602. The vibration inducing unit 9604 and the ejector mechanism 9606 are controlled by the controller (not shown) of the workstation, typically a microprocessor. The controller controls the strength and duration of the vibrations from the vibration inducing unit 9604. The controller also instructs the ejector mechanism 9606 to eject the pin probe module 9602. When instructed the ejector mechanism 9606 travels distally making contact with the receiver piece 9614 on the pin probe module 9602 and continues to move distally until the pin probe module 9602 is ejected. Once the pin probe module 9602 is ejected the ejector mechanism 9606 is moved back to its starting position.

Another embodiment of the present disclosure provides a microplate mixing apparatus for stirring and/or mixing the contents of a microplate having a base module including a magnet drive unit, the magnet drive unit having a motor and a magnet drive shaft attached to the motor, where a magnet is attached off center to the rotational axis of the magnet drive shaft; and an orbital plate module having a magnet motive element.

The present embodiment provides for orbiting the pin probe module about a small radius orbit. This motion is similar to that induced by a vibration motor in that it creates a swirling motion in every pin probe. To generate this motion, a pair of magnets is used. One magnet, the magnet motive element, is attached to the orbital plate module and the second magnet is mounted off center on the magnet drive shaft. The two magnets are placed so that the sides of the magnets facing each other are of opposite polarity so that the magnets are attracted to each other.

The motor rotates the magnet drive shaft, which has a magnet attached off center to its axis of rotation. This results in an orbiting magnetic field which attracts the magnet motive element. The orbital motion is imparted to the magnet motive element, which is attached to the proximal side of the orbital plate, thereby imparting the orbital motion to the orbital plate, which results in the pin probes attached to the distal side of the orbital plate moving in a swirling motion. The swirling motion of the pin probes provides the desired stirring/mixing in the wells of the microplate wells.

To obtain effective mixing the radius of the orbiting motion of the pin probe module should be about 5% to about 20% of the radius of the microplate well. For example, microplate dimensions and the range of the corresponding orbital radius useful for stirring are as follows:

| Micro-plate Format | Well Diameter (mm) | Orbital Radius Range (mm) | mathematical (5% to 20%) | Well to Well Distance (mm) |
|---|---|---|---|---|
| 48-well | 11 | 0.3-1.1 | (0.275-1.1) | 13 |
| 96-well | 7 | 0.2-0.7 | (0.175-0.7) | 9 |
| 384-well | 3.8 | 0.1-0.4 | (0.095-0.380 | 4.5 |
| 1536-well | 1.7 | 0.04-0.2 | (0.0425-0.17) | 2.25 |

Another embodiment of the present disclosure provides a microplate mixing apparatus for stirring and/or mixing the contents of a microplate having a first plurality of wells and a second plurality of microplate notches, comprising an orbital plate module and a base module for receiving the microplate, the base module having a magnet drive unit, the magnet drive unit having a motor and a magnet drive shaft attached to the motor, where a magnet is attached off center to the rotational axis of a magnet drive shaft. On the proximal side of the orbital plate module is at least one magnet motive element, where the magnet motive element is made from a magnet, and is attached to the orbital plate so that its magnetic field is aligned with the magnetic field of the magnet in the magnet drive unit and the magnet motive element and magnet are attracted to each other. On the distal side of the orbital plate module are a third plurality of orbital plate alignment spikes extending from the distal side that are received by the second plurality of microplate notches, and a fourth plurality of pin probes extending orthogonally from the distal side, where the number of fourth plurality pin probes and the first plurality of microplate wells are the same, and each pin probe is aligned with each individual well of the microplate.

FIG. 52 provides a top down perspective view of a microplate mixing apparatus of the present embodiment 5200 for stirring and/or mixing the contents of a microplate. The microplate 5202 having microplate notches 5204 for aligning with the orbital plate module 5206. The orbital plate module 5206 having a magnet motive element 5208, orbital plate alignment spikes 5210, and pin probes 5212. A base module 5214, which encloses a magnet drive unit (not shown).

Figure 53:
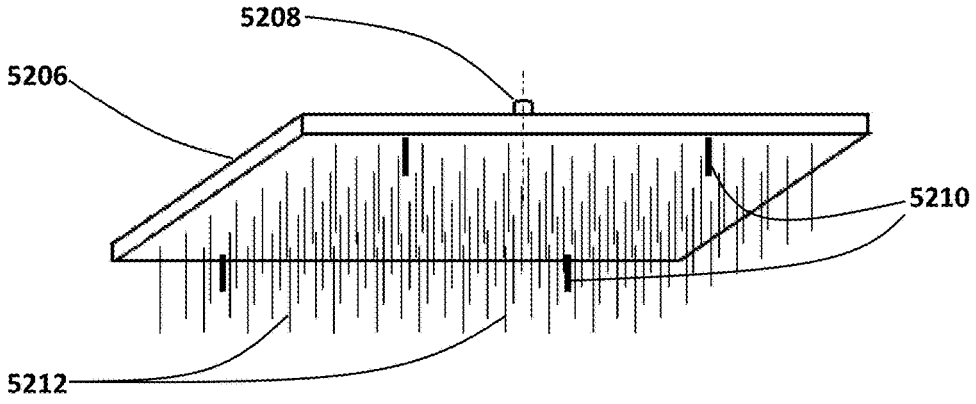
FIG. 53 provides a bottom up perspective view of the orbital plate having a magnet motive element.

FIG. 53 provides a bottom up perspective view of the orbital plate module 5206 having a magnet motive element 5208, orbital plate alignment spikes 5210, and pin probes 5212.

Figure 54:
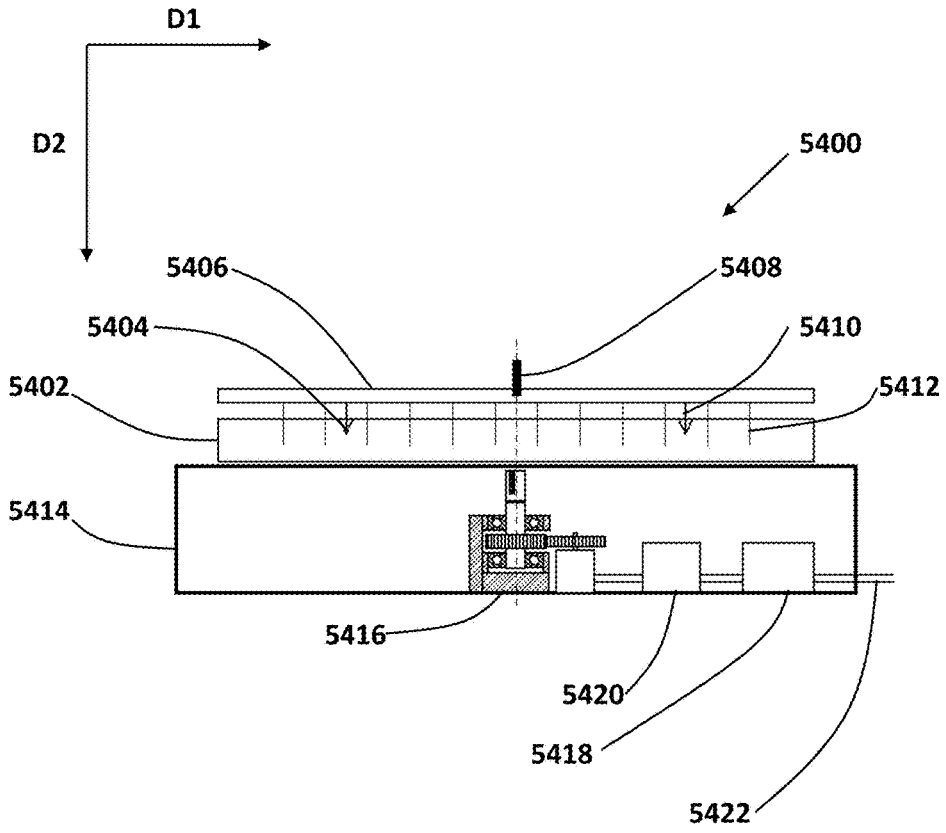
FIG. 54 provides a cross section view of a microplate mixing apparatus having a magnet drive unit and magnet motive element.

FIG. 54 provides a cross section view of a microplate mixing apparatus of the present embodiment 5400 for stirring and/or mixing the contents of a microplate. The microplate 5402 having microplate notches 5404 for aligning with the orbital plate module 5406. The orbital plate module 5406 having a magnet motive element 5408, which is made from a magnet, orbital plate alignment spikes 5410, and pin probes 5412. A base module 5414, which encloses a magnet drive unit 5416, a power adaptor 5418, speed controller 5420 and an electrical line 5422 for provide power to the magnet drive unit 5416.

Figure 55:
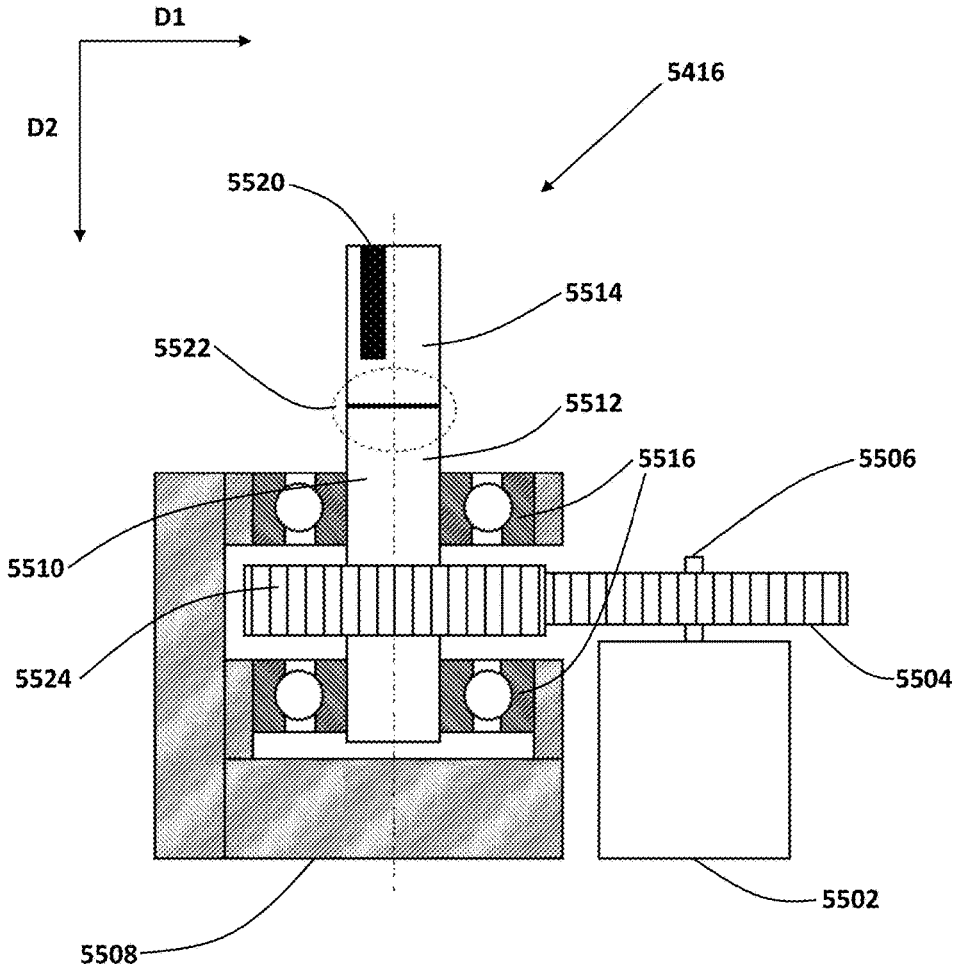
FIG. 55 provides a cross section view of a magnet drive unit.

FIG. 55 provides a cross section view of a magnet drive unit 5416 of the present embodiment shown in FIG. 54. The magnet drive unit 5416 includes a motor 5502; motor drive gear 5504 that is attached to the motor shaft 5506; a magnet drive housing 5508 encloses a rotatable magnet drive shaft 5510 having a distal portion 5512 and a proximal portion 5514, and at least two sets of bearings 5516 that support the rotatable magnet drive shaft 5510 within the magnet drive housing 5508. A magnet 5520 is mounted at the proximal end of the proximal portion 5514 of the magnet drive shaft 5510. The magnet 5520 is mounted off center from the rotational axis of the magnet drive shaft 5510. The proximal portion 5514 is attached to the distal portion 5512 of the magnet drive shaft 5510 by a detachable attachment interface 5522, which allows the proximal portion 5514 to be optionally detached from the distal portion 5512. Attached to the distal portion 5512 of the magnet drive shaft 5510 is a drive shaft gear 5524. The drive shaft gear 5524 is aligned so that it engages the motor drive gear 5504, such that rotational motion from the motor drive gear 5504 causes the drive shaft gear 5524 to rotate the magnet drive shaft 5510.

The magnet 5520 and the magnet motive element 5408 are configured such that their respective magnetic fields attract each other. The vertical axis of the magnet motive element 5408 is aligned with the rotational axis of the magnet drive shaft 5510 in the D2 direction. Because the magnet 5520 is mounted off center from the rotational axis of the magnet drive shaft 5510, rotation of the magnet drive shaft will result in a corresponding off axis displacement in the D1 direction of the magnetic field from the magnet 5520. The attraction between the magnetic fields of the magnet 5520 and the magnet motive element 5408 will cause the orbital plate 5406 attached to the magnet motive element 5408 to orbit with the magnet 5520 resulting in the swirling motion of the pin probe and the stirring and/or mixing of the contents of the microplate wells.

Figure 56:
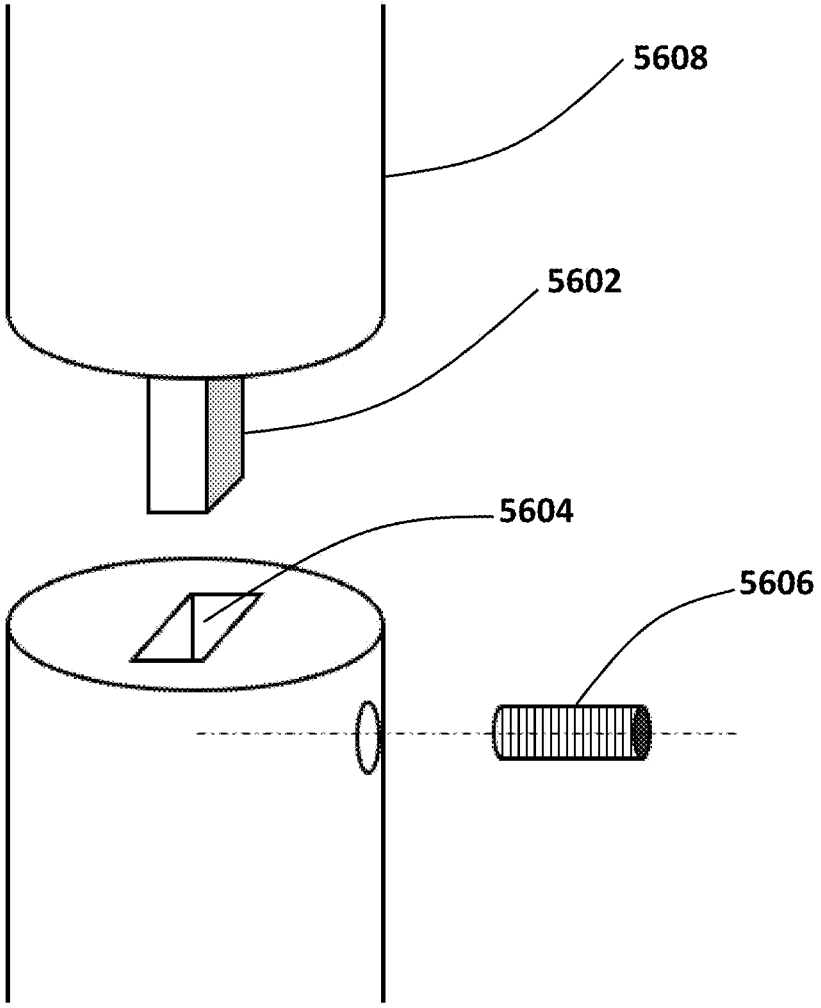
FIG. 56 provides a top down perspective view of a detached attachment interface having an insert member and an insert slot.

FIG. 56 provides a top down perspective view of a detached attachment interface 5522 having an insert member 5602 that is secured using an insert slot 5604 with a locking screw 5606. In the current FIG. 56 the insert member 5602 is shown as part of the proximal portion 5608 of the magnet drive shaft. However the placement of the insert member 5602 and insert slot 5604 can be interchanged, that is the insert member 5602 can be constructed as part of the distal portion of the magnet drive shaft with the corresponding insert slot 5604 and locking screw 5606 as part of the proximal portion of the magnet drive shaft.

Figure 57:
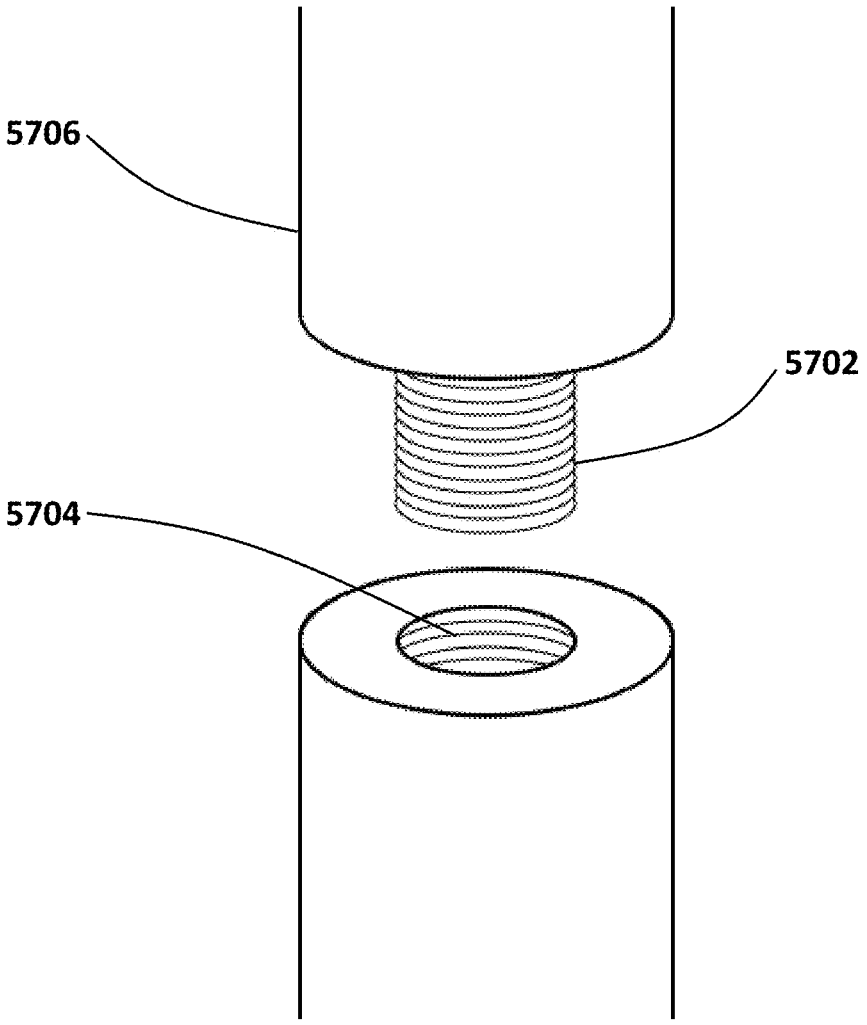
FIG. 57 provides a top down perspective view of a detachable attachment interface having a screw member and a thread member.

FIG. 57 provides a top down perspective view of a detachable attachment interface 5522 having a screw member 5702 and a thread member 5704. In the current FIG. 57 the screw member 5702 is shown as part of the proximal portion 5706 of the magnet drive shaft. However the placement of the screw member 5702 and the thread member 5704 can be interchanged, that is the screw member 5702 can be constructed as part of the distal portion of the magnet drive shaft with the corresponding thread member 5704 as part of the proximal portion 5706 of the magnet drive shaft. In either arrangement the thread rotation should be counter to the direction of rotation of the magnet drive shaft to prevent the inadvertent unscrewing of the thread. For example, where the magnet drive shaft rotates counter clockwise, the thread rotation should follow the right hand rule convention, so that a screw member 5702 located on the proximal portion of the magnet drive shaft is tightened by the counter clockwise rotation of the magnet drive shaft.

An aspect of the present embodiment provides a microplate mixing apparatus having more than one magnet motive element.

Figure 58:
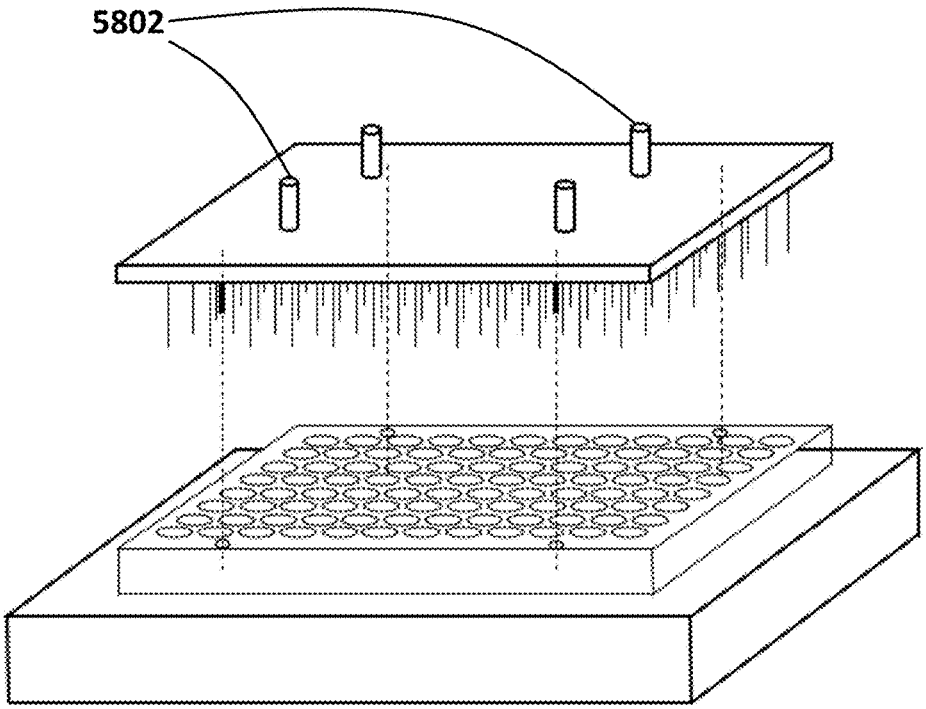
FIG. 58 provides a top down perspective view of an embodiment of the microplate mixing apparatus having four magnet motive elements.

FIG. 58 provides a top down perspective view of an embodiment of the microplate mixing apparatus described in FIG. 52 having four magnet motive elements 5802.

Figure 59:
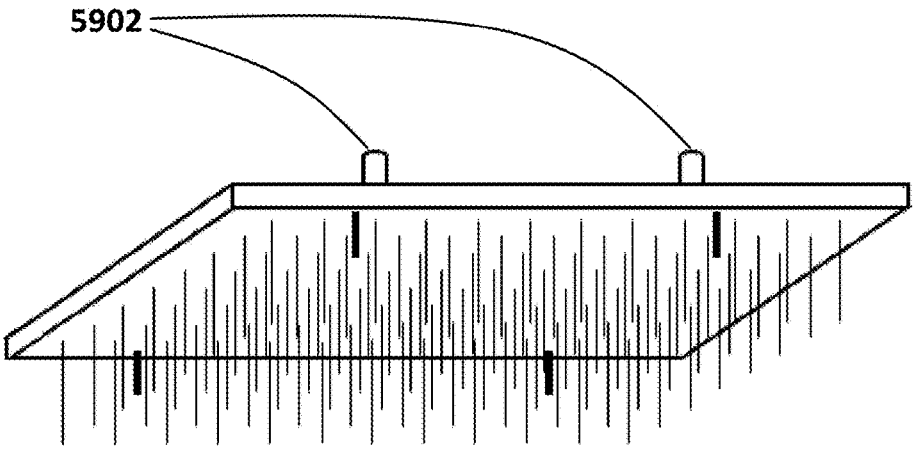
FIG. 59 provides a bottom up perspective view of an embodiment of the orbital plate having four magnet motive elements.

FIG. 59 provides a bottom up perspective view of an embodiment of the orbital plate described in FIG. 53 having four magnet motive elements 5902 (the perspective view only shows two of the four magnet motive elements).

Figure 60:
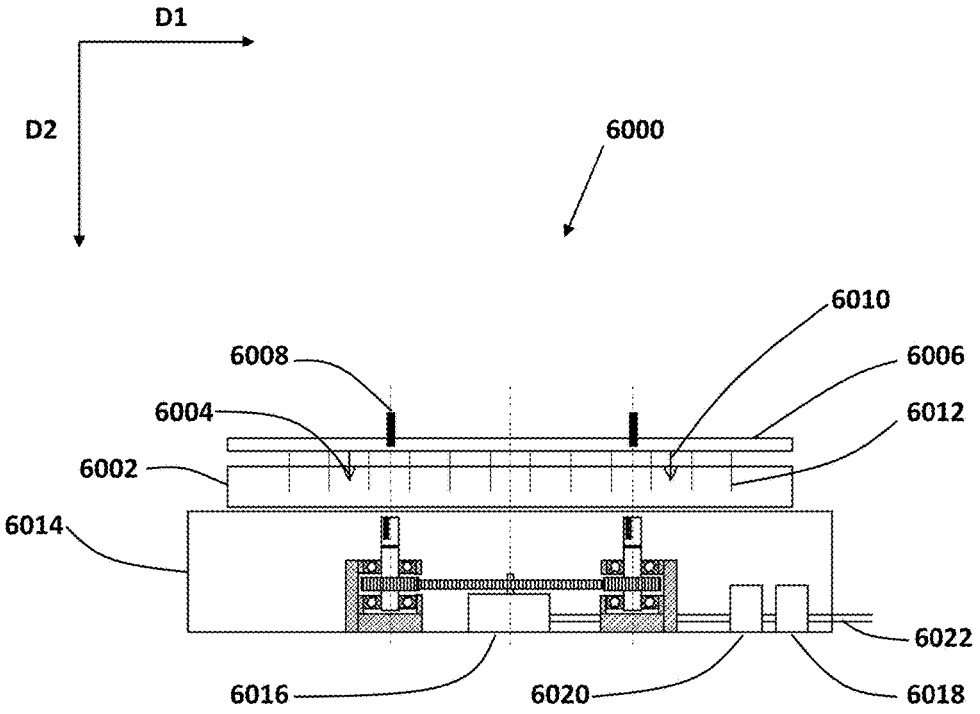
FIG. 60 provides a cross section view of a microplate mixing apparatus having a magnet drive unit and a magnet motive element.

FIG. 60 provides a cross section view of a microplate mixing apparatus 6000 for stirring and/or mixing the contents of a microplate. The microplate 6002 having microplate notches 6004 for aligning with the orbital plate module 6006. The orbital plate module 6006 having four magnet motive elements 6008, orbital plate alignment spikes 6010, and pin probes 6012. A base module 6014, which encloses a magnet drive unit 6016, a power adaptor 6018, speed controller 6020 and an electrical line 6022 that provides power to the magnet drive unit 6016.

Figure 61:
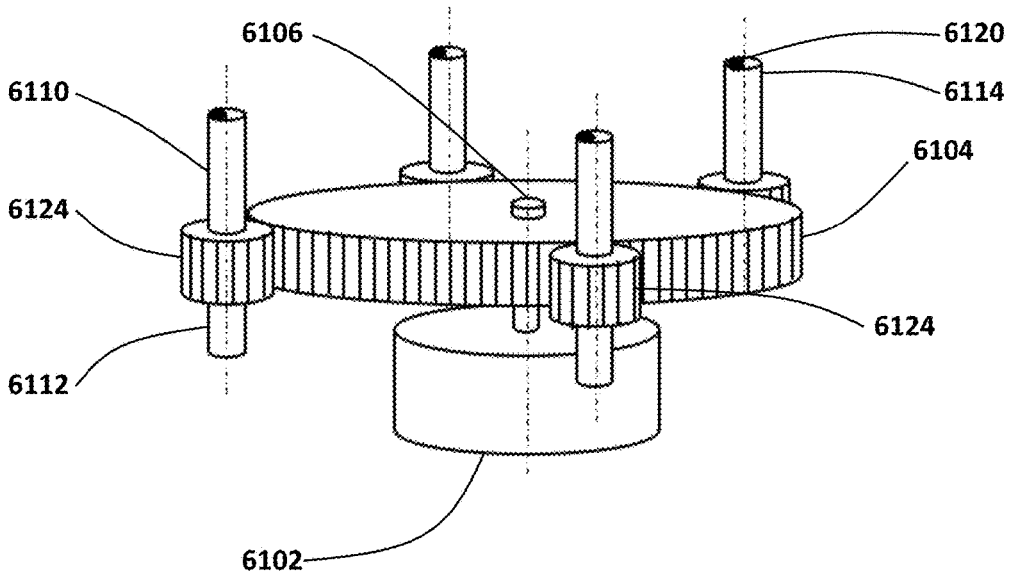
FIG. 61 provides a top down perspective view of the gear mechanism for the magnet drive unit.

FIG. 61 provides a top down perspective view of the gear mechanism for the magnet drive unit 6016. The magnet drive unit 6016 includes a motor 6102; motor drive gear 6104 that is attached to the motor shaft 6106; four magnet drive housings (not shown) previously described in FIG. 55 that each enclose of the rotatable magnet drive shafts 6110.

Each rotatable magnet drive shaft having a distal portion 6112 and a proximal end 6114, and at least two sets of bearings that support the rotatable magnet drive shaft within the magnet drive housing (not shown). A magnet 6120 is mounted at the proximal end 6114 of the magnet drive shaft 6110. The magnet 6120 is mounted off center from the rotational axis of the magnet drive shaft 6110. Although the rotatable magnet drive shafts 6110 in the present FIG. 61 are shown as single piece shafts, they can each be optionally constructed to incorporate the detachable attachment interface 5522 taught in FIGS. 55, 56 and 57. Attached to the distal portion 6112 of each magnet drive shaft 6110 is a drive shaft gear 6124. Each drive shaft gear 6124 is aligned so that it engages the motor drive gear 6104, such that rotational motion from the motor drive gear 6104 causes each magnet drive shaft gear 6124 to rotate the magnet drive shaft 6110. All magnets mounted off center from the rotational axis of the magnet drive shaft are made to rotate in the same angle of rotation such that the corresponding four magnet motive elements are attracted in unison and cause the orbital plate module to orbit. Alternatively, the magnet drive shaft gear 6124 may be linked to the motor drive gear with a toothed drive belt (also known as synchronous belt, notch belt or timing belt) instead of the direct gear-to-gear contact.

Figure 62:
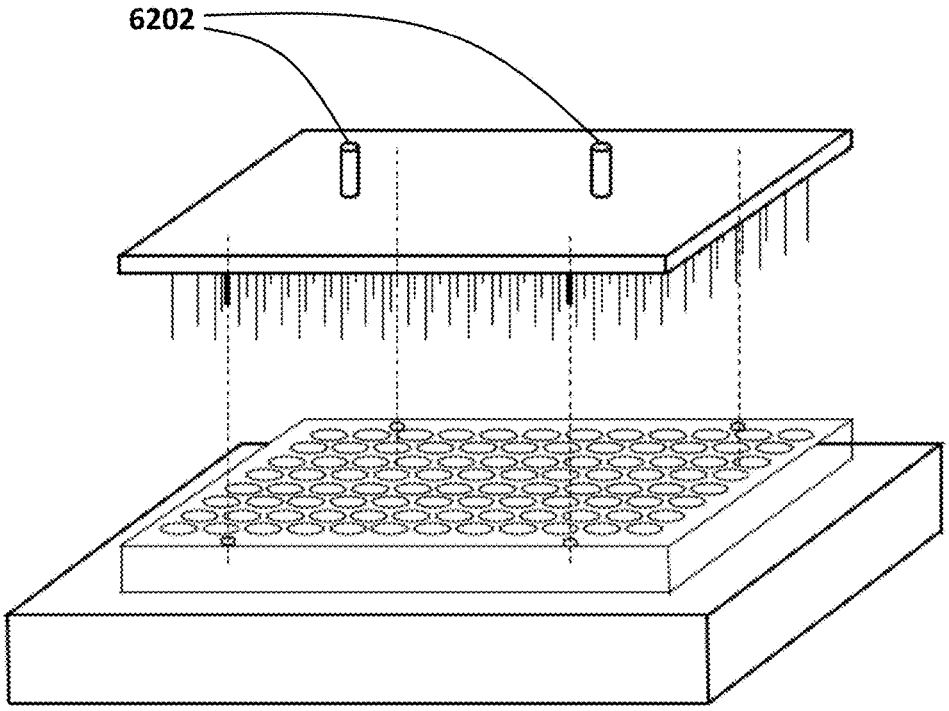
FIG. 62 provides a top down perspective view of a microplate mixing apparatus having two magnet motive elements.

FIG. 62 provides a top down perspective view of an embodiment of the microplate mixing apparatus described in FIG. 52 having two magnet motive elements 6202.

Figure 63:
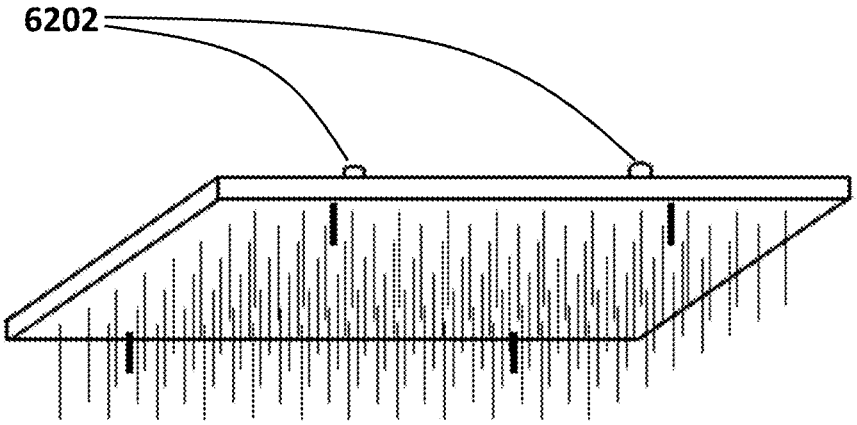
FIG. 63 provides a bottom up perspective view of an orbital plate module having two magnet motive elements.

FIG. 63 provides a bottom up perspective view of an embodiment of the orbital plate module described in FIG. 53 having two magnet motive elements 6202.

Figure 64:
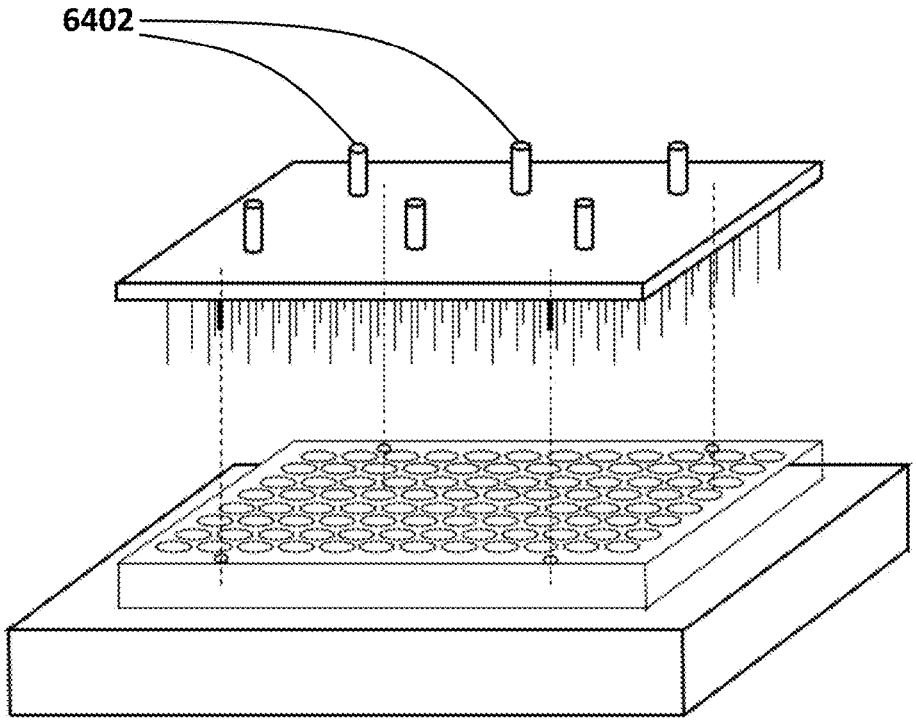
FIG. 64 provides a top down perspective view of a microplate mixing apparatus having six magnet motive elements.

FIG. 64 provides a top down perspective view of an embodiment of the microplate mixing apparatus described in FIG. 52 having six magnet motive elements 6402.

Figure 65:
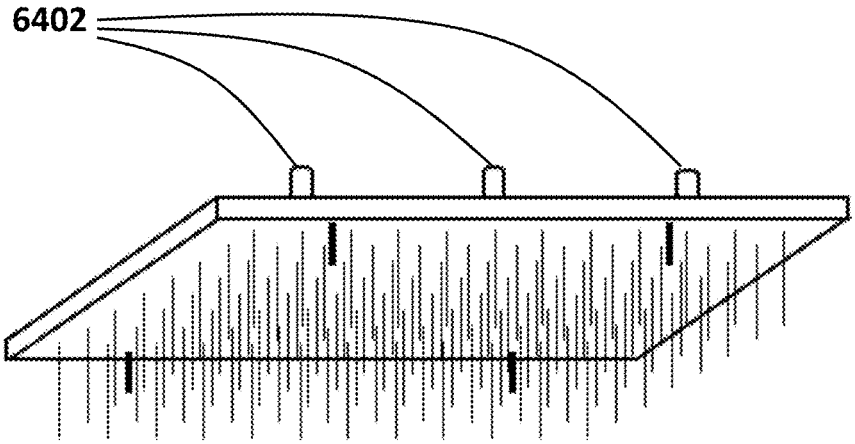
FIG. 65 provides a bottom up perspective view of an orbital plate module having six magnet motive elements.

FIG. 65 provides a bottom up perspective view of an embodiment of the orbital plate module described in FIG. 53 having six magnet motive elements 6402 (the perspective view only shows three of the six magnet motive elements).

The present embodiment is not limited to the shape of magnets that can be used. For example, cylinder shaped magnets or disk shaped magnets can be used as matched pairs, or mismatched combinations. Magnets are readily available from commercial sources, such as K&J Magnetics, Inc., 2110 Ashton Dr. Suite 1A, Jamison, Pa. 18929, http://www.kjmagnetics.com/; AMAZING MAGNETS 4081 E La Palma Ave Suite J, Anaheim, Calif. 92807, http://amazing-magnets.com/; Apex Magnets, 1841 Johnson Run Rd., Petersburg, W. Va. 26847, http://apexmagnets.com/; Viona Magnetics, PO Box 7104 Hicksville N.Y. 11802, http://www.vionamag.com/; and Stanford Magnets, 360 Goddard, Irvine, Calif. 92618, http://www.neodymium-magnet.net/.

Figure 66:
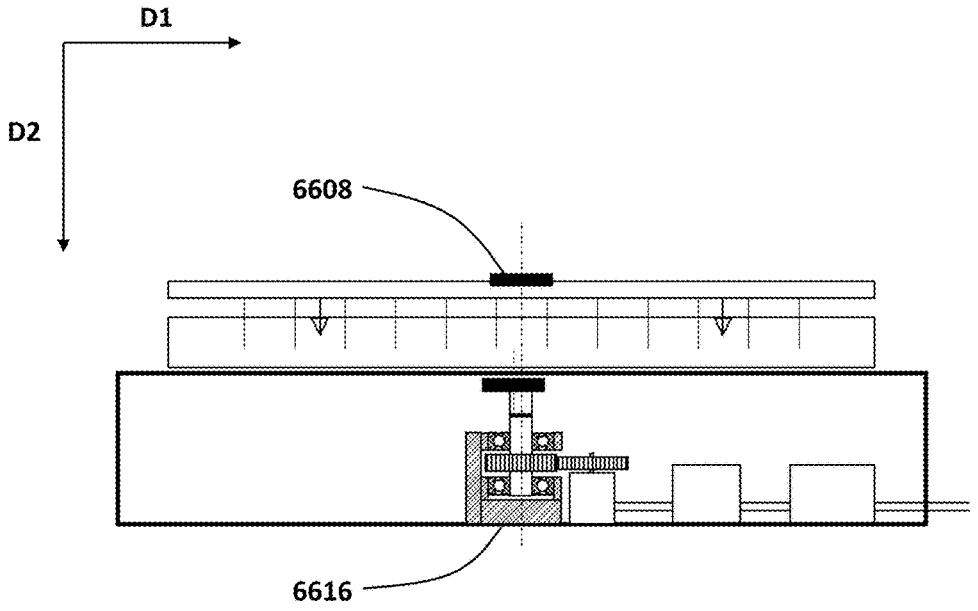
FIG. 66 provides a cross section view of a microplate mixing apparatus having a disk shaped magnet motive element.

FIG. 66 provides a cross section view of a microplate mixing apparatus of the present embodiment for stirring and/or mixing the contents of a microplate described in FIG. 54 having a disk shaped magnet 6608 instead of a cylinder shaped magnet motive element 5408, and having a magnet drive unit 6616 having a disk shaped magnet instead of a cylinder shaped magnet.

Figure 67:
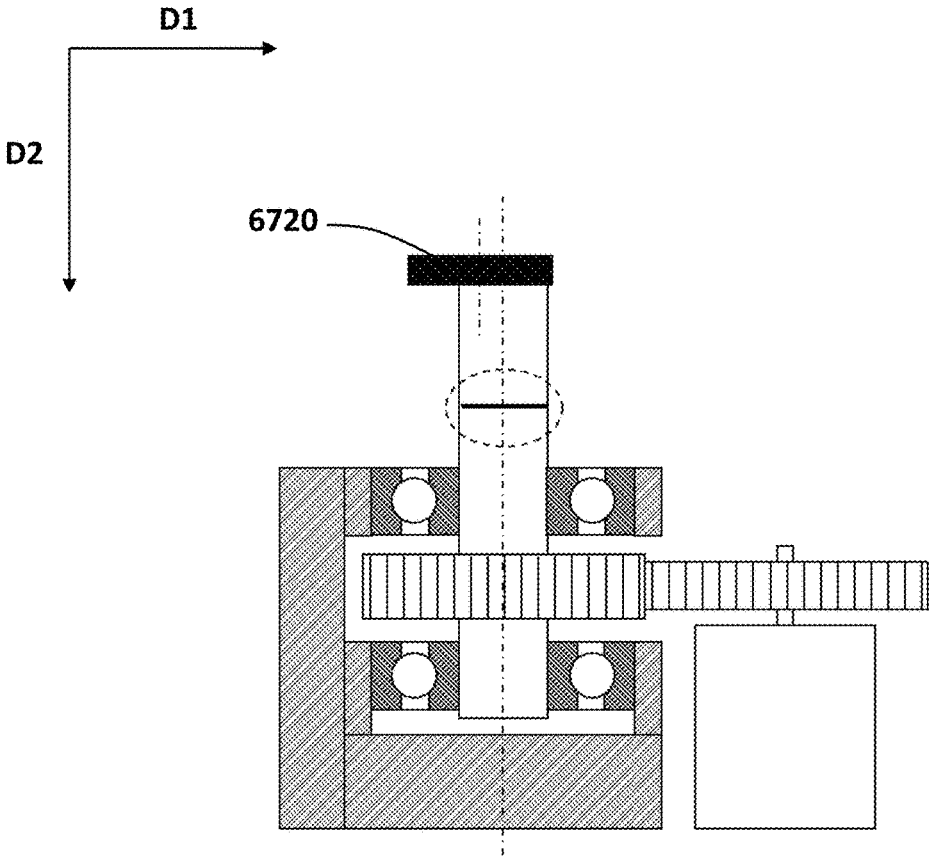
FIG. 67 provides a cross section view of a magnet drive unit having a disk shaped magnet.

FIG. 67 provides a cross section view of a magnet drive unit 6616 of shown in FIG. 66 and described in FIG. 55 having a disk shaped magnet 6720 instead of the cylinder shaped magnet 5520 shown in FIG. 55.

Figure 68:
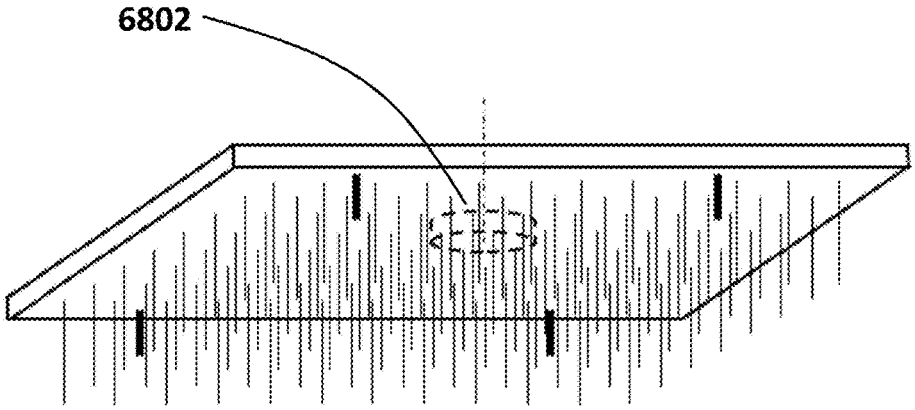
FIG. 68 provides a bottom up perspective view of the orbital plate module having a disk shaped magnet.

FIG. 68 provides a bottom up perspective view of the orbital plate module described in FIG. 53 having a disk shaped magnet 6802 (obscured by the body of the orbital plate) instead of the cylinder shaped magnet motive element 5208 shown in FIG. 53.

Figure 69:
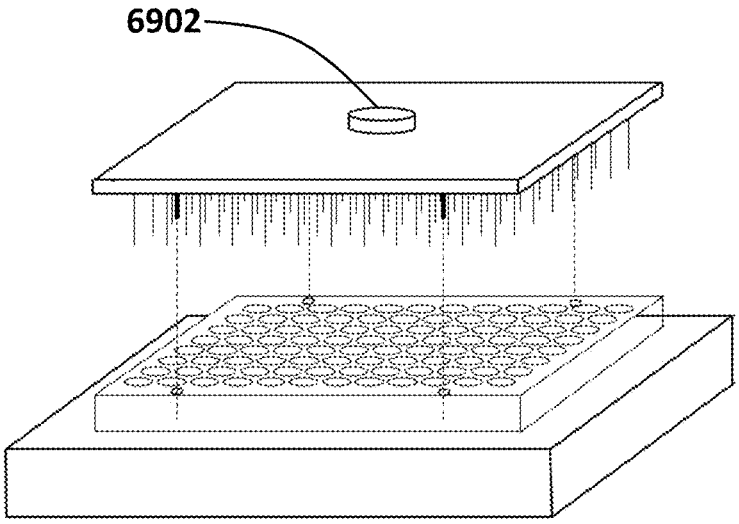
FIG. 69 provides a top down perspective view of a microplate mixing apparatus having a disk shaped magnet.

FIG. 69 provides a top down perspective view of a microplate mixing apparatus described in FIG. 52 having a disk shaped magnet 6902 instead of the cylinder shaped magnet motive element 5208 shown in FIG. 52.

Figure 76:
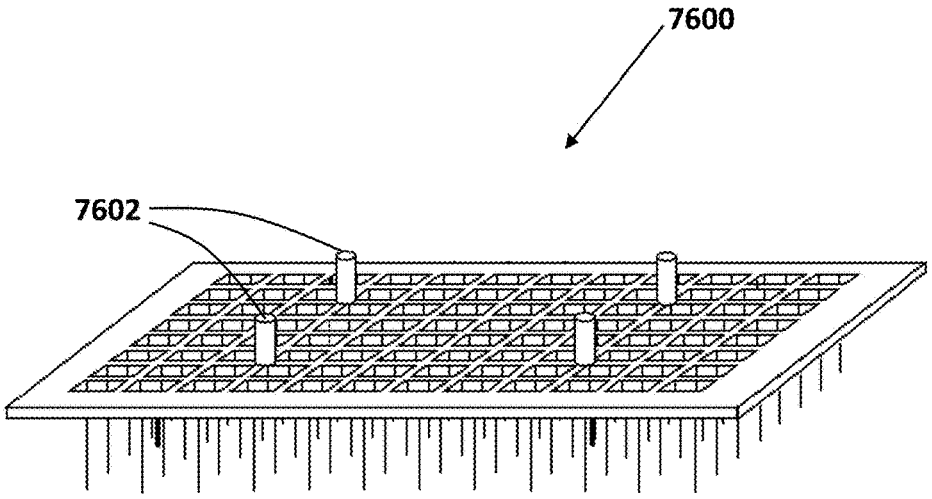
FIG. 76 provides a top down perspective view of an orbital lattice module having four magnet motive elements.

Another embodiment of the present disclosure provides an orbital lattice module having four magnet motive elements. FIG. 76 provides a top down perspective view of orbital lattice module 7600 of the present disclosure. The orbital lattice is similar to the orbital lattice module 5000 described in FIG. 50 with the exception that instead of the four vibration inducing units 5004, the present orbital lattice module has four magnet motive elements 7602.

Figure 77:
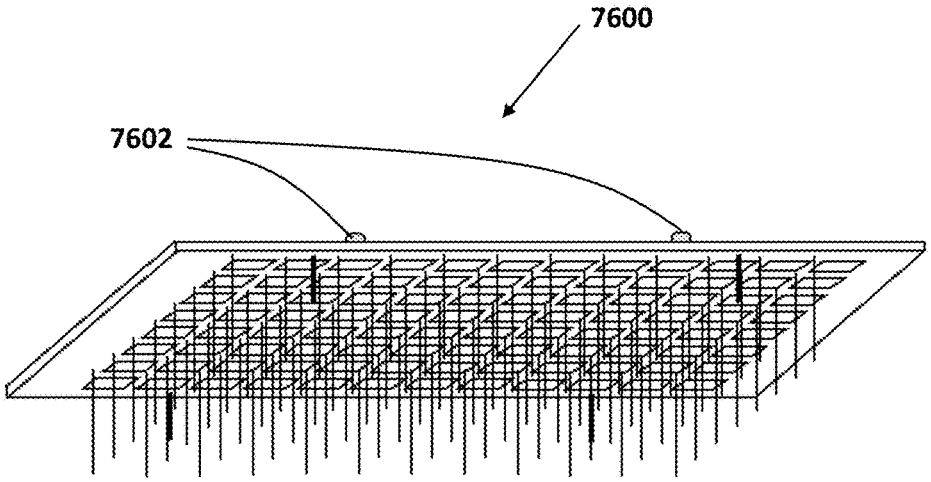
FIG. 77 provides a bottom up perspective view of an orbital lattice module having four magnet motive elements.

FIG. 77 provides a bottom up perspective view of the orbital lattice module 7600 having four magnet motive elements 7602 (the perspective view only shows two of the four magnet motive elements).

Alternatively, a plurality of electromagnets can be used in place of the magnet drive unit, for example as described in U.S. Pat. No. 7,364,350. Any number of suitable electromagnet coils may be used, for example 4, 5, 6, 7 or 8. The electromagnet coils are placed in a symmetrical pattern, such as a circle. The placement of the electromagnet coils determines the radius of the orbit of the magnetic field. Pulses of DC current are provided to the electromagnet coils in a sequential fashion. As an electromagnet coil is energized it creates a magnetic field for the duration for which it receives DC current. By sequentially energizing a plurality of electromagnet coils, an orbiting magnetic field can be created.

Figure 70:
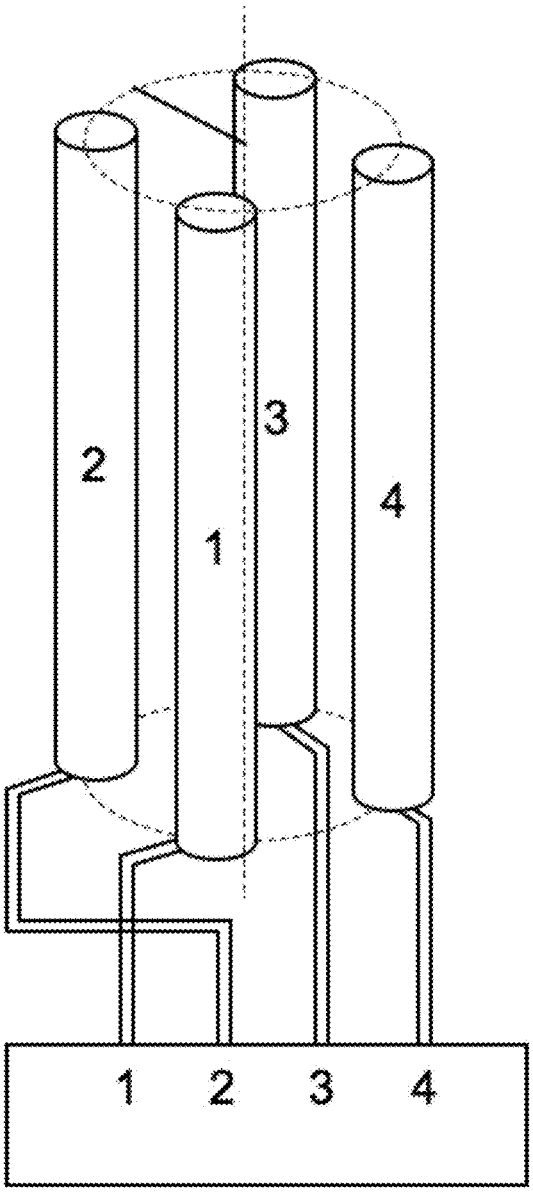
FIG. 70 provides a graphic depiction of a four electromagnet coil system.
Figure 71:
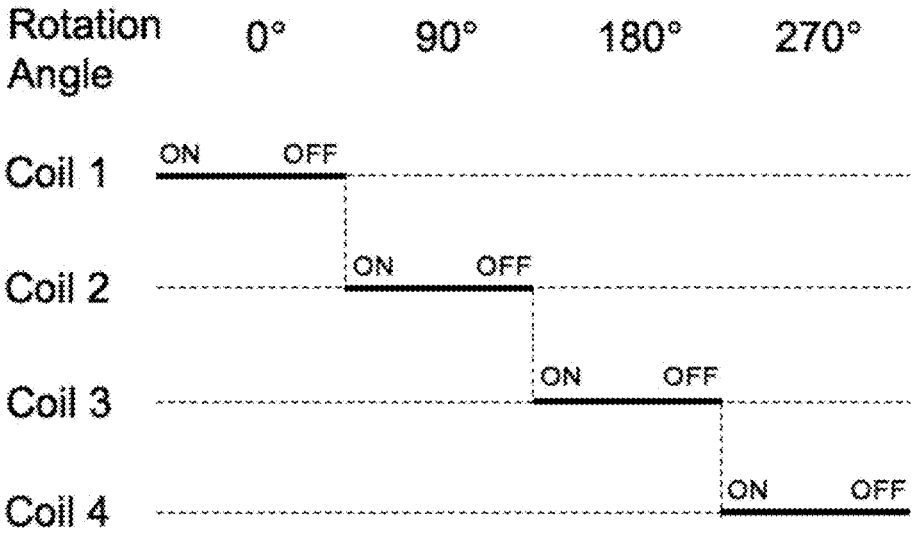
FIG. 71 shows the pulsing sequence for a four electromagnet coils to produce a orbiting magnetic field.

FIG. 70 provides a graphic depiction of a four electromagnet coil system. Each electromagnet coil is configured to be energized independently of the other electromagnet coils. FIG. 71 shows the pulsing sequence for the four electromagnet coils that result in the degrees of rotation of the resultant magnetic field.

An embodiment of the present disclosure teaches a microplate mixing apparatus that provides efficient and controlled mixing of liquids in the wells of standard microplates such as 96-well, 384-well or 1536-well plates. Mixing is achieved with a pin probe immersed in each well undergoing a swirling motion produced by a vibration inducing unit. The microplates are kept stationary during the stirring/mixing process.

As used herein the term "vibration inducing unit" refers to an eccentric rotating mass motor, also known as a pager motor or vibration motor. Eccentric rotating mass motors are available commercially with varying characteristics, including vibration speed, typically with a range from about 10 Hz to about 250 Hz, vibration amplitude from about 0.5 g to about 100 g, operating voltage as well as the physical shape, for example cylindrical or a coin, disk or pancake shape. As noted previously this type of motor is commercially available from numerous suppliers, for example, Precision Microdrives, Ltd., Canterbury Court Unit 1.05, 1-3 Brixton Road, London, SW9 6DE, United Kingdom (http://www-.precisionmicrodrives.com/vibrating-vibrator-vibration-motors; and https://catalog.precisionmicrodrives.com/order-parts/filter/vibration-motor.

As used herein the term "power source" refers to batteries, rechargeable batteries (including those that recharge within the device, or are removed for recharging). Alternatively, the power source may be located external to the device, where the external power source provides electrical power to the device via an electrical connection. A vibration inducing unit is commonly a DC motor with an offset mass, or an eccentric mass, attached to the motor shaft.

An aspect of the present embodiment provides for microplate mixing. Pins are attached to a flat plate having the lateral dimensions (width and depth) similar to those of a microplate to its lower surface perpendicularly at positions that match to the centers of all wells of a microplate. The pins attached to a plate are then lowered into microplate wells in such a way that one pin is inserted into every well. All pins have equal lengths and are sufficiently long to be immersed into the liquid in the well. The plate attached with pins that is the pin probe module, is made to fit to 96-well, 384-well, 1536-well plate or other multiple well microplates.

The pin probe module is then engaged with a plate to which a vibration inducing unit is attached. The vibration inducing unit is attached with its shaft axis perpendicular to the plate surface, where the eccentric rotating weight is as close as possible to the plate. The vibration inducing unit has amplitude rating adequate for shifting the combined weight of the orbital plate module and the pin probe module. The vibration inducing unit may be attached centered or off-center or on a side of the case or the plate with appropriate counter balances. When activated the vibration inducing unit causes the orbital plate module and the pin probe module to undergo orbital revolution as discussed above. The engaged orbital plate module and pin probe module induces a swirling motion of the pins attached, thereby effecting mixing in all wells of a microplate.

Alternatively the pin probe module and the orbital plate module can be combined as a single unit; or they may be configured so that once they are attached, they are not detachable. Further the pin probe module may have a plate made of a lattice. Use of lattice plates reduces the net weight, minimizing the load to the vibration inducing unit. Lattice plates may be made such that it has an open space next to each pin. With the vibration inducing unit placed on a side of the plate, this open space may be utilized to lower liquid delivery tips and dispense liquid into the wells while maintaining mixing.

The speed of mixing can be controlled continuously in real time by altering the voltage applied to the vibration inducing unit. The mixing speed is also influenced by the depth to which the pin is immersed and by the physical characteristics of the pin including the diameter, length and elasticity. A pin immersed shallowly is less effective but provides gentler mixing, while a pin immersed deeper provides more efficient and thorough mixing. A thinner and more elastic pin provides gentler mixing, while a thicker and more rigid pin provides more vigorous mixing. These parameters are selected based on the dimensions of the well, the volume and viscosity of sample liquid as well as the type of assays.

The device described above enables simultaneous and continuous mixing in all wells of a microplate at a controlled speed. Under this setup, the pin probe modules are exchangeable while the orbital plate modules are reusable. Pin probe modules may be used on a one time basis to avoid cross-contamination or made sterilized for certain applications such as cell-based assays.

Another aspect of the present embodiment provides a device for single well mixing. A single pin probe is attached to the portable stirring device discussed previously.

Another aspect of the present embodiment provides the portable stirring device having a probe attachment having a number pin probes corresponding to the number of wells in a row or column of a microplate, for example 8 or 12 for a 96 well microplate. In this manner 8 or 12 wells of a microplate can be manually stirred/mixed simultaneously.

An embodiment of the present disclosure provides a liquid handling system used for aspirating and dispensing liquids including, a controller; liquid handling assembly; a probe head assembly including a pipette tip ejector mechanism, at least one liquid handling channel, and a stirring module assembly.

Another aspect of the present disclosure provides a liquid handling system where the probe head assembly has one liquid handling channel.

Another aspect of the present disclosure provides a liquid handling system where the probe head assembly has a plurality of liquid handling channels.

Another aspect of the present disclosure provides a liquid handling system where the stirring module assembly includes a plurality of liquid handling channels each having a vibration transmission interface.

Another aspect of the present disclosure provides a liquid handling system where the stirring module assembly includes a stirring module base having at least one vibration inducing unit.

Another aspect of the present disclosure provides a liquid handling system where the plurality of liquid handling channels each having a vibration transmission interface including at least one vibration inducing unit.

Another aspect of the present disclosure provides a liquid handling system where the plurality of liquid handling channels each having a vibration transmission interface includes an ejector sleeve.

Another aspect of the present disclosure provides a liquid handling system where the stirring module assembly further comprising an ejector plate.

Another aspect of the present disclosure provides a liquid handling system where the stirring module assembly further comprising one liquid handling channel having a vibration transmission interface.

While the present invention has been illustrated and described herein in terms of an embodiment and several alternatives, it is to be understood that the techniques described herein can have a multitude of additional uses and applications. Accordingly, the invention should not be limited to just the particular description and various drawing figures contained in this specification that merely illustrate a preferred embodiment and application of the principles of the invention.

What is claimed is:

1. A portable stirring device comprising, a casing forming a first internal space, said casing having a proximal end and a distal end; said casing having a first part of an attachment mechanism at said distal end of said casing;

a detachable probe housing forming a second internal space, said detachable probe housing having a proximal section and distal section wherein said proximal section and said distal section are joined by a flexible joint; said detachable probe housing having a second part of said attachment mechanism at the proximal end of said proximal section of said detachable probe housing wherein said second part of said attachment mechanism is detachably attached to said first part of said attachment mechanism;

a vibration inducing unit enclosed within said second internal space of said distal section;

a power source enclosed within said first internal space for said vibration inducing unit; and a control unit enclosed within said first internal space for controlling said vibration inducing unit.

2. The portable stirring device of claim 1 further comprising a tapered appendage at said distal end of said distal section of said detachable probe housing.

3. The portable stirring device of claim 2 further comprising a probe tip detachably attached to said tapered appendage.

4. The portable stirring device of claim 3 further comprising a probe tip ejector for ejecting said probe tip.

5. The portable stirring device of claim 1 wherein said flexible joint is a sleeve.

6. The portable stirring device of claim 1 wherein said flexible joint is a flexible bellows.

7. The portable stirring device of claim 1 wherein said flexible joint is a vibration transmission interface forming a helical space in the wall of said vibration transmission interface.

8. The portable stirring device of claim 3 wherein said probe tip is a pipette tip.

9. The portable stirring device of claim 3 wherein said probe tip is a pin probe.

10. The portable stirring device of claim 3 wherein said pin probe has a plurality of pins for mixing a plurality of microplate wells simultaneously.

11. The pin probe of claim 10, wherein said pin probe has 12 pins.

12. The pin probe of claim 10, wherein said pin probe has 8 pins.

13. The pin probe of claim 10, wherein said pin probe has 6 pins.

14. The pin probe of claim 10, wherein said pin probe has 4 pins.

15. The pin probe of claim 10, wherein said pin probe has 3 pins.

16. The pin probe of claim 10, wherein said pin probe has 2 pins.

* * * * *